US011213081B2

(12) United States Patent
Sperry

(10) Patent No.: US 11,213,081 B2
(45) Date of Patent: Jan. 4, 2022

(54) QUICK DONNING DISPOSABLE GLOVES

(71) Applicant: Sperry Product Innovation, Inc., Bedford, MA (US)

(72) Inventor: Laurence B. Sperry, Bedford, MA (US)

(73) Assignee: Sperry Product Innovation, Inc., Bedford, MA (US)

( * ) Notice: Subject to any disclaimer, the term of this patent is extended or adjusted under 35 U.S.C. 154(b) by 143 days.

(21) Appl. No.: 16/451,843

(22) Filed: Jun. 25, 2019

(65) Prior Publication Data

US 2019/0387819 A1 Dec. 26, 2019

Related U.S. Application Data

(60) Provisional application No. 62/689,670, filed on Jun. 25, 2018.

(51) Int. Cl.
*A41D 19/00* (2006.01)

(52) U.S. Cl.
CPC ..... *A41D 19/0082* (2013.01); *A41D 19/0044* (2013.01); *A41D 19/0058* (2013.01); *A41D 19/0072* (2013.01)

(58) Field of Classification Search
CPC ..... A41D 19/0068; A41D 19/0072; A41D 19/0044; A41D 19/0062; A41D 19/0058; A41D 19/0055; A41D 19/0075; A41D 19/0082
USPC ..... 2/168
See application file for complete search history.

(56) References Cited

U.S. PATENT DOCUMENTS 1,037,946 A * 9/1912 Mahieu ..... A41D 19/02 2/169
D171,524 S * 2/1954 Baender ..... A41D 19/0068 D2/622
4,411,026 A * 10/1983 Secter ..... A41D 19/00 2/158
5,806,099 A * 9/1998 Grinberg ..... A41D 19/0068 2/158
5,921,434 A 7/1999 Hollander et al.
5,961,167 A * 10/1999 Gilley ..... A41D 19/0068 2/159
5,966,741 A * 10/1999 Klecina ..... A41D 19/0068 2/159

(Continued)

FOREIGN PATENT DOCUMENTS

JP 2016079521 A 5/2016
WO WO 2016/077886 A1 5/2016
WO WO 2019/022703 A1 1/2019

OTHER PUBLICATIONS

International Search Report in International Application No. PCT/US2019/038991.

*Primary Examiner* — Amy Vanatta
(74) *Attorney, Agent, or Firm* — Morse, Barnes-Brown & Pendleton, P.C.; Sean D. Detweiler, Esq.

(57) ABSTRACT

A disposable glove and system are provided that has features and characteristic that enable a cuff opening of the glove to more easily open, thereby assisting in donning the glove. The disposable glove system includes stacked glove configurations for mounting and storage. The disposable glove system also includes features that make the disposable gloves easier to dispense from a dispenser with minimal user contact with the outer surface of the disposable gloves.

18 Claims, 49 Drawing Sheets

(56) References Cited

U.S. PATENT DOCUMENTS

| | | | | |
|---|---|---|---|---|
| 6,637,035 | B1 * | 10/2003 | Brinkmann | A41D 19/0068 15/227 |
| 6,708,840 | B2 | 3/2004 | Grinberg | |
| 2006/0049199 | A1 | 3/2006 | West | |
| 2006/0260021 | A1 * | 11/2006 | Kerr-Maddox | A41D 19/0034 2/159 |
| 2007/0150996 | A1 | 7/2007 | McCarville | |
| 2015/0296902 | A1 | 10/2015 | Lin et al. | |
| 2016/0157647 | A1 | 6/2016 | Rampersad | |
| 2017/0156809 | A1 | 6/2017 | Denisson et al. | |
| 2020/0138130 | A1 * | 5/2020 | Harrison | A61B 42/10 |

* cited by examiner

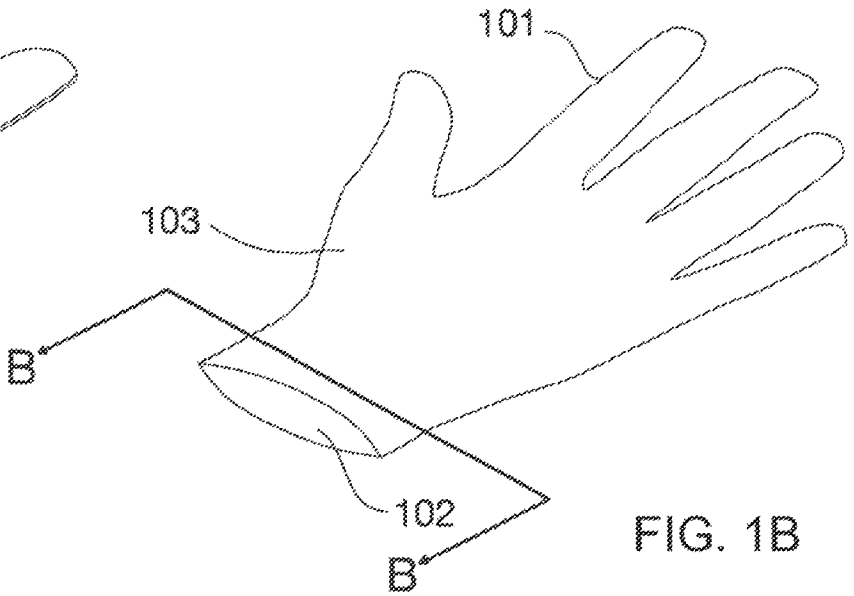
FIG. 1B
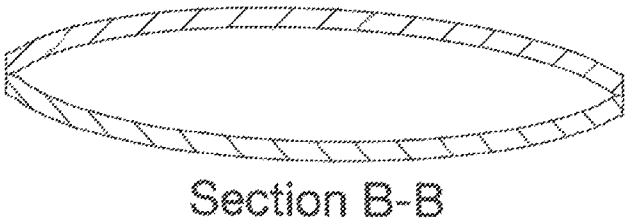
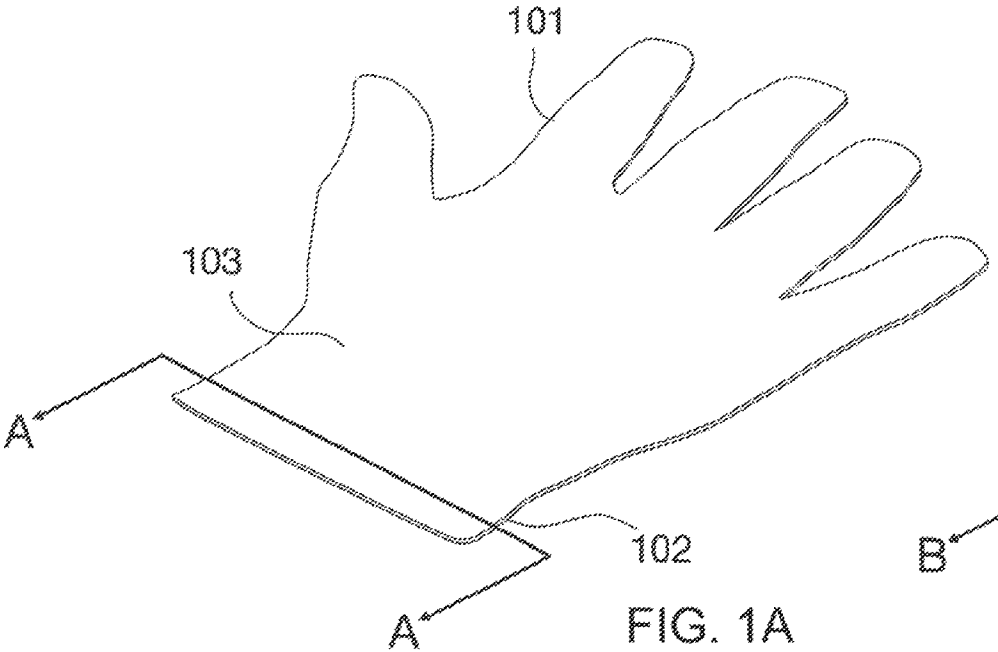
FIG. 1A
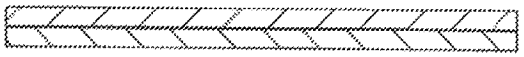
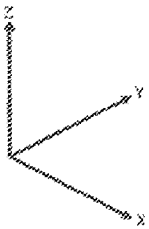

103
164
102
115
A
A 148
147
Section A-A
103
164
102
115
B
B 148
147
Section B-B
103
164
102
C
C 148
147
Section C-C
z
y
x

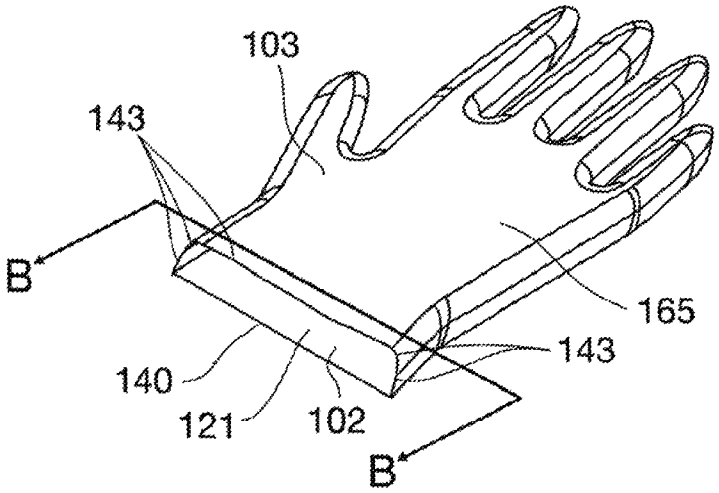
FIG. 3B
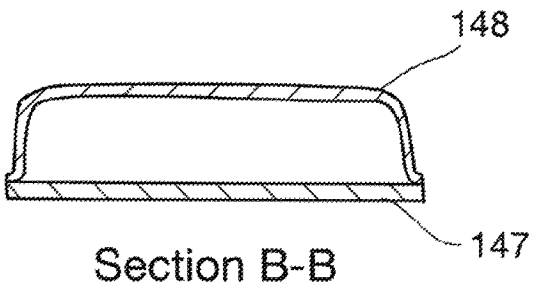
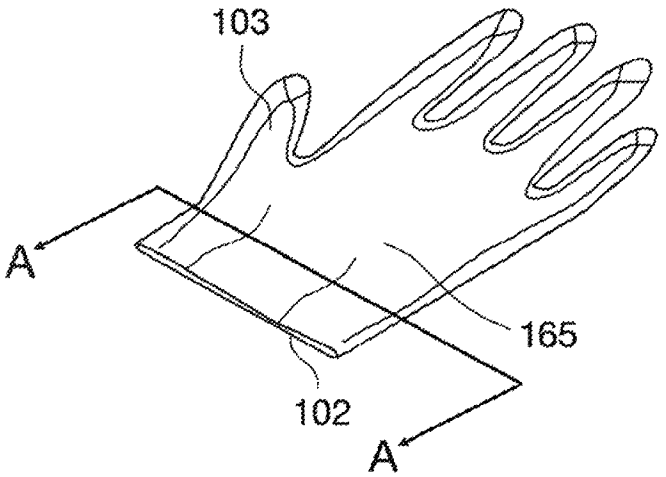
FIG. 3A
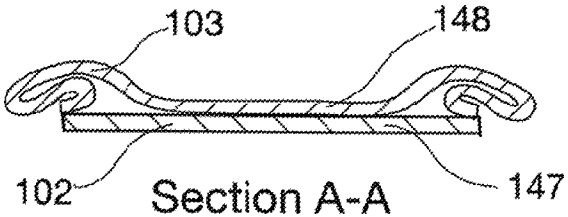
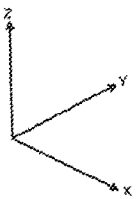

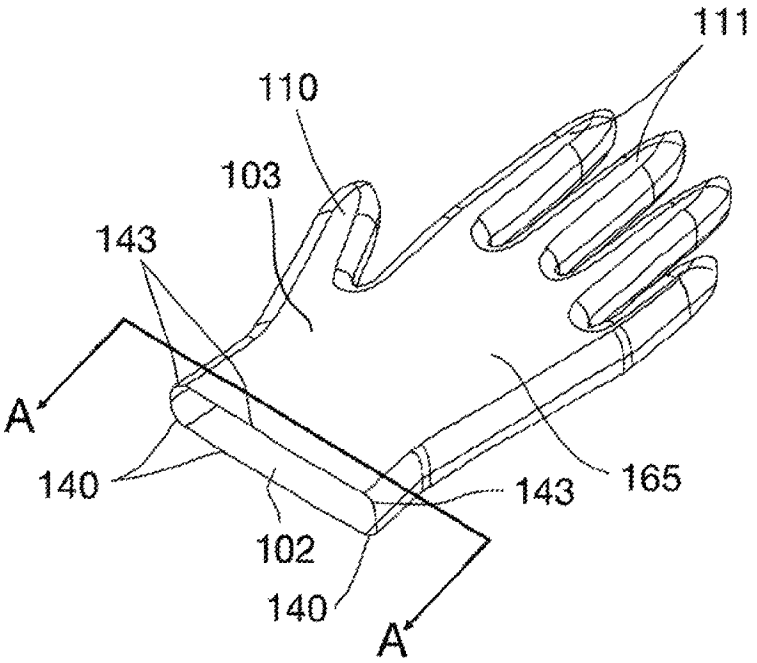
FIG. 5B
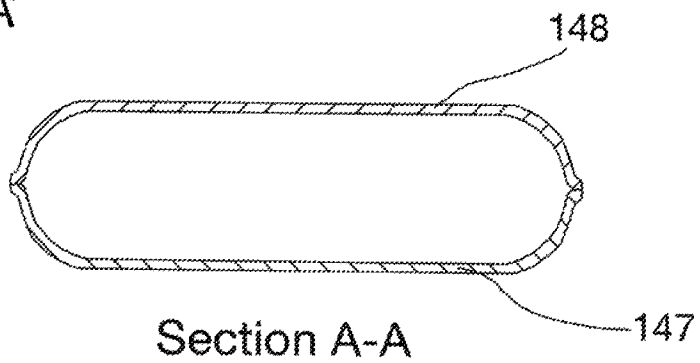
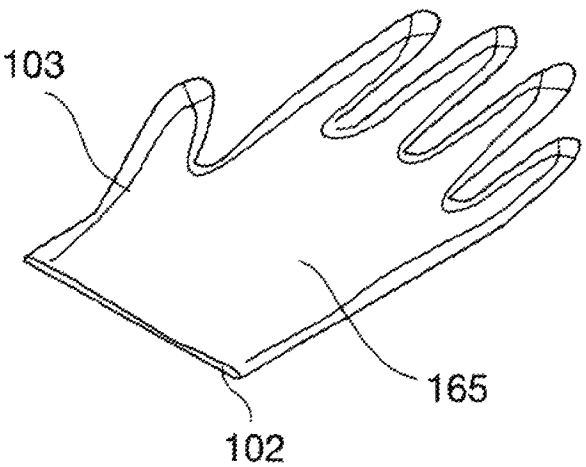
FIG. 5A
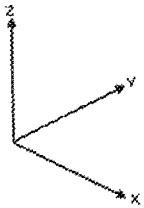

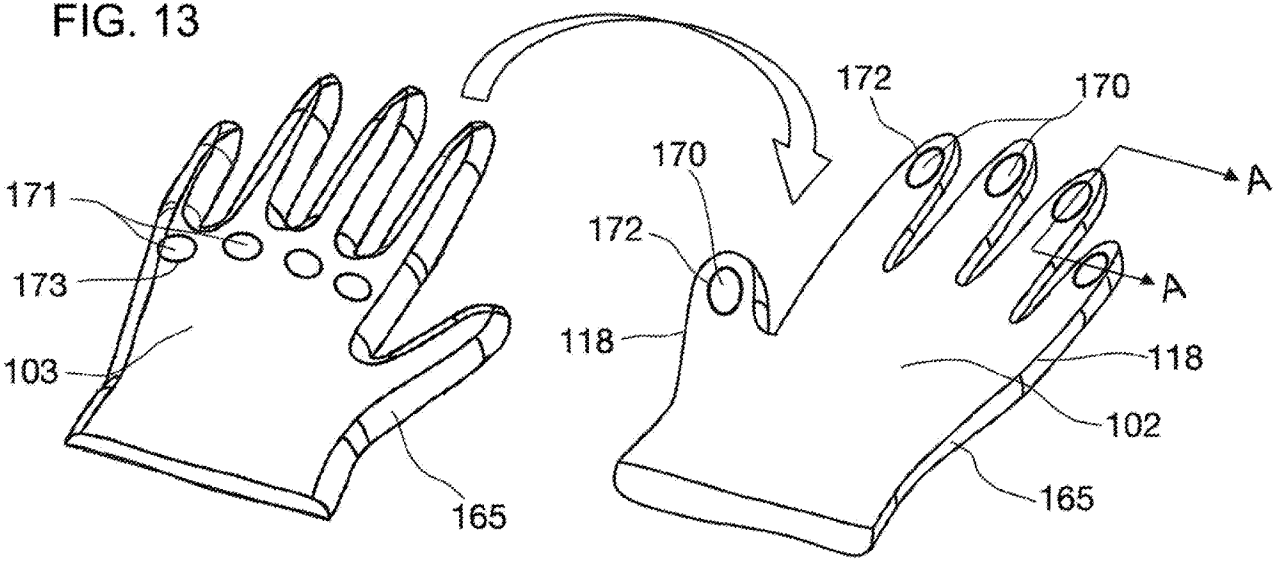
FIG. 13
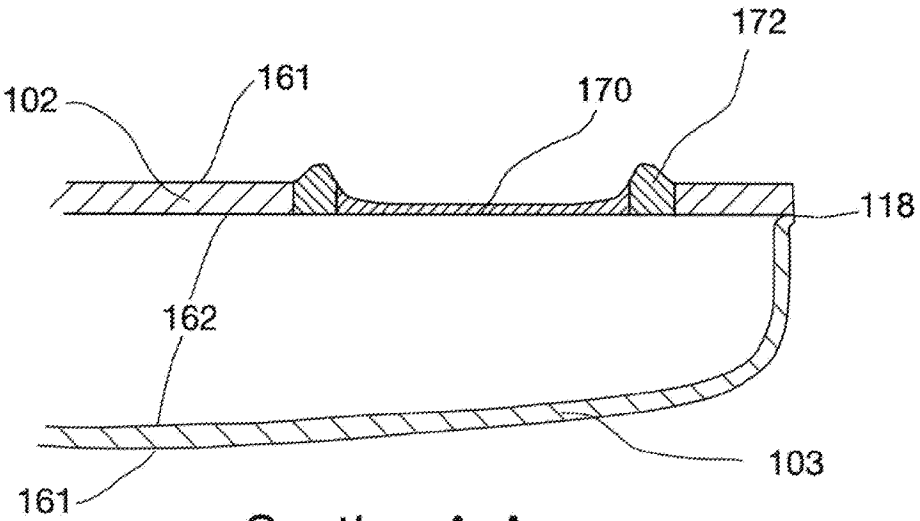
Section A-A 149
122
150
102
101
103
159
150
116
143

150
150
121
116
115
101

116
101

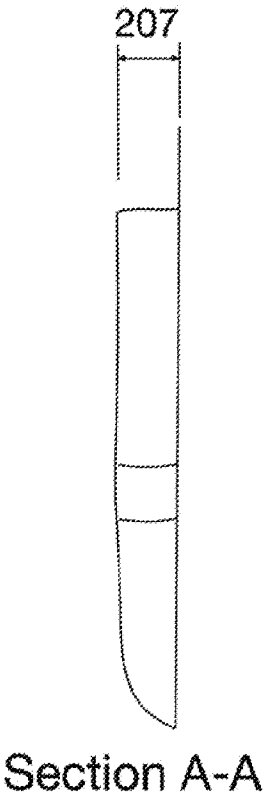
FIG. 23B
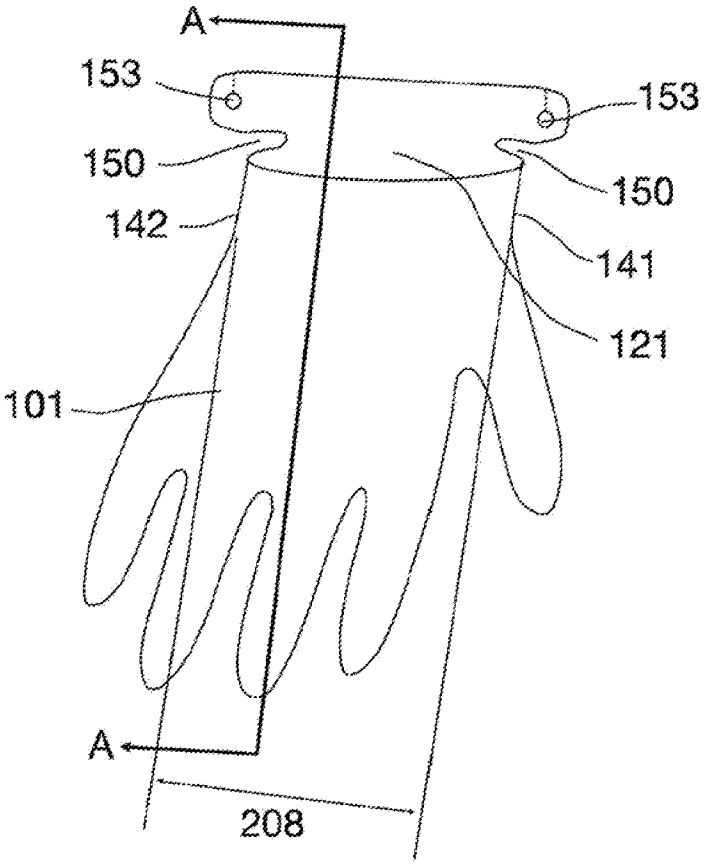
FIG. 23A
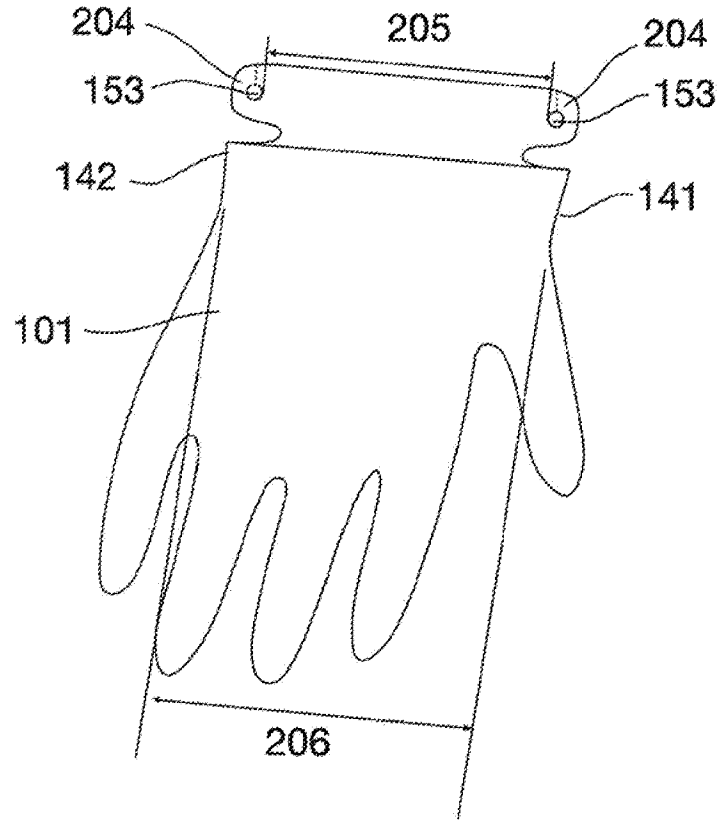

QUICK DONNING DISPOSABLE GLOVES

CROSS-REFERENCE TO RELATED APPLICATION(S)

This application claims priority to, and the benefit of, U.S. Provisional Application 62/689,670 filed Jun. 25, 2018 for all subject matter common to both applications. The disclosure of said provisional application is hereby incorporated by reference in its entirety.

FIELD OF THE INVENTION

The present invention relates to disposable gloves for the service industry. In particular, the present invention relates to disposable gloves having features that make them easier to don by a user.

BACKGROUND

The service industry, such as food service or cleaning service, often requires workers to wear gloves to prevent cross-contamination. Gloves are often one-time use disposable gloves where the risk of cross-contamination is reduced with frequent glove changes. For example, a food service worker will don fresh gloves for each customer to prevent cross-contamination of foods or after handling money or other non-food items.

Conventional elastomeric (nitrile or similar) gloves are generally manufactured using a dipping process over a form of a hand. These gloves are designed to be close in size to a user's hand and stretch when donned to conform tightly to the hand. Although the conformed fit is beneficial to the usability, elastomeric gloves are generally costly and overcoming the elastomeric nature of the material makes for a difficult and time consuming donning process.

A conventional and cost-effective solution is to use two layers of substantially non-elastic plastic material (polyethylene or similar) sealed together to form the anterior (palm side of the hand) and posterior (back side of the hand) portions of the glove. The gloves have the general profiled shape of a hand but because the flat profiled shape of these gloves needs to fit the three-dimensional shape of a user's hand, the gloves require excess material for the geometric transformation. Two-layer gloves are also resistant to transitioning to the three-dimensional donned shape, preferring to hold to their flattened shape. Flattened two-layer gloves are prone to bending and kinking, making them further resistant to donning and the internal surfaces of plastic gloves generally stick to wet surfaces such that sweaty or wet hands even further complicate the donning process. Two-layer gloves are difficult and slow to don, they do not provide for a good fit, and they are generally uncomfortable to wear.

Some quick don glove solutions exist, which feature stacks of gloves with relatively easy access to the glove opening for inserting a hand and separating a glove from the stack with the action of donning. Quick don glove products can be advantageous over other glove products available but existing options suffer from a number of shortcomings. Existing solutions either consist of overly involved equipment or overly simplistic approaches that impede the path of donning with remnant glove stack material or glove mounts that reside directly in the path of donning.

The difficult donning process for both elastomeric gloves and non-elastic gloves is also further complicated since the user should not contact the exterior surfaces of the glove to limit the spread of contamination.

Escalating public awareness and understanding of the environmental impact of disposable plastic products provides another deterrent for the usage of disposable gloves in general. Conventional two layer gloves are often contaminated with food and unable to be properly recycled where food products inhibit the recyclability of plastic, consequently, gloves are usually thrown out and not recycled.

SUMMARY

There is a need for a disposable glove that is fast and simple to don and is low cost, comfortable to wear, and of an appropriate size and fit for conducting manual operations. The present invention is directed toward further solutions to address this need, in addition to having other desirable characteristics. Specifically, the disposable glove has features that allow the cuff of the glove to more easily open assisting in donning the glove. The disposable gloves are stackable for mounting and storage. The disposable gloves also include features that make the glove easier to dispense from a dispenser with minimal user contact with the outer surface of the glove.

In accordance with example embodiments of the present invention, a disposable glove is provided. The disposable glove includes a first layer of thermoplastic material and a second layer of thermoplastic material. The first layer of thermoplastic material has a first perimeter border generally in the shape of a human hand and includes a first middle section configured to span interchangeably a palmar aspect and a dorsal aspect of a user's hand based on whether the user's hand is left hand or right hand. The second layer of thermoplastic material has a second perimeter border generally in the shape of a human hand and includes a second middle section configured to span interchangeably a palmar aspect and a dorsal aspect of a user's hand based on whether the user's hand is a left hand or right hand. The first layer and the second layer are coupled together at and along the first perimeter border and the second perimeter border in such a way that results in the disposable glove. The disposable glove has a biased open cuff opening configured to receive a user's left hand or a user's right hand therethrough, wherein the first middle section and the second middle section have different total areas from each other in such a way that one of the first middle section and second middle section contain extra material and does not lay flat, causing the biased open cuff opening to maintain a steady-state open configuration facilitating donning of the disposable glove.

In accordance with an aspect of the present invention, at least one of the first layer and second layer comprises a starch based thermoplastic.

In accordance with an aspect of the present invention, the thermoplastic material of at least one of the first layer and second layer has a thickness between 0.5 mils and 3 mils.

In accordance with an aspect of the present invention, at least one of the first layer and second layer comprises formed geometry. In certain instances, the formed geometry comprises a three-dimensional form generally shaped to fit a human hand. The geometry may be formed by extruding the thermoplastic material to a depth between about 0.1 inches to about 2.5 inches. In certain instances, the formed geometry comprises features for facilitating compression and elastic deformation of the disposable glove for storage. In other instances, when in a compressed state, the extra material of the formed geometry provides structural rigidity to disposable glove.

In accordance with an aspect, at least one of the first layer or second layer has extra cuff length so to extend beyond the cuff of the other layer resulting in an offset cuff feature.

In accordance with an aspect, the disposable glove further includes one or more mounting features for mounting the disposable glove. In certain instances, the one or more mounting features are configured to separate from the disposable glove when disposable glove is unmounted and donned by a user. In other instances, the one or more mounting features are configured to release with disposable glove when disposable glove is unmounted and donned by a user. In some instances, the one or more mounting features are attached to one of the first layer and second layer. In other instances, the one or more mounting features are asymmetrical for facilitating correct orientation when mounting. In still other instances, the one or more mounting features are configured to facilitating the stacking of one or more disposable gloves in an elastically deformed and compressed closed state. In certain instances the one or more mounting features are spaced such that the one or more mounting features are located within the width of the cuff of the disposable glove in its elastically deformed and compressed state and located outside the width of the cuff of the disposable glove in an open state.

In accordance with an aspect of the present invention, the disposable glove is configured to be interchangeably right-handed or left-handed.

In accordance with an aspect of the present invention, the disposable glove further includes a tab extending from the biased open cuff of the disposable glove on at least one of the first layer and second layer.

In accordance with an aspect of the present invention, the disposable glove is disposed within a stack of a plurality of disposable gloves underneath the plurality of disposable gloves, the biased open cuff is held in a closed state by the stack of the plurality of disposable gloves and returns to the open state when the disposable glove is disposed in a top most position on top of the stack of the plurality of disposable gloves. In some instances, the stack of plurality of disposable gloves are all the either right-handed or left-handed gloves. In certain instances, the disposable glove is treated to adhere to other to disposable gloves in the stack.

In accordance with an example embodiment of the present invention, a stack of disposable gloves is provided. The stack consists of one or more disposable gloves having a first layer of thermoplastic material and a second layer of thermoplastic material. The first layer of thermoplastic material has a first perimeter border generally in the shape of a human hand and includes a first middle section configured to span interchangeably a palmar aspect and a dorsal aspect of a user's hand based on whether the user's hand is left hand or right hand. The second layer of thermoplastic material has a second perimeter border generally in the shape of a human hand and includes a second middle section configured to span interchangeably a palmar aspect and a dorsal aspect of a user's hand based on whether the user's hand is a left hand or right hand. The first layer and second layer are coupled together at and along the first perimeter border and the second perimeter border in such a way that results in the one or more disposable gloves. The disposable glove has a cuff opening configured to receive a user's left hand or a user's right hand therethrough. The disposable glove also has one or more mounting features extending from the at least one of first or second layers at the cuff of the disposable glove for connecting the disposable glove to the stack of disposable gloves and one or more opening reliefs where the one or more mounting features extend from the at least one of first or second layers at the cuff of the disposable glove. The one or more opening reliefs provide slack in the cuff facilitating donning of the disposable glove while the mounting features are connecting the disposable glove to the stack.

In accordance with an aspect of the present invention, the opening reliefs comprise separation lines, that when torn, provide slack in the cuff facilitating donning of the disposable glove while the mounting features still couple the disposable glove to the stack.

In accordance with an aspect of the present invention, at least one of the first layer or second layer has extra cuff length so to extend beyond the cuff of the other layer resulting in an offset cuff from which the mounting features extend.

In accordance with an aspect of the present invention, when the disposable glove is disposed within a stack of a plurality of disposable gloves underneath the plurality of disposable gloves, the cuff is held in a closed state by the stack of the plurality of disposable gloves and transitions to the open state when the disposable glove is disposed in a top most position on top of the stack of the plurality of disposable gloves enabling the opening reliefs to provide slack in the cuff.

In accordance with an aspect of the present invention, the one or more mounting features are asymmetrical for facilitating correct orientation when mounting the stack in a dispenser. In certain instances, the one or more mounting features are configured to separate from the disposable glove when the disposable glove is removed from the stack. In other instances, the one or more mounting features are configured to release with the disposable glove when the disposable glove is removed from the stack.

In accordance with an aspect of the present invention, the one or more disposable gloves are all the either right-handed or left-handed gloves.

In accordance with an aspect of the present invention, the one or more disposable gloves are treated to adhere to other disposable gloves in the stack. In certain instances the treatment is chemical. In other instances the treatment is electrostatic. In still other instances, the treatment is heat.

In accordance with an example embodiment of the present invention, a dispenser for disposable gloves is provided. The dispenser includes a base for supporting dispenser; a support frame extending from the base; a first mounting face attached to the support frame; a first set of mounts for holding a first stack of disposable gloves on the first mounting face; a second mounting face attached to the support frame opposite and adjacent to the first mounting face; and a second set of mounts for holding a second stack of disposable gloves on the second mounting face.

In accordance with an aspect of the present invention, the dispenser further includes a first stack of disposable gloves mounted on the first mounting face and a second stack of gloves mounted on the second mounting face. In certain instances, the stack of gloves consists of one or more disposable gloves having a first layer of thermoplastic material and a second layer of thermoplastic material. The first layer of thermoplastic material has a first perimeter border generally in the shape of a human hand and includes a first middle section configured to span interchangeably a palmar aspect and a dorsal aspect of a user's hand based on whether the user's hand is left hand or right hand. The second layer of thermoplastic material has a second perimeter border generally in the shape of a human hand and includes a second middle section configured to span interchangeably a palmar aspect and a dorsal aspect of a user's hand based on whether the user's hand is a left hand or right hand. The first layer and second layer are coupled together at and along the first perimeter border and the second perimeter border in such a way that results in the one or more disposable gloves. The disposable glove has a biased open cuff opening configured to receive a user's left hand or a user's right hand therethrough. The disposable glove also has one or more mounting features for mounting the one or more disposable gloves on the one or more mounts of at least one of the first or second mounting faces of the dispenser. The first middle section and the second middle section have different total areas from each other in such a way that one of the first middle section and second middle section contain extra material and does not lay flat, causing the biased open cuff of the one or more disposable gloves to have a steady-state open state facilitating donning of the one or more disposable gloves. The one or more disposable gloves are in an elastically deformed and compressed closed state wherein the biased open cuff of the one or more disposable gloves is held in a closed state by the one or more other disposable gloves in the stack of disposable gloves and transitions to the open state when the one or more disposable gloves holding the biased open cuff in a closed state are removed. In other instances, the first and second stack consist of one or more disposable gloves having a first layer of thermoplastic material and a second layer of thermoplastic material. The first layer of thermoplastic material has a first perimeter border generally in the shape of a human hand and includes a first middle section configured to span interchangeably a palmar aspect and a dorsal aspect of a user's hand based on whether the user's hand is left hand or right hand. The second layer of thermoplastic material has a second perimeter border generally in the shape of a human hand and includes a second middle section configured to span interchangeably a palmar aspect and a dorsal aspect of a user's hand based on whether the user's hand is a left hand or right hand. The first layer and second layer are coupled together at and along the first perimeter border and the second perimeter border in such a way that results in the one or more disposable gloves. The disposable glove has a cuff opening configured to receive a user's left hand or a user's right hand therethrough. The disposable glove also has one or more mounting features extending from the at least one of first or second layers at the cuff of the disposable glove for connecting the disposable glove to the stack of disposable gloves and mounting on at least one of the first and second mounting faces. The disposable glove also has one or more opening reliefs where the one or more mounting features extend from the at least one of first or second layers at the cuff of the disposable glove; wherein the one or more opening reliefs provide slack in the cuff facilitating donning of the disposable glove while the mounting features are connecting the disposable glove to the stack.

In accordance with an aspect of the present invention, the second mounting face is not orientated parallel with the first mounting face.

In accordance with an aspect of the present invention, the orientation of the first mounting face and second mounting face are angularly splayed to each other.

In accordance with an aspect of the present invention, the orientation of the first mounting face and second mounting face are adjustable in relation to each other and the dispenser base.

In accordance with an aspect of the present invention, the first set of mounts and second set of mounts are independent of the first mounting face and second mounting face. In certain instances, at least one of the first mounting face and second mounting face are biased in relation to the first set of mounts and second set of mounts so as to provide a retention force for holding the first stack and second stack of disposable gloves on the mounts. In some such instances the bias is provided by a spring mechanism. In still other instances, at least one of the first mounting face and second mounting face are configured to deflect when a user inserts a hand into the cuff of the one or more disposable gloves to assist donning of the one or more disposable gloves. In certain other instances, the first set of mount and second set of mounts are biased in relation to at least one of the first mounting face and second mounting face so as to provide a retention force for holding the first stack and second stack of disposable gloves on the mounts. In some such instances, the bias is provided by a spring mechanism.

In accordance with an aspect of the invention, the mounts are asymmetrical to facilitate mounting stacks of disposable gloves in the correct orientation.

In accordance with an aspect of the present invention, the first and second mounting faces are configured to provide support for the stack of disposable gloves while a user dons the topmost disposable glove in the stack. In some instances, at least one of the first mounting face and second mounting face further comprise depressions in their respective surfaces to enable a disposable glove mounted on the dispenser to open to assist in donning. In other instances, at least one of the first mounting face and second mounting face further comprise curved surfaces to enable a disposable glove mounted on the dispenser to open to assist donning.

In accordance with an aspect of the present invention, the dispenser further includes an air jet for providing a burst of air to assist in opening the biased open cuff of a disposable glove mounted on the dispenser for donning.

In accordance with an aspect of the present invention, the first mounting face is configured to hold a stack of left-handed gloves and the second mounting face is configured to hold a stack of right-handed gloves.

In accordance with an example embodiment of the present invention, a method of manufacturing a disposable glove is presented. The method involves providing a first layer of thermoplastic material, providing a second layer of thermoplastic material, forming at least one of the first layer and second layer into a three-dimensional shape generally conforming to a human hand including a middle section configured to span interchangeably a palmar aspect and a dorsal aspect of a user's hand based on whether the user's hand is a left hand or right hand, coupling the first layer to the second layer such that a resulting middle section of the first layer and a resulting middle section of the second layer have different total areas from each other in such a way that when one of the resulting middle section of the first layer and the resulting middle section of the second layer contain extra material and does not lay flat, causing a biased open cuff of the disposable glove to be in a steady-state open state facilitating donning of the disposable glove, and cutting the coupled first layer and second layer to have a perimeter border generally in the shape of a human hand.

In accordance with an aspect of the invention, forming at least one of the first layer or second layer of material consists of vacuum forming at least one of the first layer and second layer on a mold.

In accordance with an aspect of the invention, the coupling of the first layer and second layer is performed while at least one of the first layer and second layer is still on the mold.

In accordance with an aspect of the invention, the cutting of the coupled first layer and second layer is performed while at least one of the first layer and second layer is still on the mold.

In accordance with an aspect of the invention, at least one of the first layer and second layer comprises a starch based thermoplastic.

In accordance with an aspect of the invention, at least one of the first layer and second layer comprises sub layers.

In accordance with an aspect of the invention, the thermoplastic material of at least one of the first layer and second layer has a thickness between about 0.5 mils and about 3 mils.

In accordance with an aspect of the invention, the first layer and second layer are made of different thermoplastic materials.

In accordance with an aspect of the invention, at least one of the first layer and second layer comprises formed geometry. In some instances, the formed geometry comprises a three-dimensional form generally shaped to fit a human hand. In other instances, the formed geometry comprises extruded features.

In accordance with an aspect of the invention, at least one of the first layer and second layer further includes one or more mounting features.

In accordance with an example embodiment of the present invention, a disposable glove is provided. The disposable glove includes a first layer of thermoplastic material and a second layer of thermoplastic material. The first layer of thermoplastic material has a first perimeter border generally in the shape of a human hand and includes a first middle section configured to span interchangeably a palmar aspect and a dorsal aspect of a user's hand based on whether the user's hand is left hand or right hand. The second layer of thermoplastic material has a second perimeter border generally in the shape of a human hand and includes a second middle section configured to span interchangeably a palmar aspect and a dorsal aspect of a user's hand based on whether the user's hand is a left hand or right hand. The first layer and the second layer are coupled together at and along the first perimeter border and the second perimeter border in such a way that results in the disposable glove. The disposable glove has a biased open cuff opening configured to receive a user's left hand or a user's right hand therethrough, wherein at least one of the first or second sections have a formed geometry comprising a three-dimensional form generally shaped to fit a human hand and causing the biased open cuff of the disposable glove to be in a steady-state open state facilitating donning of the disposable glove.

In accordance with and example embodiment of the present invention, a dispenser for disposable gloves is provided. The dispenser includes a housing with an internal chamber and stack of disposable gloves in the internal chamber. The stack of disposable gloves having one or more disposable gloves. The disposable glove includes a first layer of thermoplastic material and a second layer of thermoplastic material. The first layer of thermoplastic material has a first perimeter border generally in the shape of a human hand and includes a first middle section configured to span interchangeably a palmar aspect and a dorsal aspect of a user's hand based on whether the user's hand is left hand or right hand. The second layer of thermoplastic material has a second perimeter border generally in the shape of a human hand and includes a second middle section configured to span interchangeably a palmar aspect and a dorsal aspect of a user's hand based on whether the user's hand is a left hand or right hand. The first layer and the second layer are coupled together at and along the first perimeter border and the second perimeter border in such a way that results in the disposable glove. The disposable glove has a biased open cuff opening configured to receive a user's left hand or a user's right hand therethrough, wherein the first middle section and the second middle section have different total areas from each other in such a way that one of the first middle section and second middle section contain extra material and does not lay flat, causing the biased open cuff opening to maintain a steady-state open configuration facilitating donning of the disposable glove. The one or more disposable gloves of the stack are in an elastically deformed and compressed closed state wherein the biased open cuff of the one or more disposable gloves is held in a closed state by the one or more other disposable gloves in the stack of disposable gloves and transitions to the open state when the one or more disposable glove holding the biased open cuff in a closed state are removed. The housing has an opening from which protrudes at least the biased open cuff of an uppermost disposable glove of the stack such that when the uppermost disposable glove is removed from the housing, the biased open cuff of a next disposable glove in the stack transitions from a closed to state to an open state and protrudes from the opening.

In accordance with an aspect of the present invention, the one or more disposable gloves of the stack further comprise one or more mounting features. In certain instances, the dispenser includes one or more mountings corresponding to the one or more mounting features of the one or more disposable gloves for holding the one or more disposable gloves of the stack in the housing. In some instances, the one or more mounting features are configured to separate from the one or more disposable gloves when the glove is unmounted and donned. In some such instances, the one or more mounting features comprises excess material around at least a portion of the first perimeter and second perimeter of the one or more disposable gloves. In some instances, the one or more mounting features are attached to one of the first layer and second layers. In certain other instances, the one or more mounting features are configured to facilitate the stacking of one or more disposable gloves in an elastically deformed compressed closed state. In still other instances, the one or more mounting features of each of the one or more disposable gloves in the stack are connected to the mounting features of the next disposable glove in the stack.

In accordance with an aspect of the present invention, one or more disposable gloves of the stack further comprise a tab extending from the biased open cuff of the one or more disposable gloves on at least one of the first layer and second layer. In certain instances, the biased open cuff of one layer of the one or more disposable gloves comprises a first tab extending from the biased open cuff and the biased open cuff of an other layer of the one or more disposable gloves comprises a second tab extending from the biased open cuff not opposite and not opposing the first tab.

In accordance with an aspect of the present invention, the opening of the dispenser is generally in the shape of a human hand.

BRIEF DESCRIPTION OF THE FIGURES

These and other characteristics of the present invention will be more fully understood by reference to the following detailed description in conjunction with the attached drawings, in which:

FIG. 1A and FIG. 1B are perspective views with corresponding cross-sectional views of a two layer glove in a flat and open state for donning;

FIG. 3A and FIG. 3B are perspective views with corresponding cross-sectional views of a glove having formed geometry and a biased open cuff in a flat state and an open state in accordance with an embodiment;

FIG. 5A and FIG. 5B are perspective views with corresponding cross-sectional views of a another glove having formed geometry in a flat state and an open state in accordance with an embodiment;

FIG. 13 is a perspective view and corresponding cross-section of another glove with alternate formed geometry having a additional formed features accordance with an embodiment;

FIG. 23A and FIG. 23B are perspective views and a corresponding cross-sectional view of gloves with alternate mounting features and opening reliefs in use in accordance with an embodiment;

DETAILED DESCRIPTION

Figures 2A, 2B, 2C:
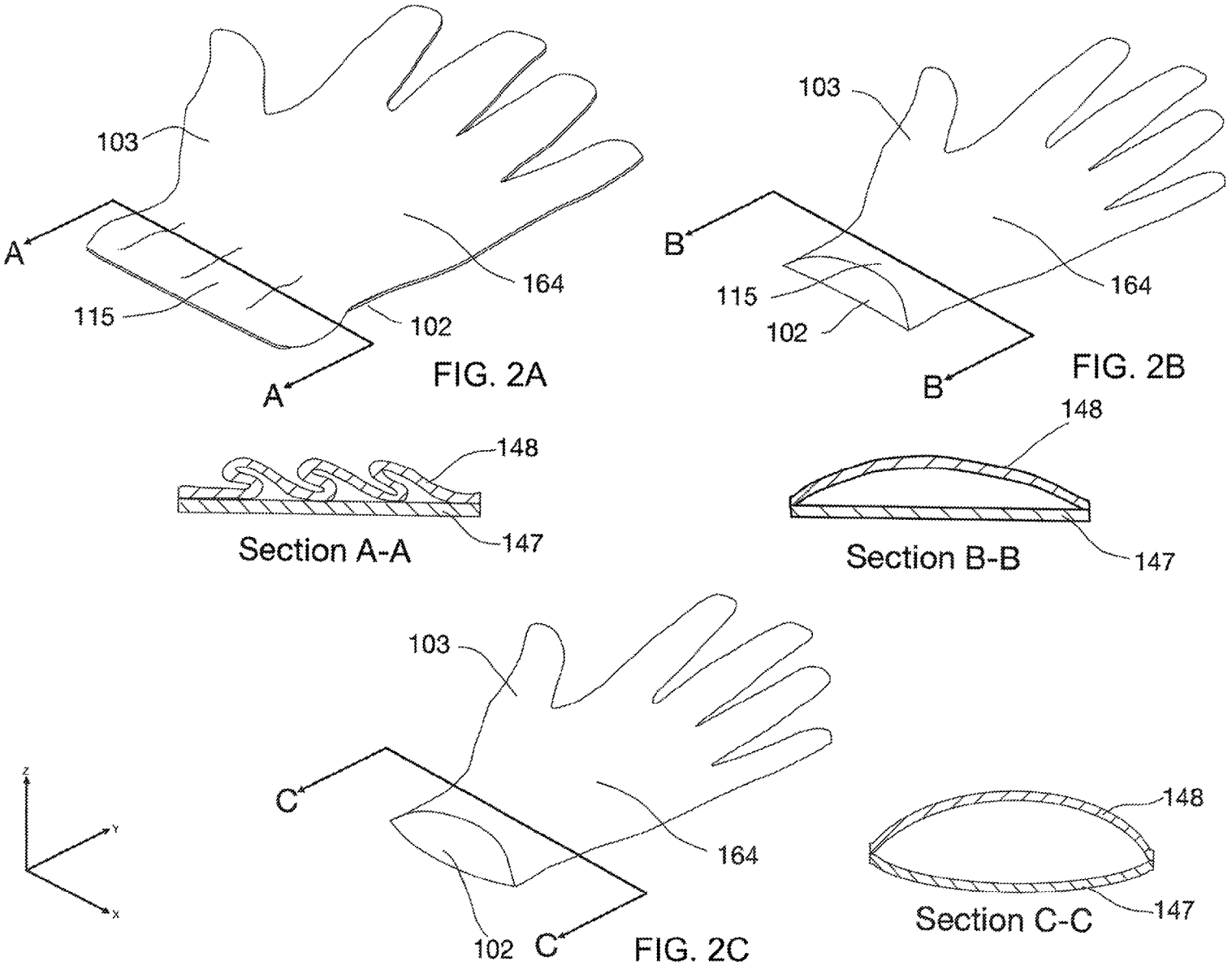
FIG. 2A, FIG. 2B, and FIG. 2C are perspective views with corresponding cross-sectional views of a two layer glove having a biased open cuff in different states of opening for donning in accordance with an embodiment.

An illustrative embodiment of the present invention relates to quick donning disposable gloves.

FIG. 1 through FIG. 48 wherein like parts are designated by like reference numerals throughout, illustrate an example embodiment or embodiments of easy donning disposable gloves and dispensers for the gloves, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

An illustrative embodiment of the present invention relates to two-layer disposable gloves containing features and/or forming for faster and more sanitary donning. For example, one layer of film having a differential length across the cuff region than the opposing layer permits easy insertion of a hand by impeding the ability of the two film layers to lie flat together. Further ease of donning can be achieved by forming one or more layers of film to more closely resemble the three-dimensional shape of a hand, which also provides superior comfort, fit, and usability. Additionally, the packaging method and/or a quick don apparatus with glove mounting features further increases and/or improves the donning speed, usability, and sanitation of the presented configurations by permitting a hand to be easily inserted into the glove without contact, or limited contact, with the outer surface. The glove has additional configurations where glove opening reliefs for gloves constrained about a cuff region, such as having one or more binding regions or side mounting regions or glove mounting regions, provide a means for said glove to open for improved donning. Materials and methods of manufacturing said gloves are also described.

FIG. 1A shows a two-layer glove 101 that must reduce in size in the x and y-directions in order to increase in size in the z-direction to take on its donned shape shown in FIG. 1B. In FIG. 1A, the glove is in its naturally flattened state and in FIG. 1B, the glove is in an unnatural three-dimensional hand shape. The disposable glove 101 is formed of two layers of thermoplastic material. The first film layer 102 has a perimeter generally in the shape of a human hand including a middle section covering either the palmar aspect or the dorsal aspect of a user's hand. The second film layer 103 also has a perimeter generally in the shape of a human hand and includes a middle section to span the palmar or dorsal aspects of a user's hand. The first layer 102 and second layer 103 are coupled together along their perimeters resulting in the disposable glove having a cuff opening for receiving a user's hand therethrough.

The two-dimensional glove shape is typically intended to fit a left hand or a right hand, therefore film layer 102 and film layer 103 may be located on either the anterior side covering a palmar aspect of a hand or the posterior side covering the dorsal aspect of a user's hand. It should be noted that film layer thickness is exaggerated in some of the illustrations to convey the engagement of the two film layers. An individual film layer of two-layer disposable gloves is generally between 0.5 and 3 mils thick although thicker and thinner glove material layers are also practicable.

FIGS. 2A-2C identify a differential layer sized glove 164 configuration in accordance with one embodiment of the present invention where FIG. 2A shows the glove in an unnatural flattened state, FIG. 2B shows the glove in its natural non-flattened state, and FIG. 2C shows the glove in an unnatural three-dimensional hand shape. The disposable glove 164 is formed of two layers of thermoplastic material. The first film layer 102 has a perimeter generally in the shape of a human hand including a middle section covering either the palmar aspect or the dorsal aspect of a user's hand. The second film layer 103 also has a perimeter generally in the shape of a human hand and includes a middle section to span the palmar or dorsal aspects of a user's hand. The first layer 102 and second layer are coupled together along their perimeters resulting in the disposable glove having a biased open cuff opening for receiving a user's hand therethrough. Here, the first middle section of the first layer 102 and the second middle section of the second layer 103 have different total areas from each other such that one of the middle sections contains extra material and does not lay flat. This causes the biased open cuff opening to maintain a steady-state open configuration facilitating donning of the disposable glove.

In this example the first film layer 102 defines the anterior of the glove covering the palmar aspect and is composed of less material surface area than the second film layer 103 defining the posterior of the glove covering the dorsal aspect of the user's hand. However, the functionality of the layers may be reverse or interchangeable. Additional material surface area residing in one film layer compared to the opposing film layer is achievable within the same fused perimeter of a glove such as by bowing, bunching, or folding the material during or prior to the glove fusing manufacturing operation. A film layer forming operation, such as vacuum forming or molding or by some other means, also is practicable to produce said glove. The cross-sectional views of FIGS. 2A-2C illustrates an example of a layer 103 that is bunched and folded relative to layer 102 such that layers 102 and 103 are unable to lie flush with one another when in a flattened state making the glove biased open. The natural non-flattened state in FIG. 2B serves as a transitional state, so that a glove requires less transformation for being in either a flattened state or a hand-shaped state. Producing the differential layer size in the cuff region creates a predisposition or bias for cuff 115 to be in an open state or a partially open state for easier donning and an improved fit compared to flat two-layer gloves. FIG. 2B also shows the resulting cross-sectional cuff length difference across the cuff region where a longer posterior cross-sectional cuff length 148 exists compared to the anterior cross-sectional cuff length 147. Generating a differential cross-sectional cuff length where the longer cross-sectional cuff length side of the glove is between 0.1% and 10% longer than the shorter cross-sectional cuff length side provides a glove with an accessible glove opening for ease of donning although cross-sectional cuff length differences less than 0.1% or greater than 10% are also viable.

Figure 4A:
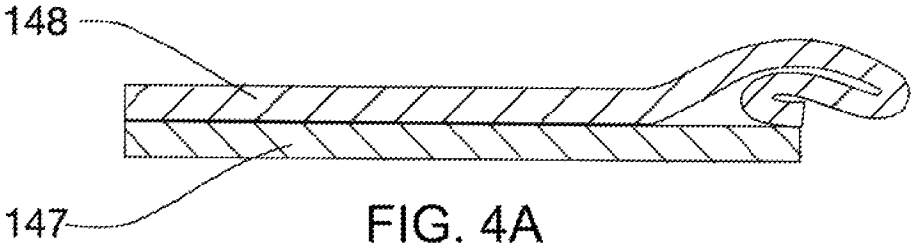
FIG. 4A, FIG. 4B, and FIG. 4C are cross-sectional views of how the excess material in one of the layers of a two layer formed glove in different flat configurations accordance with embodiments.
Figure 4B:
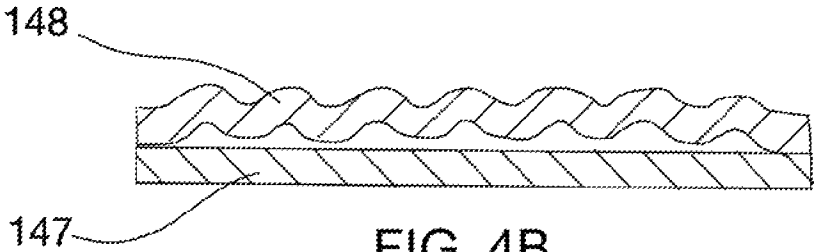
Figure 4C:
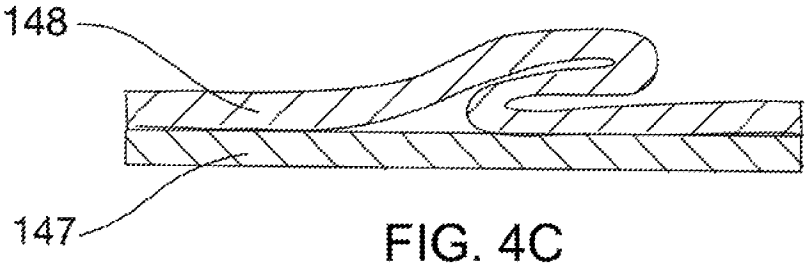
Figure 6:
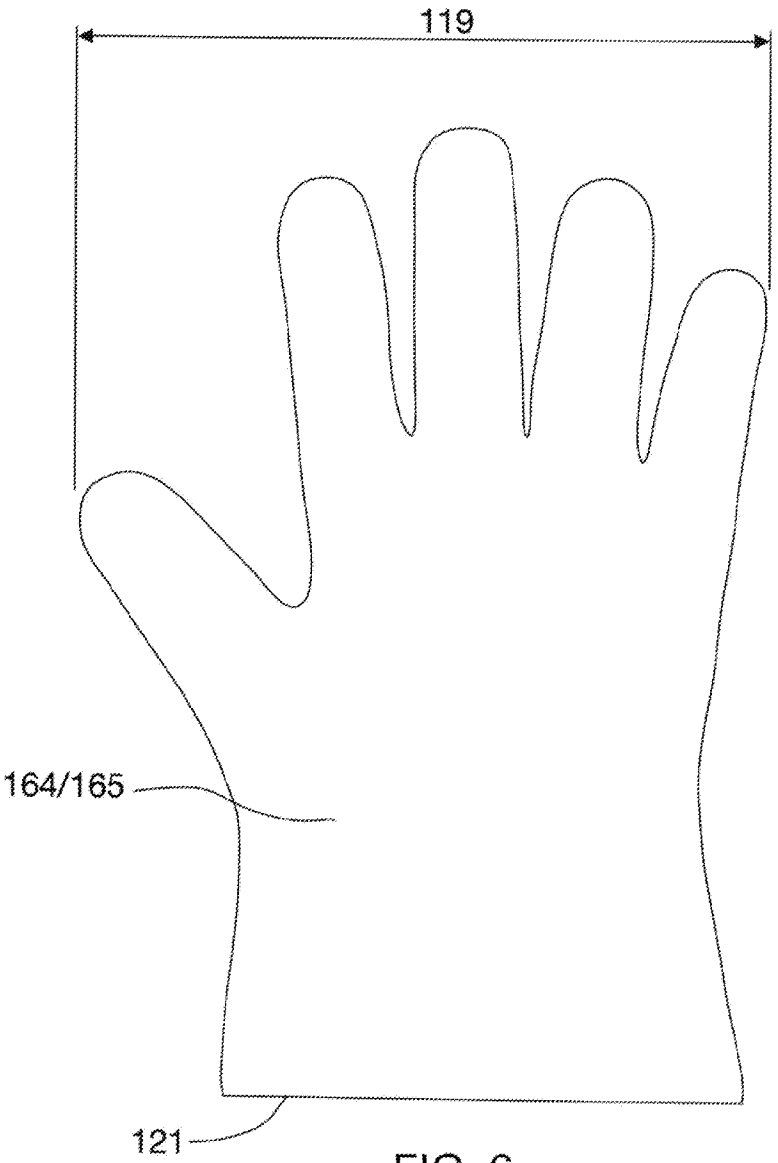
FIG. 6 depicts a glove having reduced width in accordance with an embodiment.

FIG. 3A and FIG. 3B depict a formed glove 165 configuration having formed geometry, in accordance with aspects of the present invention, where FIG. 3A shows the glove in its unnatural flattened state and FIG. 3B shows the glove in its natural three-dimensional formed state to fit a hand. The cross-sectional cuff length difference across the cuff region where a longer posterior side cross-sectional cuff length 148 exists compared to the anterior side cross-sectional cuff length 147 are also illustrated. The cross-sectional view of FIG. 3A also illustrates an example where layer 103 is unable to lie flush with layer 102 when in a flattened state making the glove biased open. FIGS. 4A-4C identify additional cross-sectional views of gloves that are biased open with differential cross-sectional cuff lengths that are not able to lie flush with one another where creasing, folding, and bending or the like is required in the longer cuff length layer. In accordance with other embodiments of the present invention, creasing, folding, bending or the like is also incorporated into the shorter cross-sectional cuff length layer. For the glove shown in FIG. 3A and FIG. 3B, the lengths of the cuff opening edges 140 and 143 of glove opening 121 correspond to the shorter and longer cross-sectional cuff lengths 147 and 148 respectively, where the glove opening 121 is perpendicular to film layer 102. Producing a differential cross-sectional cuff length where the longer cross-sectional cuff length side of said formed glove is between 10% and 100% longer than the shorter cross-sectional cuff length side provides a glove with superior fit, comfort and donnability. Cuff length differences for formed gloves of less than 10% also offer functional implementations. Formed cuff opening edge 143 formed at lengths over two times the length of cuff opening edge 140 where the seams are closer together on the anterior side of a formed glove 165 and the formed cuff opening edge 143 bulges at the sides to form glove opening 121 are also practicable. In accordance with an embodiment of the present invention, differential cross-sectional film layer lengths occur at other locations such as across a palm region or across a finger or thumb region. In accordance with another embodiment of the present invention, film layer 103 in a glove area is bunched or folded or the like prior to forming said film layer to reduce the amount of film stretch needed to create formed glove 165.

For formed or differential layer sized gloves as depicted in FIGS. 2A-2C and FIGS. 3A-3B, the formed or longer cross-sectional cuff length side of a glove defines the posterior side covering the dorsal aspect since the material on the posterior of the hand needs to adapt to the larger contoured area about a closed first or bent fingers, while material on the anterior side covering the palmar aspect of the hand generally needs to compress as fingers bend or a hand closes into a fist. Alternately, the formed or longer cross-sectional cuff length film layer defines the anterior side of a glove and the flat film layer defines the posterior side of a glove.

The formed glove 165 having formed geometry portrayed in FIGS. 5A-5B has substantially equally formed film layers 102 and 103 for both sides of the glove making the glove ambidextrous. Cuff opening edges 140 and 143 are substantially equal in length with both sides being substantially equally formed. FIG. 5B also shows the equivalent cross-sectional cuff length across the cuff region where the cross-sectional cuff lengths 147 and 148 are substantially equal and the glove is used for either the left hand or the right hand. In accordance with one embodiment of the present invention, both sides of a glove are formed where a difference in cross-sectional cuff length exists between cross-sectional cuff length 147 and 148 and said glove is made specific for either a left hand or a right hand or no cuff length differential exists and a glove still has geometry or material differences or some other difference making it hand specific or a cross-sectional cuff length differential does exist where the glove is made without being hand specific. Forming both layers of a formed glove 165 increases the ability to more closely form the glove to the shape of an actual hand, such as forming a glove with a deeper thumb 110 region in one form side for one layer of a formed glove 165 and having a deeper finger 111 region defined in an opposing cavity to more appropriately match the non-planar shape of a hand. In accordance with another embodiment of the present invention, one glove layer is formed and the opposing glove layer is bowed, bunched, folded or the like to generate a lengthened cross-sectional cuff length or increase the film area in a non-formed side of a glove. In accordance with another embodiment of the present invention, both glove film layers 102 and 103 are bowed, bunched, folded or the like to generate a lengthened cross-sectional cuff length or increase the film area on each side of a glove where the layers are equal or different from the opposing layer. In accordance with another embodiment of the present invention, the cuff region of both film layers is left unformed and other regions of one or both layers are formed or feature differential amounts of material relative to an opposing layer or bunched or bowed material on both layers.

In accordance with embodiments of the present invention, the required two-dimensional surface area of the film is reduced and the maximum number of differential layer sized gloves 164 or formed gloves 165 that fit in a two-dimensional footprint of film is increased. Often the fingers of two-layer gloves are extra wide and are splayed apart due to the size required to transition from a two-dimensional shape to a three-dimensional shape, which significantly increases the footprint of film required to fabricate a glove. In accordance with embodiments of the present invention, a differential layer sized glove 164 or formed glove 165 reduces the amount of surface area and material required for fabrication compared to a conventional two-layer glove. A reduced width 119 exists, as identified in FIG. 6, where the width 119 is measured as the maximum extents across the glove that is parallel or approximately parallel to a glove opening 121 location is 9-inches or more for a conventional two layer glove for large or extra-large or even larger hands. In accordance with an embodiment of the present invention, a formed glove 165 or differential layer sized glove 164 is fabricated with a width 119 of less than 8.75-inches such as for a user with large or extra-large hands. In accordance with an embodiment of the present invention, a formed glove 165 or differential layer sized glove 164 is fabricated with a width 119 of less than 8.5-inches. In accordance with an embodiment of the present invention, a formed glove 165 or differential layer sized glove 164 is fabricated with a width 119 of less than 8.25-inches. In accordance with an embodiment of the present invention, a formed glove 165 with formed geometry or differential layer sized glove 164 is fabricated with a width 119 of less than 8-inches. In accordance with an embodiment of the present invention, a formed glove 165 or differential layer sized glove 164 is fabricated with a width 119 of less than 7.75-inches. In accordance with an embodiment of the present invention, a formed glove 165 or differential layer sized glove 164 is fabricated with a width 119 of less than 7.5-inches. In accordance with an embodiment of the present invention, a formed glove 165 or differential layer sized glove 164 is fabricated with a width 119 of less than 7.25-inches. In accordance with an embodiment of the present invention, a formed glove 165 or differential layer sized glove 164 is fabricated with a width 119 of less than 7-inches such as for a user with medium or small or extra-small hands. The smaller two-dimensional shape of a differential layer sized glove 164 or formed glove 165 also provides for a corresponding decrease in the packaging size, for packaging stacks of gloves in particular, without requiring the need to fold the gloves or portions of the gloves causing kinks and bends that negatively impacts donnability. The smaller package and glove size improves shipping costs, storage and point-of-use space, and also provides visual benefits for the glove product a user chooses to don.

Figure 7:
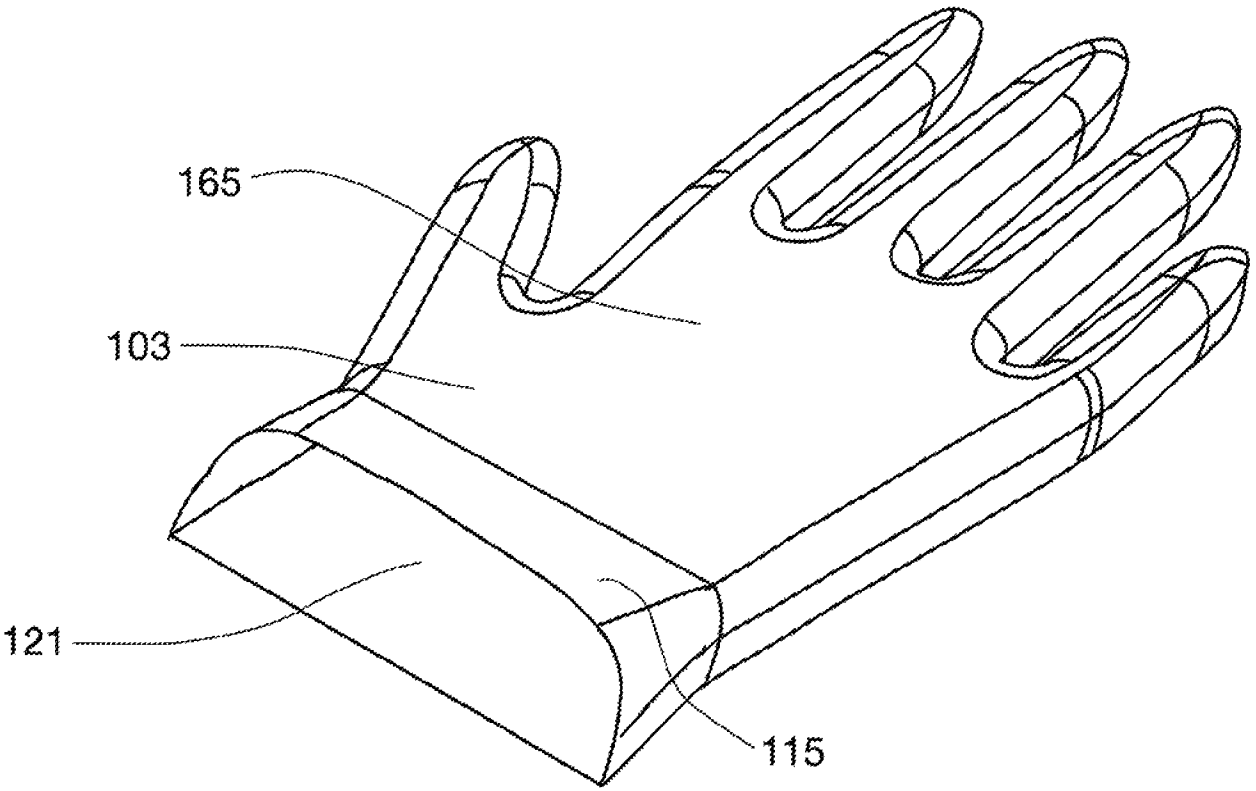
FIG. 7 is a perspective view of a glove with formed geometry having a widened cuff in accordance with an embodiment.

FIG. 7 illustrates a formed glove 165 where film layer 103 at cuff 115 is formed to increase the size of glove opening 121 making the formed glove 165 even easier to don.

Figure 8:
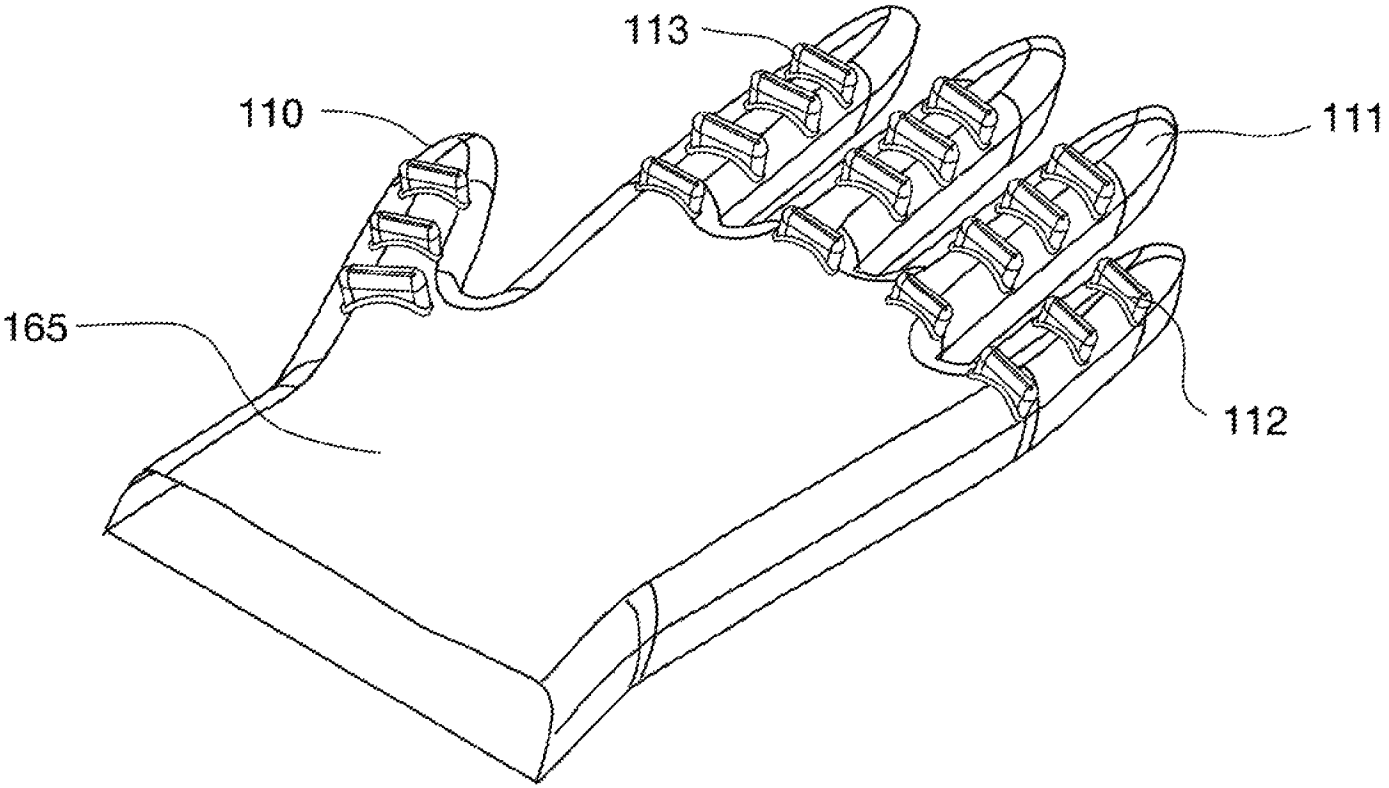
FIG. 8 is a perspective view of a glove with formed geometry having a additional formed features accordance in with an embodiment.

FIG. 8 identifies a formed glove 165 with formed geometry where articulating rib features 112 are positioned along fingers 111 and thumb 110 or just at joint locations 113, which expand and flatten to the contour of joint locations 113 as a finger or thumb is bent and is able to re-coil to its natural rib-shaped state as a finger or thumb is straightened. This provides for a tight fitting glove that does not give the user the feeling of restricted motion or stress.

To further improve the form, fit, comfort, flexibility, usability, donnability, breathability, venting, air circulation, grip, texture or any other features not mentioned herein, additional three-dimensional structures are formed or molded into the film or added by some other means to create a glove such as a differential layer sized glove 164 or formed glove 165. Such structures include rib-like features, bulbous regions, rippled geometry or other geometric forms not mentioned.

Figure 9:
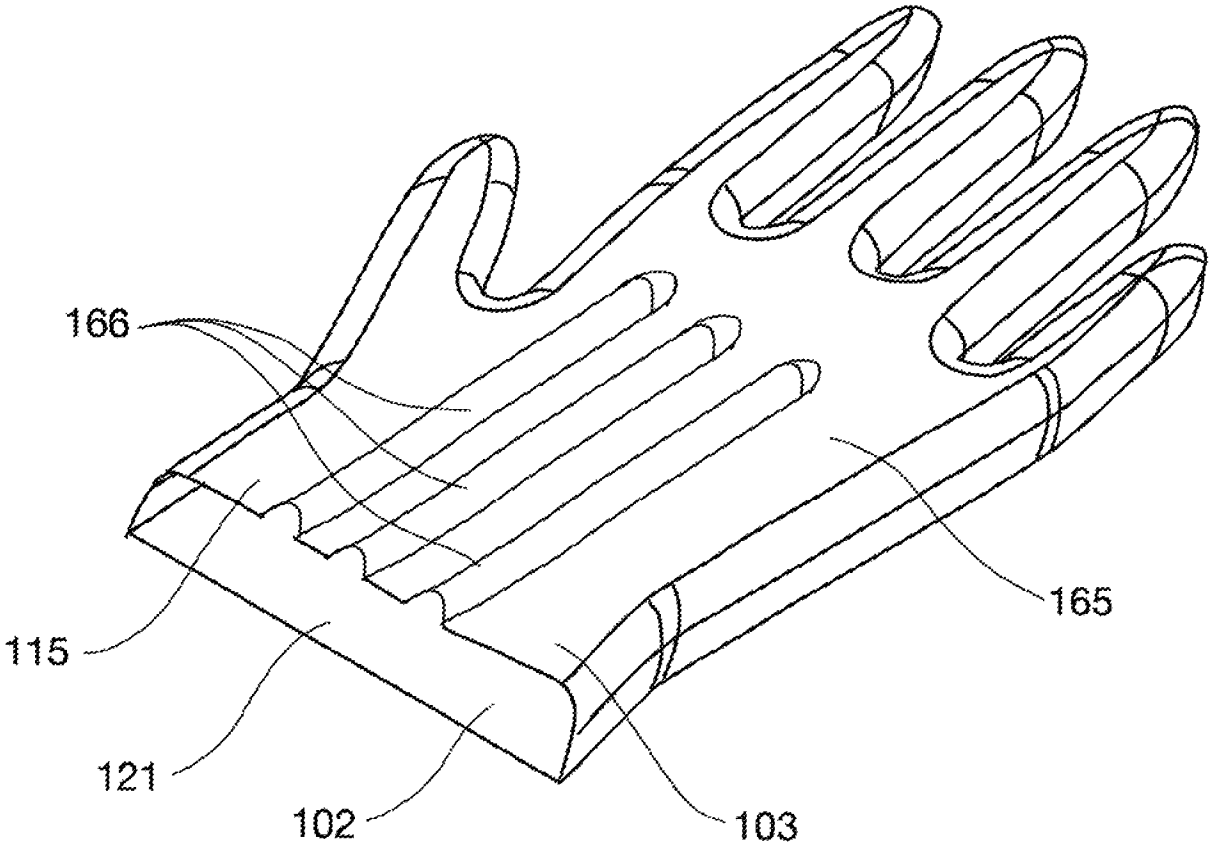
FIG. 9 is a perspective view of another glove with alternate formed geometry having a additional formed features accordance with an embodiment.

FIG. 9 details a formed glove 165 with expansion ribs or channels 166 that provide extra film that expand as needed for larger hand sizes and are inclined to retain their natural shape for smaller hand sizes in accordance with an embodiment of the present invention. The expansion ribs or channels 166 also serve to provide improved venting or air circulating capabilities in accordance with another embodiment of the present invention. Extending expansion ribs or channels 166 into the finger region, in accordance with one embodiment of the present invention, provide improved venting or air circulating capabilities or glove expansion capabilities.

Features such as expansion ribs or channels 166 also function as a rippled cuff to promote improved donnability in accordance with an embodiment of the present invention. One or more formed features, such as expansion ribs or channels 166 in a cuff 115 region, provide a means for more easily separating film layers 102 and 103 when a glove is in a flattened state causing cuff 115 region to have a further predisposition to not lay flush with an opposing layer making glove opening 121 easier to access. Compressive forces, such as those generated by packing gloves together in a package for shipping and storage, are generally required to hold formed gloves or differential layer sized gloves as flat or compressed as possible to minimize the biased open state to decrease the required packaging size. FIG. 2A, FIG. 3A, and FIG. 5A identify differential layer sized gloves or formed gloves that are in an unnaturally flattened shape having been previously compressed or otherwise loaded to achieve such a state. Those of skill in the art will appreciate that the rib-like features in FIG. 8 and FIG. 9 and any three-dimensional features mentioned or not mentioned are combinable or able to be rearranged as desired in any operable combination.

Figure 10:
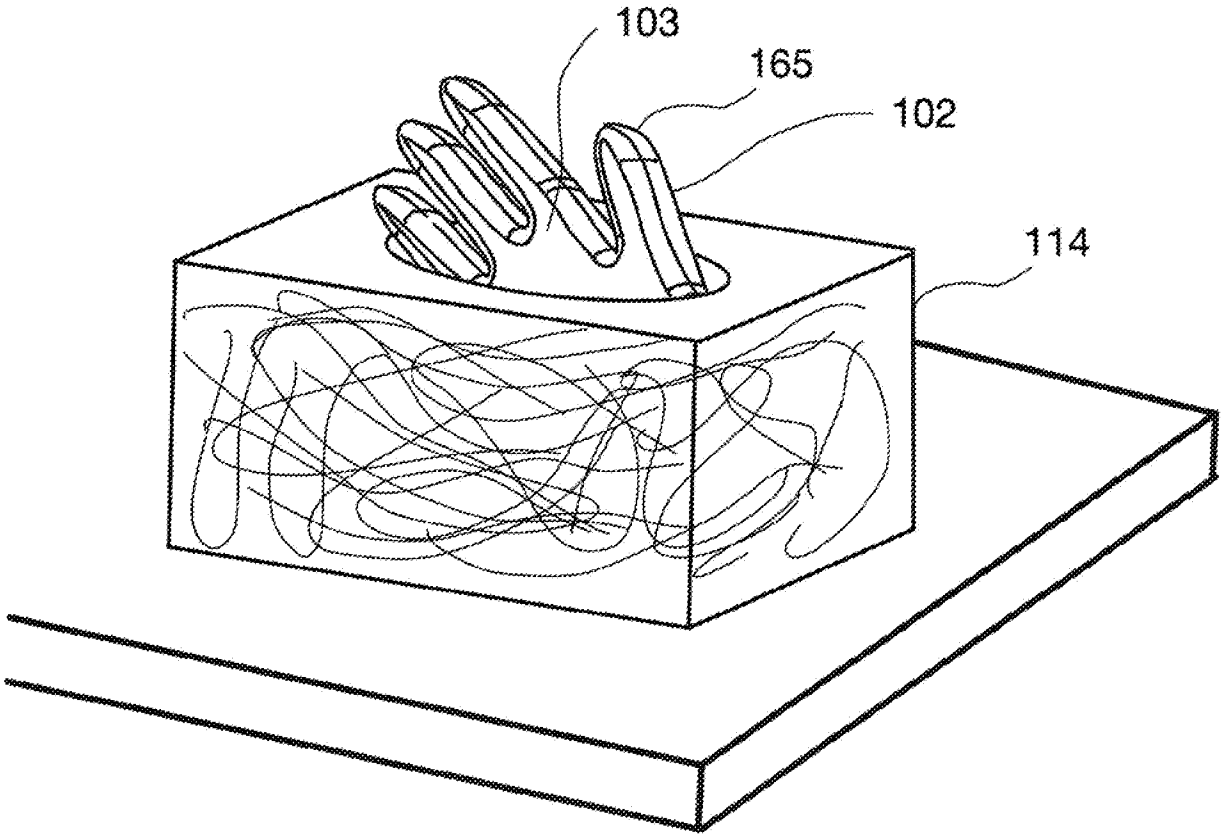
FIG. 10 is a perspective view of a box dispenser for gloves in accordance with an embodiment.

FIG. 10 illustrates a box 114 of randomly packaged and compressed formed gloves 165 for a user to pull out and don. Removing the compressive forces such as by removing a formed glove 165 from a box 114 results in stress relief such that the material transitions to a stress relieved and biased open position, which is of a less compressed state and a state that better serves the separation of film layers 102 and 103 for donning. As formed gloves 165 are removed from glove box 114 the remaining gloves inside of box 114 are able to transition to a more stress relieved and less compressed state until a sufficient number of gloves have been removed to relieve most of the compressive forces on said gloves.

Figure 11:
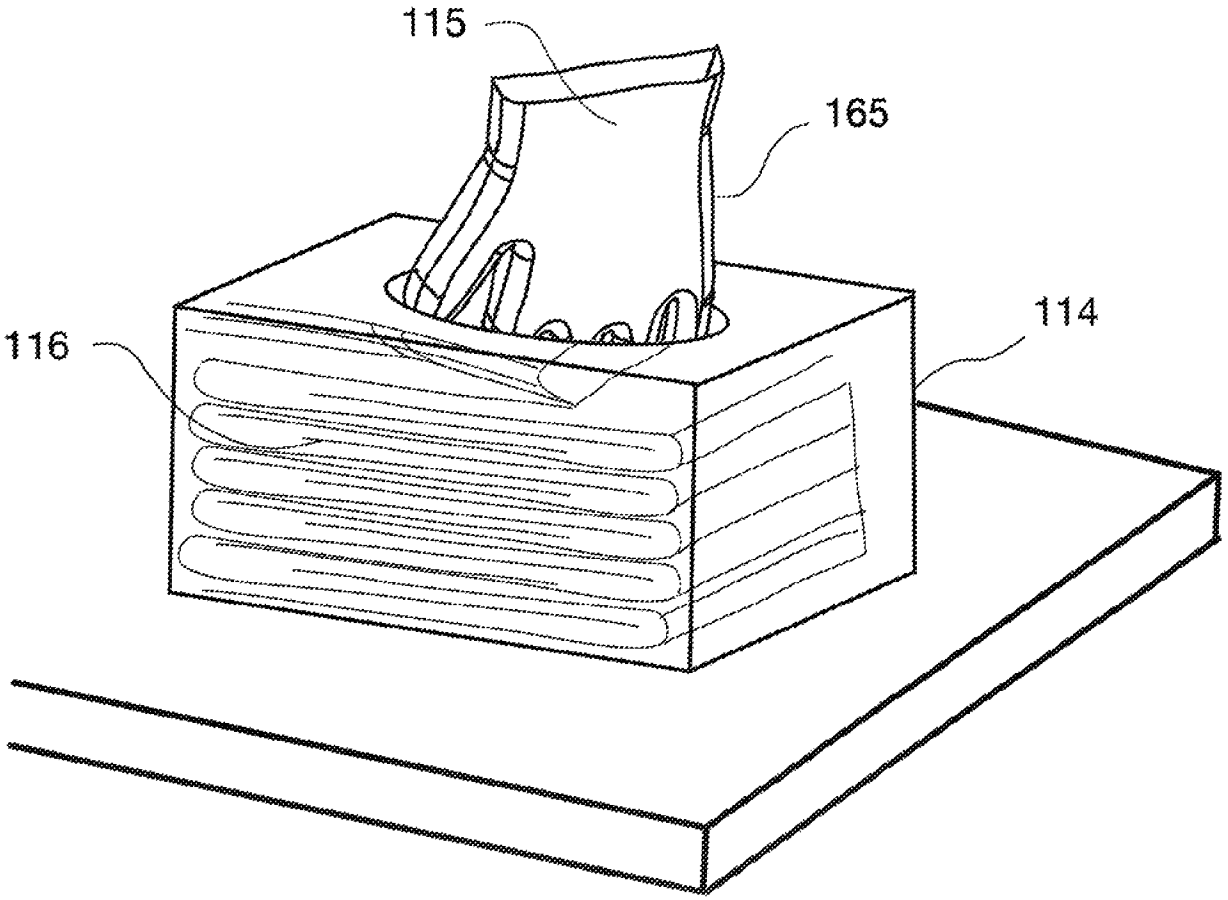
FIG. 11 is a perspective view of another box dispenser for gloves in accordance with an embodiment.

FIG. 11 shows a glove box 114, where the formed gloves 165 are dispensed cuff 115 first to minimize the user's need to contact other parts of the glove and contaminate the outside surface. The formed gloves 165 are assembled and compressed in a stack 116 of overlapping layers to generate the cuff 115 first dispensing. Box 114 and overlapping and interlacing glove stack 116 are designed such that the act of pulling a formed glove 165 from box 114 makes the next cuff 115 available to a user to pull said glove from box 114 and don.

Figure 12B:
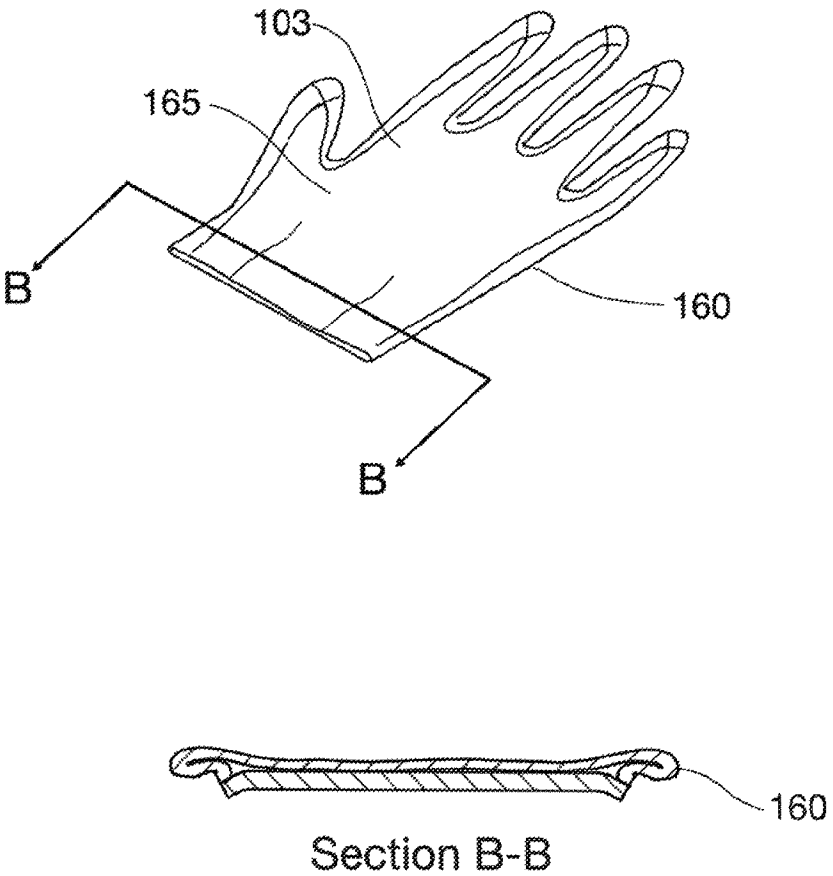
FIG. 12A and FIG. 12B are perspective views and corresponding cross-sectional views of a gloved having formed geometry including features for aiding in the compressing of the glove in accordance with an embodiment.
Figure 12A:
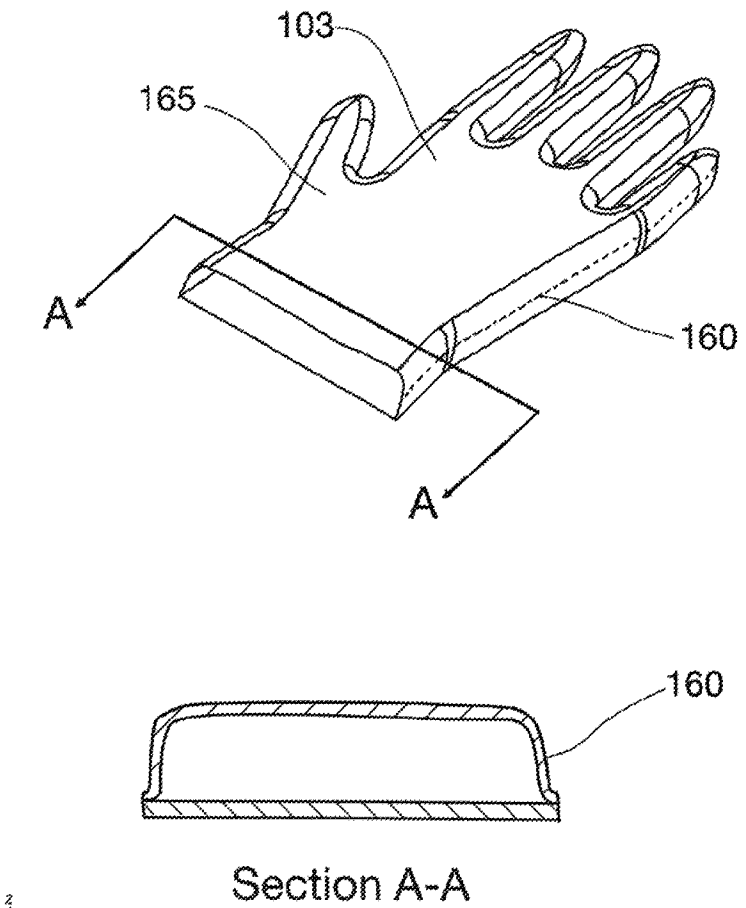

Additional features are incorporated into a formed glove shape such as formed glove 165 of FIG. 12A and FIG. 12B that provides for collapsing the formed glove 165 in a manner that makes it more manageable for packaging, such as with stacking of gloves, or for re-taking its natural shape prior to donning in accordance with embodiments of the present invention. A crease line 160, or the like, formed close to the perimeter of a formed glove 165 such as about the non-planar formed layer 103, or at appropriate locations in a glove shape, allow the glove to be elastically deformed, compressed and fold neatly into a flattened shape in a consistent manner and re-shape when the flattened state load is released prior to donning, whether re-shaping occurs by material memory or an external load or some other means. Pleats, gussets, or the like are also practicable in place of crease line 160 or in conjunction with crease line 160 to promote flattening and re-shaping of a glove.

Using compressive forces in manufacturing, such as forces between 1 and 50 tons, on individual gloves or gloves in a stack or gloves on a roll, particularly for gloves with differential layer sized gloves 164 or formed gloves 165, assists with minimizing the overall glove thicknesses and packaging volume as well as donning setup requirements, although compressive forces below 1 ton and greater than 50 tons are also practicable. Some relaxation effects are likely to occur over time and the overall thickness of differential layer sized gloves 164 or formed gloves 165 increases if a compressive load is not maintained such as a load induced by packaging although loads induced by packaging are generally substantially less than initial compressive forces induced in a manufacturing process. Compressive forces induced by packaging, such as vacuum packaging, of 0.01 pounds to 10 pounds are more typical although forces less than 0.01 pounds or greater than 10 pounds are practicable.

In accordance with embodiments of the present invention, FIG. 13 illustrates a formed glove 165 where the thickness of film layer 102 at finger tips 170 is thinned to improve tactile sensitivity and the thickness of film layer 103 at the knuckle locations 171 is thinned to increase flexibility for finger articulation. In accordance with embodiments of the present invention, material thickness is reduced down to 20% in one or more areas of a glove or increased up to 200% in one or more areas of a glove or reduced is one or more areas of a glove and increased in one or more areas of a glove. The process of thinning the material results in thick regions 172 and 173 surrounding the thin regions 170 and 171 respectively, providing some structure and protection for thinned regions 170 and 171. The cross-sectional thickness profile is manipulated with manufacturing equipment design and is manufactured to achieve the desired geometry such as by extruding the material. For example, bulging the thick regions 172 or 173 into the formed glove 165 or bulging thick regions 172 or 173 equally in and out or at any thickness variations therebetween is easily achieved. Centering the thin regions 170 or 171 between both surfaces of a film layer 102 or 103 or making the thin regions 170 or 171 biased or flush with either an external glove surface 161 or an internal glove surface 162 are additional options for optimizing glove performance.

Increasing or decreasing the film layer thickness in one or more locations of formed glove 165, or any other glove discussed thereof or herein, is used to change its characteristics such as improving sensitivity, protection, motion resilience, strength, flexibility, texture, or some other characteristic. Increasing or decreasing the thickness at the seam 118 is also used to improve the ability to fuse film layers 102 and 103 together or minimize the resulting fused seam size. Besides changing the characteristics at target areas of the glove shape, increasing or decreasing the thickness provides a further means to reduce the weight and cost. Changing the film layer thickness is performed in conjunction with forming three-dimensional geometry for further product enhancement or cost reduction or other reason. Such characteristic changes are achieved by physically loading, heating, molding, drawing or the like of one or more film layers 102 or 103 in one or more locations and at any stage of the glove manufacturing process. Said characteristic changes being applicable and practicable with any of the glove embodiments discussed thereof or herein.

In accordance with one embodiment of the present invention, alternate materials are used for the posterior layer and anterior layer of a two layer glove or are of altering thickness, color, translucency, or feature some other alternate properties or features or any combination of differences. Changing the properties between the posterior side of a hand and the anterior side of a hand provides additional benefits where stretch and flexibility on the posterior side of a hand is typically desirable where the material needs to adapt to the elongated geometry as fingers are bent towards the palm and a hand is closed whereas material properties such as grip, strength/resilience, and barrier related properties are typically more desirable on the anterior side of the hand where the majority of external contact is occurring. Changing the texture, robustness, permeability, or color provide numerous benefits. For example, color or translucency differences for branding or easily identifying the appropriate sides for donning a glove or providing an easily identifiable glove opening based on the contrast between layers for more easily donning a glove or a visual perception of a surface in contact with a food item are practicable.

In accordance with one embodiment of the present invention, film layer 102 and film layer 103 of formed glove 165 or any other glove discussed thereof or herein, are composed of one or more sub-layers. The use of particular materials or alternate materials for the anterior and posterior or the addition of material sub-layers is implemented for improved comfort, permeability characteristics, bonding capabilities, flexibility properties, grip and texture, strength, protection, cost advantages or for any other properties known in the art. It should be understood that any of the layers or sub-layers do not have to consist of the same layering, be composed of the same materials, be of the same thickness, finish, geometry, be manufactured or applied in the same manner or have any other characteristics not mentioned herein and is practicable in accordance with embodiments described thereof or herein.

In accordance with one embodiment of the present invention, a three-dimensionally formed glove 165 is composed of two layers of common food grade plastic material, such as polyethylene, with film layer thicknesses between 0.5 mils and 3 mils where at least one film layer is extruded to a depth of 0.1 inches to 2.5 inches. In accordance with an embodiment of the present invention, gloves are made of a polylactic acid (PLA) such as a vegetable starch, or root starch or grain starch or combinations thereof providing fully recyclable or compostable gloves and therefore a sustainable and eco-friendly solution for a product that generates excessive amounts of trash in the world today. Further, starch is inherently lubricious and is not excessively tacky and sticky when contacting wet or sweaty hands providing for a good quick donning glove solution. Said gloves, fabricated from other materials or film layer thicknesses or extrusion depths or combinations of materials and film layer thicknesses and extrusion depths that are incorporated into a formed glove 165 are also practicable and are usable in any combinations mentioned or not mentioned and combinations and variations understood by those of skill in the art.

Figure 14B:
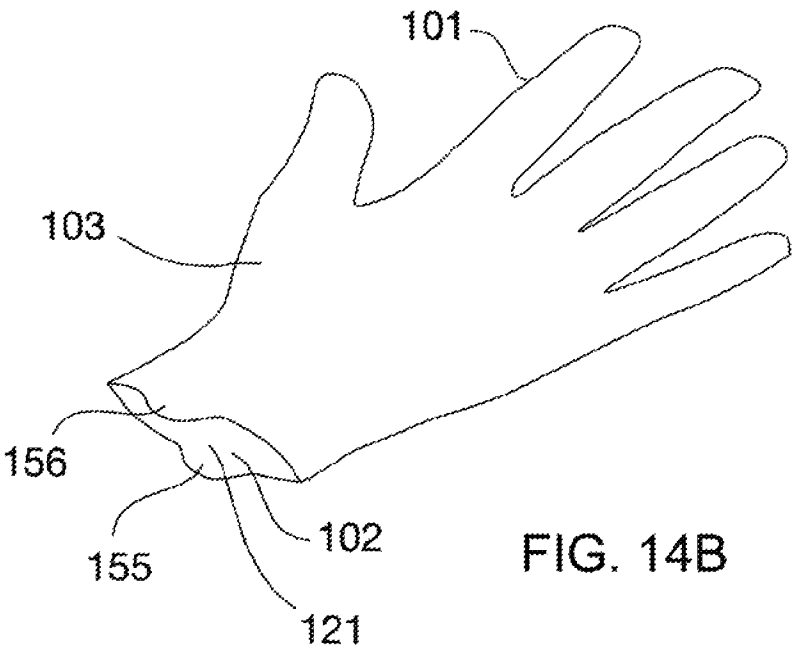
FIG. 14A and FIG. 14B are perspective views of a glove having tabs extending from the cuff in accordance with an embodiment.
Figure 14A:
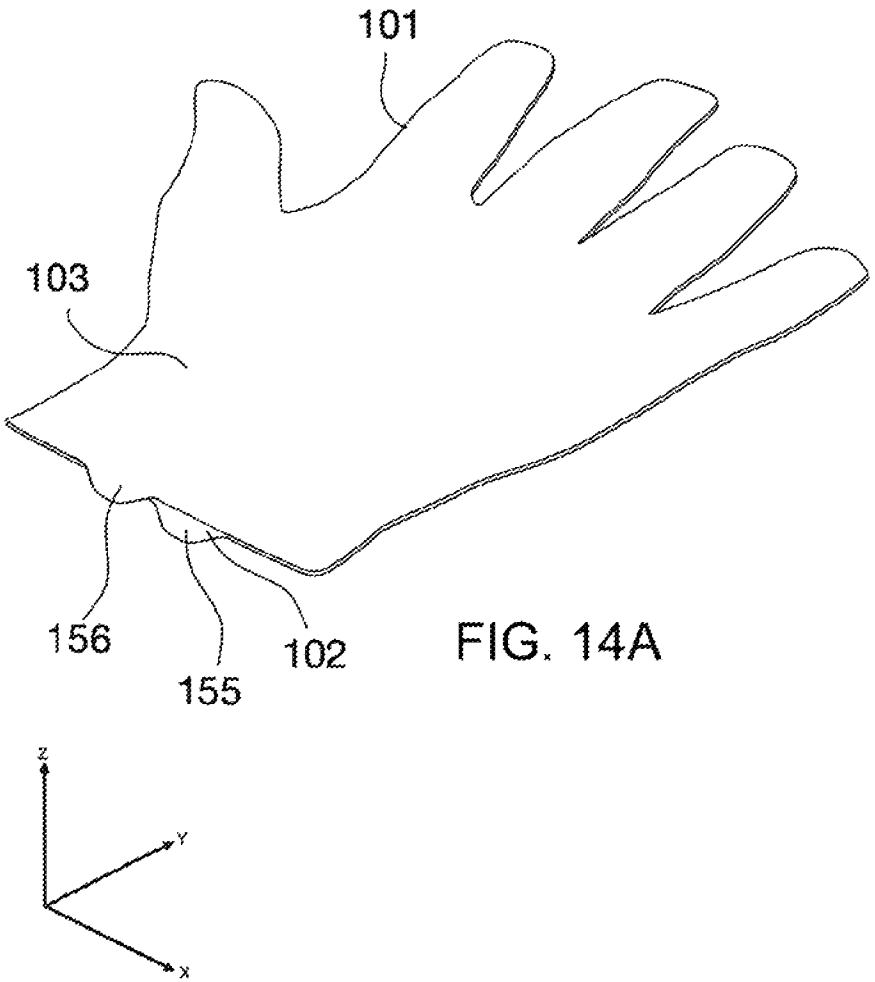

To further improve the donnability of formed or unformed two-layer gloves, additional features are incorporated at glove opening 121 in FIG. 14A and FIG. 14B, such as non-overlapping layer regions in accordance with some aspects of the present invention. FIG. 14A and FIG. 14B illustrate an example of a two-layer glove 101 that features a non-overlapping tab on each material layer that provides a simple means for a user to grab and pull the tabs apart to open a glove. FIG. 14A shows said two-layer glove 101 in a flat state and FIG. 14B shows said two-layer glove 101 in an open and donnable state. Non-overlapping cuff tab 156 is a protrusion from the cuff of top film layer 103 of the glove that has at least a portion of its region without any material from film layer 102 opposing it. Non-overlapping cuff tab 155 protruding from the cuff on the bottom film layer 102 of the glove has at least a portion of its region without any material from film layer 103 opposing it. In accordance with an embodiment of the present invention, gloves featuring one or more tabs at any location along the cuff opening edge for either layer are also practicable. It is also contemplated that one or more non-overlapping tabs or non-overlapping regions exist on just a top layer or just a bottom layer in accordance with an embodiment of the present invention.

Figure 15B:
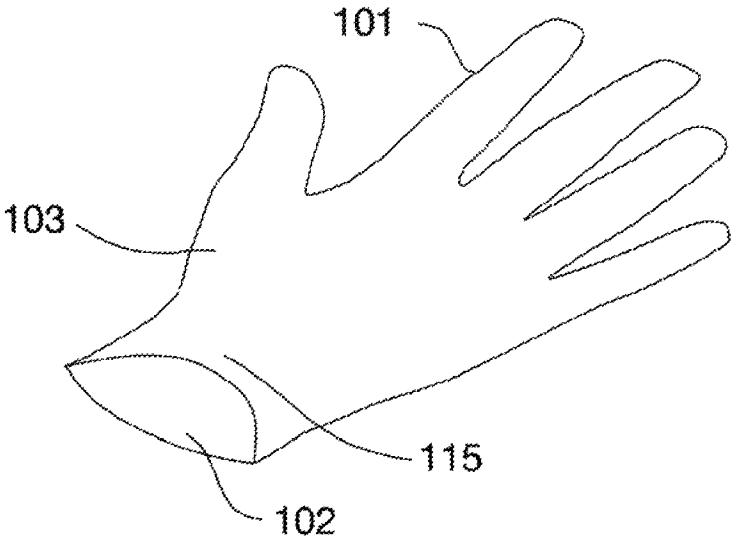
FIG. 15A and FIG. 15B are perspective views of a glove having a non-overlapping cuff in accordance with an embodiment.
Figure 15A:
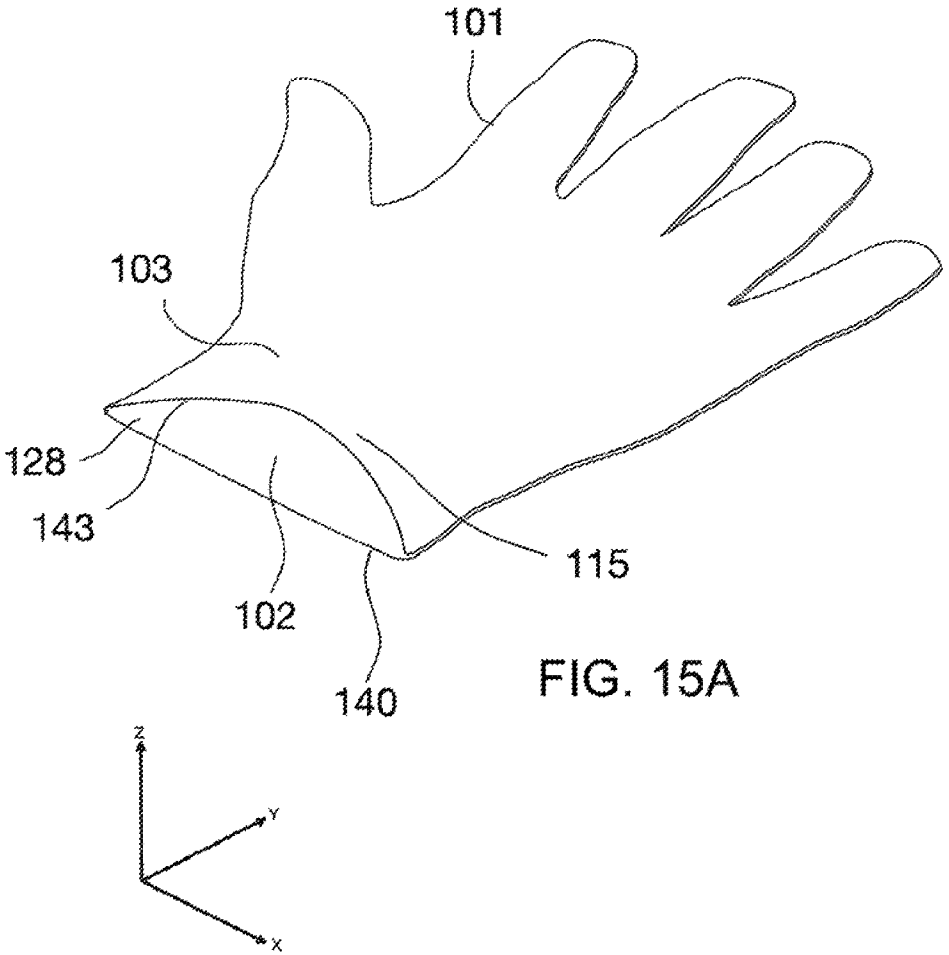

FIG. 15A portrays a two-layer glove 101 in a flat state featuring cuff 115 with an offset and FIG. 15B shows said two-layer glove 101 with said cuff 115 in an open and donnable state. Said cuff 115 having a region 128 where film layer 102 has no material from film layer 103 opposing it. This offset feature of the cuff makes it easier for a user to separate the film layers and don said glove. In accordance with an embodiment of the present invention, a user manually opens a glove with their fingers or simply applying a load to the non-overlapping layer or applying an alternate force such as a shear force to one or more layers causes the film layers to separate and the cuff to open enough for a user to get their hand into said glove.

One or both cuff opening edges 140 and 143 are optionally straight across, angled, curved or feature tabs or ripples, or include any other geometry that may be desired in a glove for donning purposes or for some other reason mentioned or not mentioned herein. In accordance with an embodiment of the present invention, the cuff region features differential cross-sectional cuff lengths between film layers 102 and 103 to further facilitate donning.

Figure 16:
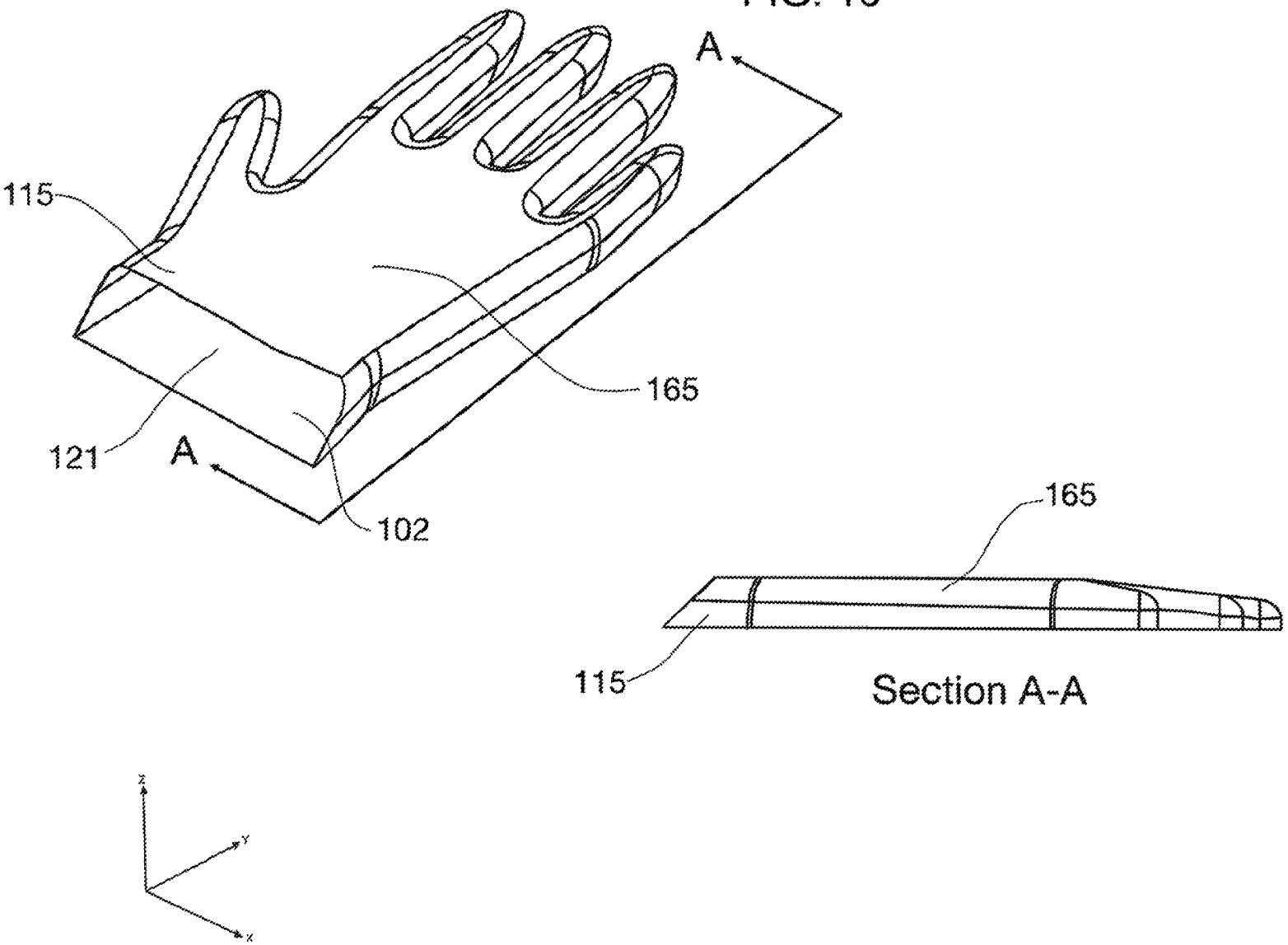
FIG. 16 is a perspective view and corresponding cross-sectional view of a glove having formed geometry and a non-overlapping cuff in accordance with an embodiment.

FIG. 16 shows a formed glove 165 where the cuff 115 has been angle cut to create glove opening 121 when in its three-dimensional formed shape during the manufacturing process, resulting in an offset cuff feature for easy donnability. FIG. 16 also shows a side view of said formed glove 165. Said angle cut occurring within a range of 5-degrees and 60-degrees off of a cut perpendicular to film layer 102 though angles greater than 60-degrees or less than 5-degrees are viable. Said angle cut being curved or cut on a second axis is also practicable.

Figure 17:
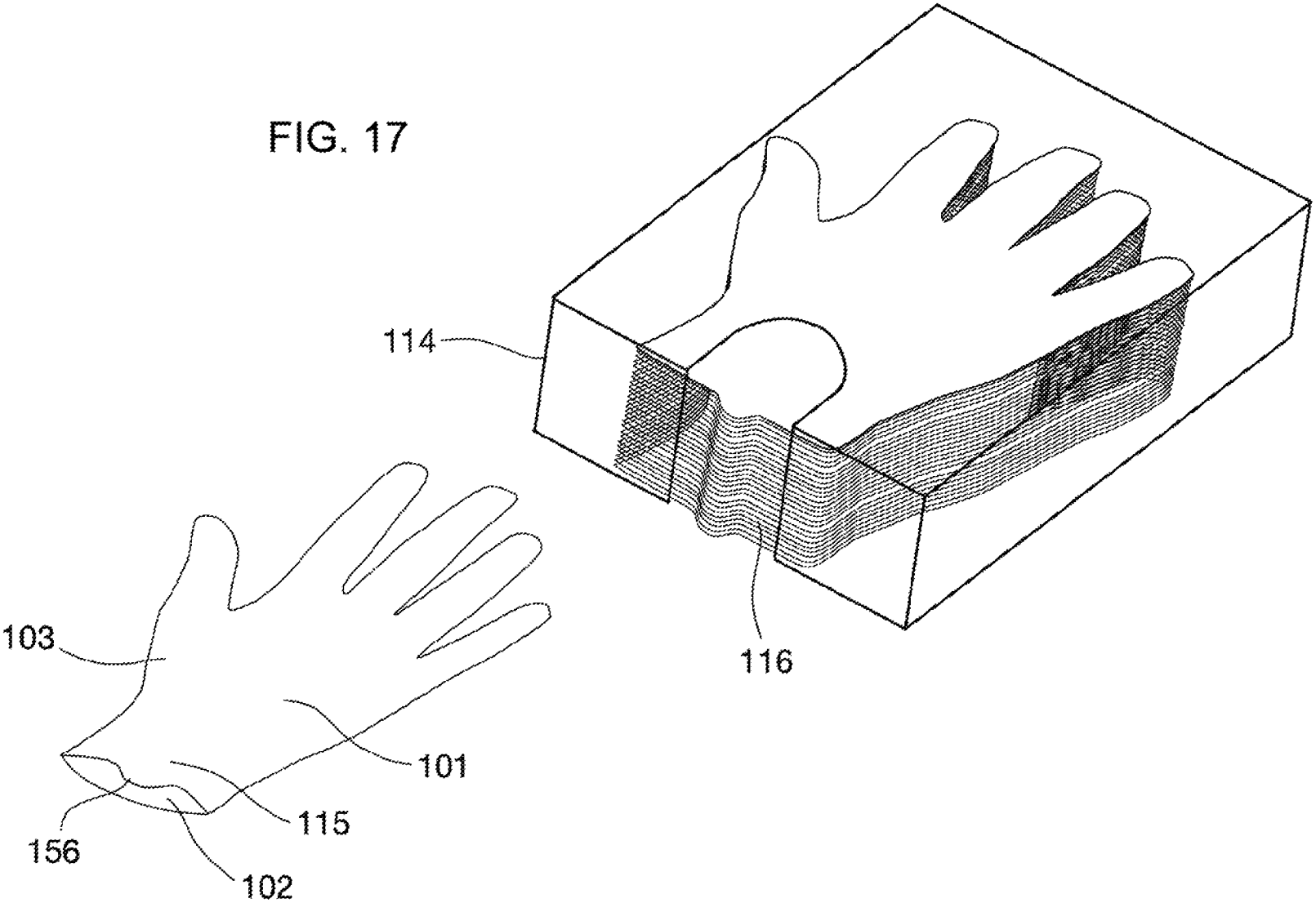
FIG. 17 is a perspective view of a glove dispenser for gloves having a tab extending from the cuff in accordance with an embodiment.

FIG. 17 shows a box 114 of gloves in a stack 116 for a user to pull out and don. The depicted gloves in FIG. 17 feature a non-overlapping cuff tab 156 on the top film layer 103 of the gloves in a stack 116 where the user pulls out the top two-layer glove 101 by the non-overlapping cuff tab 156 causing glove film layers 102 and 103 to separate at the cuff 115 as the glove is pulled from the box making the glove easier to don and reducing the need for a user to contact the exterior areas of the glove other than the non-overlapping cuff tab 156 or cuff 115 region. In accordance with another embodiment of the present invention, a user presses down on a non-overlapping tab such as the non-overlapping tab on the lower layer of a glove causing a glove opening for a user to don the glove.

In accordance with embodiments of the present invention, the boxed glove configurations identified in FIG. 10, FIG. 11, and FIG. 17 may include any of the gloves or glove features described thereof or herein such as gloves with an offset cuff, differential cross-sectional cuff lengths, offset tabs, non-overlapping tabs, formed features, or thinned or thickened regions as well as other glove features described or not described herein and combinations or variations being understood by those of skill in the art.

In accordance with embodiments of the present invention, two layer disposable gloves 101, 164 or formed gloves 165 may further include mounting features for mounting the disposable glove. Mounting features comprise extra material extending from one of the first layer 102 or second layer 103 of the glove providing a surface for mounting the glove and/or connecting the glove to other gloves in a stack 116. In accordance with certain embodiments the mounting features can be configured to separate from the glove when the glove is donned. In other embodiments, the mounting features are configured to release with the glove when the glove is donned.

Figures 18A, 18B, 18C:
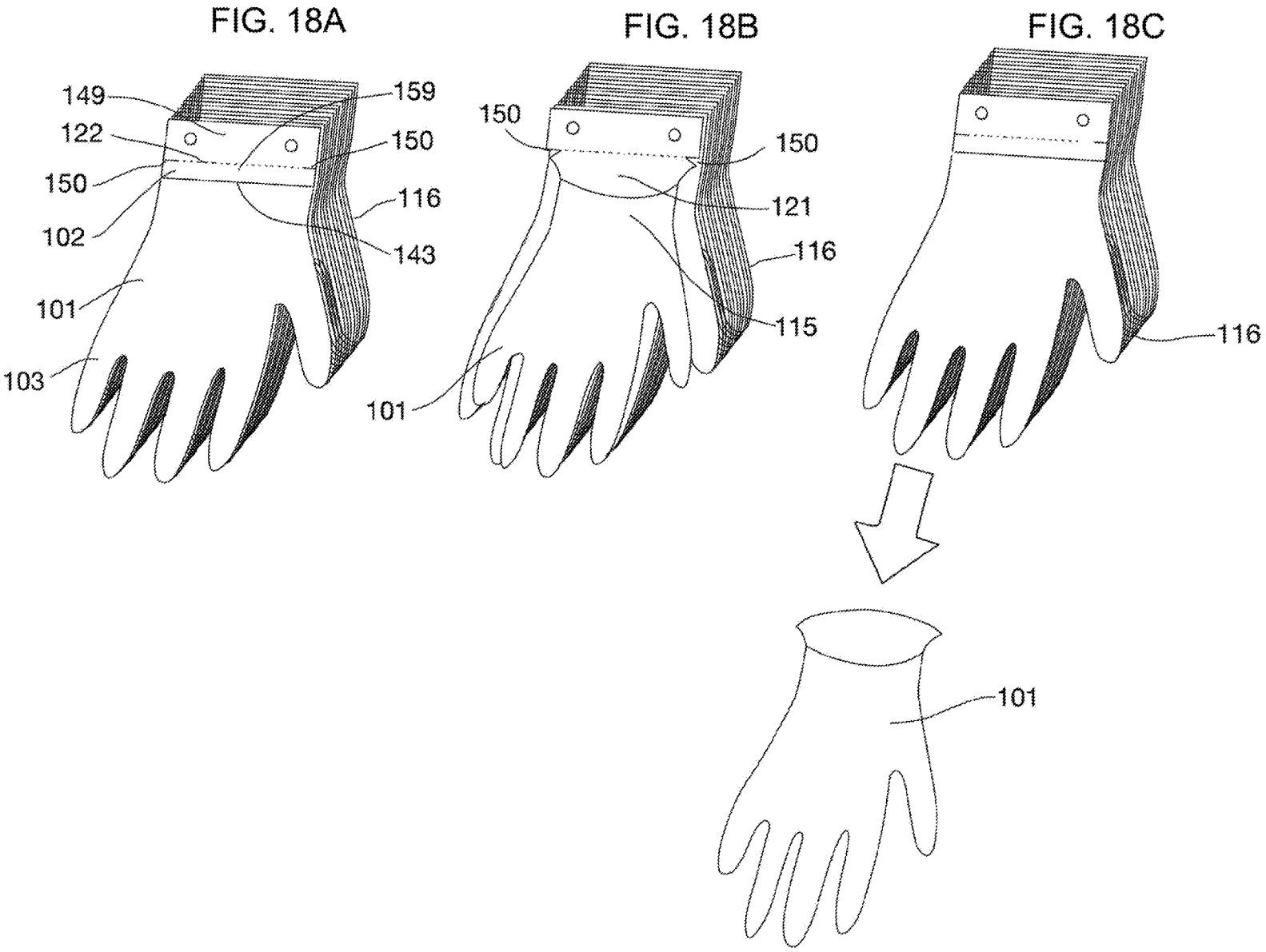
FIG. 18A, FIG. 18B, and FIG. 18C are perspective views of a stack of gloves with mounting features and opening reliefs in accordance with an embodiment.

In accordance with one embodiment of the present invention, FIGS. 18A-18C identifies a stack 116 of two-layer gloves 101 fused, stapled, or otherwise joined together within a separation region 149 mounting feature where a perforated or weakened material line 122 resides alongside the separation region 149 of film layer 102, which separates the separation region 149 from the two-layer glove 101. Where said separation region 149 is appropriately constrained or mounted such that said perforated or weakened material line 122 is of sufficient strength to remain intact until a user has fully donned said glove, at which point the additional force, such as a force between 0.5 pounds and 4.0-pounds, applied by a user breaks the perforated or weakened material line 122 and separates said glove from said separation region 149. Said perforated or weakened material line 122 being of any curve or shape to achieve the desired effect or glove geometry.

In accordance with one embodiment of the present invention, the separation region 149 includes material from both film layers 102 and 103 or is composed of material from the bottom film layer 102 and does not include any material from top film layer 103. In accordance with one embodiment of the present invention, a region 159 exists where no material is present from top film layer 103 providing an offset cuff to improve the accessibility of the glove opening although a slit through the top film layer 103 of film is used to define the glove opening in accordance with another embodiment of the present invention. As the number of gloves in stack 116 is reduced, the remaining height of the separation region 149 becomes an increasing impediment as it is directly in the path of where a user needs to place their hand for donning. A large distance between cuff opening edge 143 and perforated or weakened material line 122 helps reduces the negative impact caused by the remnant separation region 149. In accordance with one embodiment of the present invention, cuff opening edge 143 and perforated or weakened material line 122 are aligned. Folding the separation region 149 out of the path of donning is also practicable but suffers from other shortcoming such as increasing the space requirements, changing the feel of glove donning as a stack depletes, creating a slanted stack, as well as producing other issues.

Glove opening reliefs 150, such as separation lines are featured at one or both ends of the perforated or weakened material line 122 such as those shown in FIG. 18A in accordance with other embodiments of the present invention. FIG. 18A shows a stack 116 of gloves with two glove separation line opening reliefs 150 intact on a topmost two-layer glove 101 and FIG. 18B shows a topmost two-layer glove 101 of stack 116 having been opened and said glove separation line opening relief 150 torn apart to provide a more open and donnable glove where separation region 149 is rigidly or semi-rigidly connected to a stack or dispenser. FIG. 18C depicts two-layer glove 101 torn from stack 116. In accordance with an embodiment of the present invention, said glove separation line style opening relief 150 is a weaker perforated or weakened length or lengths than perforated or weakened material line 122 that are designed to tear apart to create slack as glove opening 121 is accessed, making it easier for the cuff 115 to be opened for improved donning capability.

In accordance with one embodiment of the present invention, the force to separate a two-layer glove 101 after donning from stack 116 is between 0.5 and 4.0 pounds for ease of use and still ensures that the user is able to get their hand fully into the glove prior to said two-layer glove 101 separating from said stack 116. In accordance with one embodiment of the present invention, the force holding the separation line opening relief 150 intact is 2 to 100 times less than the force to separate a donned two-layer glove 101 from said stack 116. In accordance with one embodiment of the present invention, the force to hold glove separation line opening relief 150 intact are more than 100 times less than the force to separate a donned two-layer glove 101 from said stack 116. In accordance with other aspects of the present invention, a glove opening relief 150 is a fully cut through length.

Figure 19C:
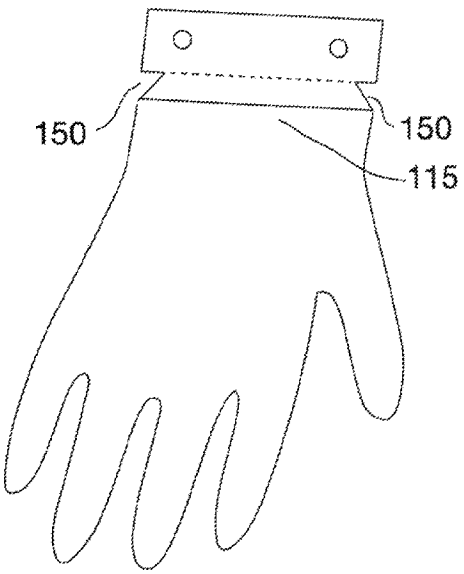
FIG. 19A-19D depict gloves with alternate opening reliefs in accordance with an embodiment.
Figure 19B:
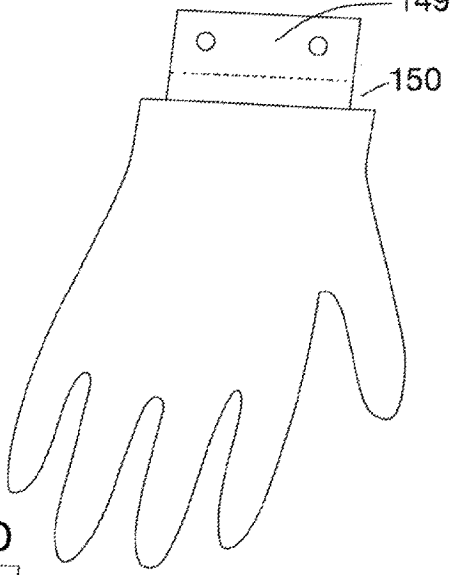
Figure 19A:
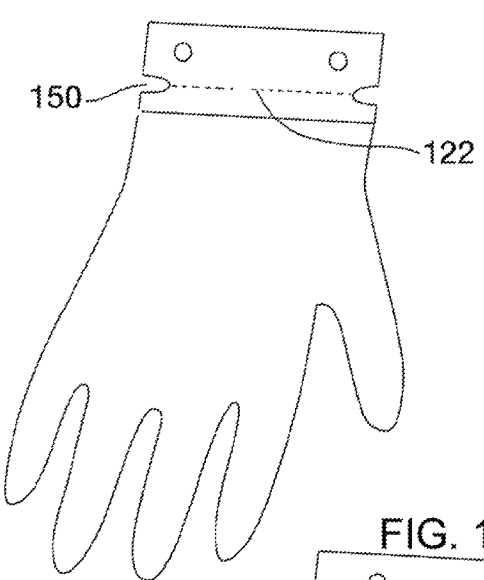

In accordance with one embodiment of the present invention, glove opening relief 150 is a slotted region as shown in FIG. 19A. Material relief areas are identified as glove opening reliefs 150 in FIG. 19B are also present, in accordance with another embodiment of the present invention, by simply narrowing the separation region 149. FIG. 19C provides the glove opening relief function with an angular glove opening relief 150 region at both sides of the cuff 115. Any combination of relief methods described or not described herein are also practicable and said combination being understood by those of skill in the art.

Since conventional quick don glove solutions do not have a glove opening relief feature of the present invention, other accommodations with various shortcomings are used to assist donning such as the incorporation of an overly wide cuff or excess length between the separation region and the glove opening. Without appropriately relieving the glove opening, the cuffs of the gloves are generally more resistant to opening for donning where the gloves are effectively held taut by a separation region or mounting posts or some other donning apparatus feature. If a stack is fabricated with a feeble weakened material line, such as perforated or weakened material line 122 of FIG. 19A, to assist with opening; it prevents the glove from being held taut or the glove separates from the stack prematurely before the glove is properly donned.

Figure 19D:
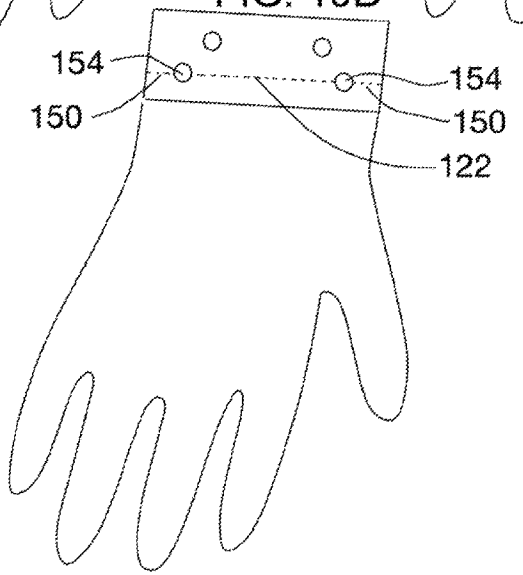

In accordance with one embodiment of the present invention, FIG. 19D features tear propagation prevention features 154, such as a hole, serving as distinct points of transition for the low tearing strength separation line opening reliefs 150 and the high tearing strength perforated or weakened material line 122.

The function of the glove opening reliefs 150 is also achieved by other means. For example, in accordance with an embodiment of the present invention, a perforated or weakened material line 122 varies in strength across its length without having a defined glove opening reliefs 150 region. Said varied strength perforated or weakened material line 122 begins to tear at the ends for a user to access the glove opening and then provides a greater force to hold two-layer glove 101 to stack 116 for a user to don before fully tearing free from stack 116 once sufficient force is applied.

The function of the glove opening reliefs 150 is also achieved by differential cross-sectional cuff lengths or formed features. Combining glove opening reliefs with differential cross-sectional cuff length gloves or formed gloves produces additional benefits and such combinations being understood by those of skill in the art.

Figure 20B:
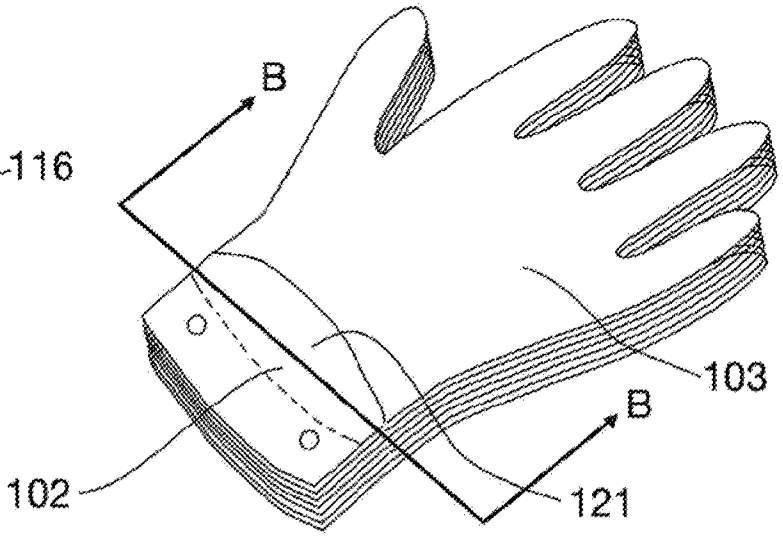
FIGS. 20A and 20B are perspective views and corresponding cross-sectional views of a glove stack bent to assist in opening and donning in accordance with an embodiment.
Figure 20B:
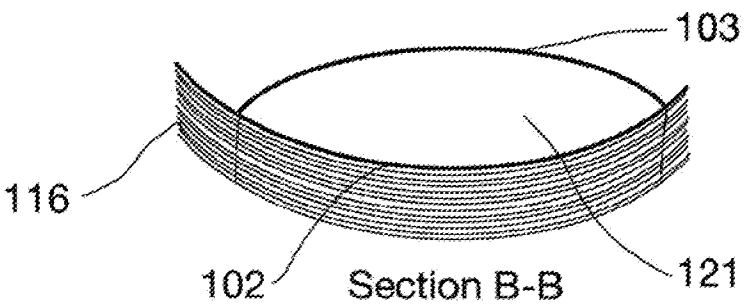
Figure 20A:
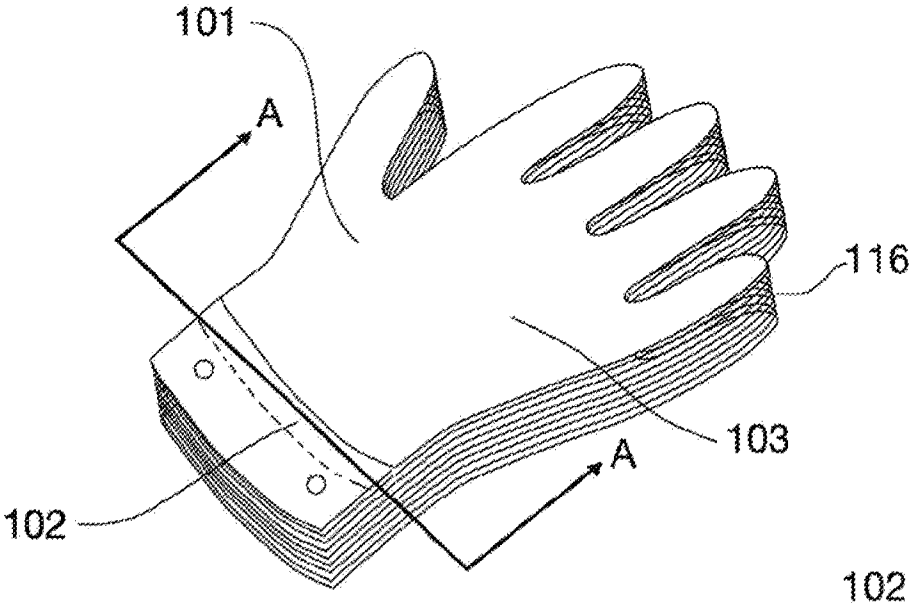
Figure 20A:
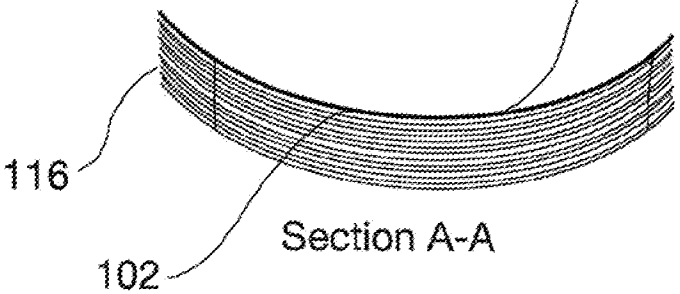

In accordance with embodiments of the present invention, FIG. 20A and FIG. 20B portray a means for achieving the function of glove opening reliefs by curving or creasing stack 116 to bias stack 116 and film layer 102 away from glove opening 121. FIG. 20A shows glove film layer 103 of the top most two-layer glove 101 curved with stack 116 and FIG. 20B shows glove film layer 103 curved away from stack 116 to create glove opening 121 for donning. Keeping film layer 102 taut or deflected away from the location where a user positions their hand for donning promotes ease of access.

Figure 21C:
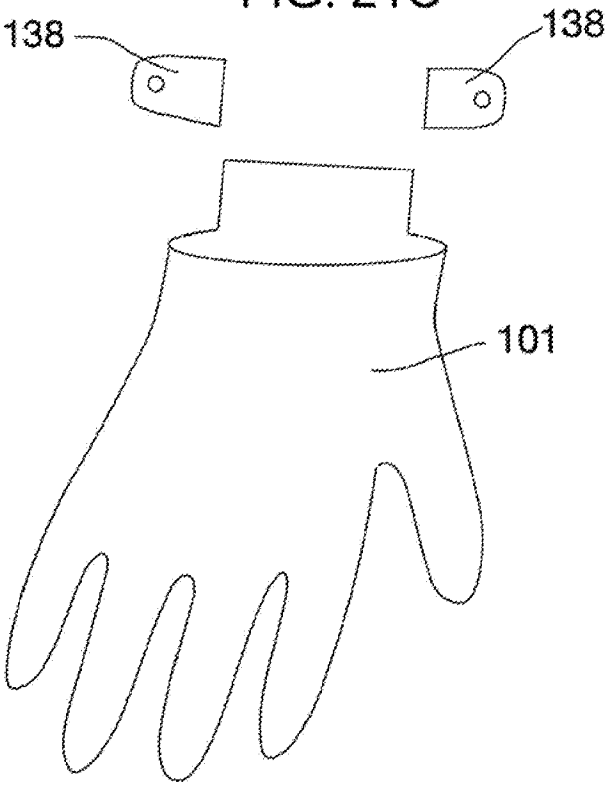
FIG. 21A, FIG. 21B, and FIG. 21C depict gloves with alternate mounting features and opening reliefs in use in accordance with an embodiment.
Figure 21B:
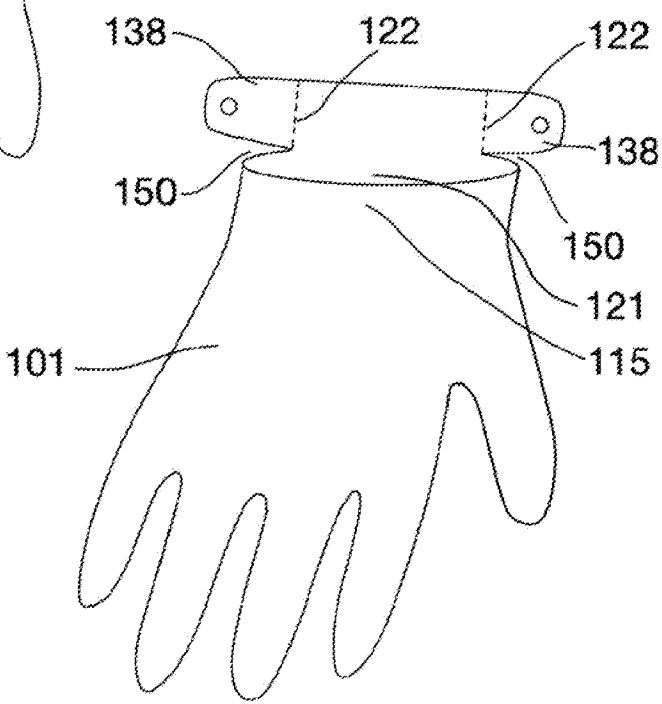
Figure 21A:
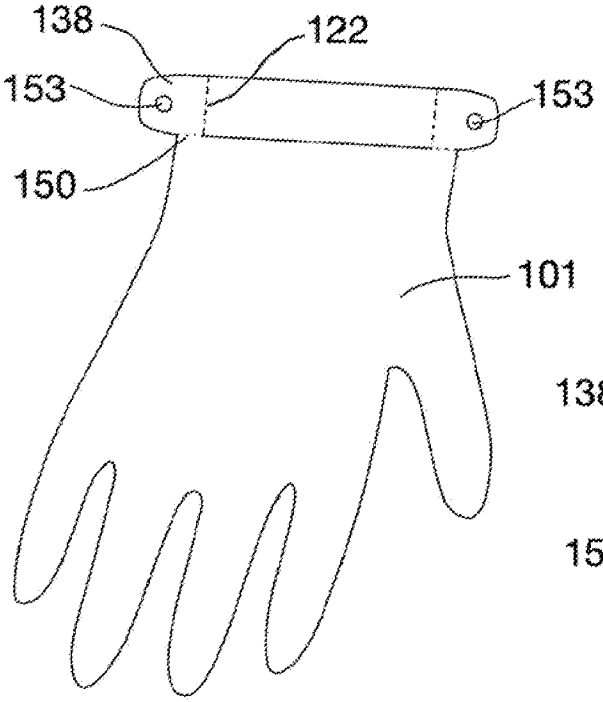

Since donning is increasingly impeded as a glove stack 116 is reduced with a separation region 149 mounting feature positioned in front of the glove openings 121 where the separation region 149 remains intact and in the way of where a user is attempting to place their hand to access the cuff 115 of a topmost glove per FIGS. 18-20, a further embodiment in accordance with aspects of the present invention is identified in FIGS. 21A-21C featuring side separation regions 138 mounting features located at the sides of a cuff 115 where said side separation regions 138 are mounted on a donning apparatus using one or more mount holes 153 or some other mounting feature such as clips. In accordance with one embodiment of the present invention, glove side separation regions 138 feature a perforated or weakened material line 122 tear location between a side separation region 138 and a two-layer glove 101 as shown in FIG. 21A and FIG. 21B such that the side separation region or side separation regions 138 tear free of a glove at said perforated or weakened material line 122 and remains with the donning apparatus when a glove is pulled free. FIG. 21B shows said two-layer glove 101 of FIG. 21A but in an open and donnable position with the cuff 115 easily opening up to create glove opening 121 due to the function of glove opening reliefs 150 where constrained separation regions 138 would otherwise limit the ability of the glove to properly open to a donnable position. FIG. 21C shows said two-layer glove 101 in a donned state having been separated from side separation regions 138, which remain with a stack, donning apparatus, web or film roll, or the like. In accordance with aspects of the present invention, glove side separation regions 138 are connected to adjacent glove side separation regions or are independent. In accordance with other embodiments of the present invention, each glove side separation region 138 is composed of one or both glove material layers or any portion or combination thereof.

Figures 22A, 22B, 22C:
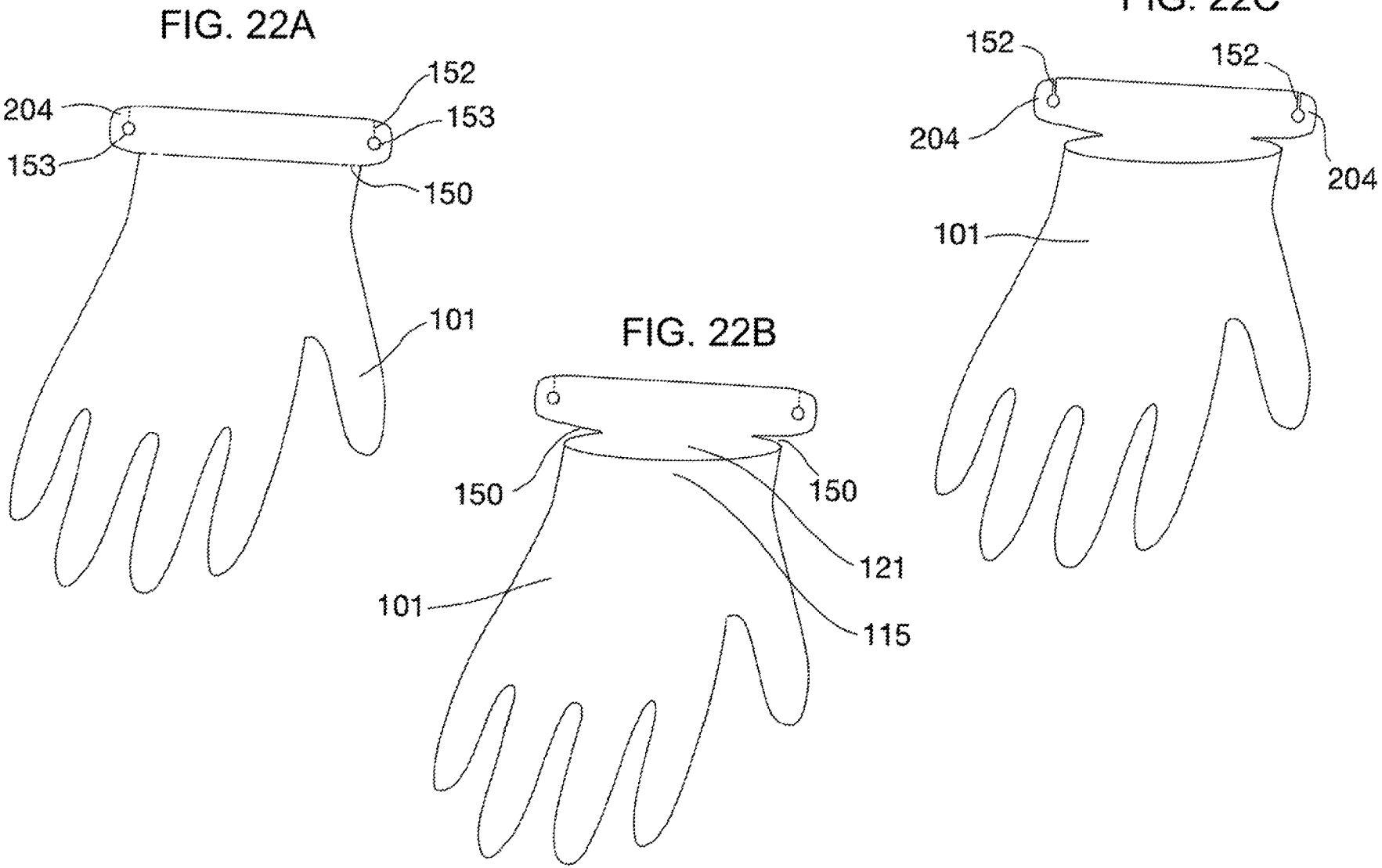
FIG. 22A, FIG. 22B, and FIG. 22C depict gloves with alternate mounting features and opening reliefs in use in accordance with an embodiment.

FIG. 22A shows a stackable two-layer glove 101 with glove opening reliefs 150 and glove mounting features 204 that remain with the glove when separated from a donning apparatus instead of side separation regions 138 of FIG. 21A that stay with the donning apparatus when a glove is removed. FIG. 22B shows said stackable two-layer glove 101 of FIG. 22A but in an open and donnable position with the cuff 115 easily opening up to create glove opening 121 due to the function of the glove opening reliefs 150. FIG. 22C portrays a two-layer glove 101 in an open and donned state with perforated or weakened separation tearing lines 152 on glove mounting features 204 having been separated, signifying that the glove has been removed from a donning apparatus. In accordance with another embodiment of the present invention, the gloves shown in FIGS. 22A-22C do not feature glove opening reliefs and said gloves have a differential cross-sectional cuff length, are folded or curved, are formed, or have no additional opening relief means or rely on film stretch or donning apparatus compliance or the like or features any other means discussed thereof or herein for accessing a glove opening 121.

Since the glove transitions to a three-dimensional shape as it is opened, glove mounting locations such as mount holes 153 of glove mounting features 204, are positioned inboard of cuff side edges of the glove in a flat state, as shown in FIG. 23A without interfering with a user's hand when they attempt to don a glove in accordance with one embodiment of the present invention. FIG. 23A shows a two-layer glove 101 in its otherwise flattened state with mount holes 153 of the mounting features 204 positioned inboard of cuff side edges 141 and 142. FIG. 23B identifies the two-layer glove 101 of FIG. 23A but in an opened and donnable state where glove opening relief 150 locations provide a means for cuff side edges 141 and 142 to pull in towards the glove region as the glove is opened to create glove opening 121 and causing cuff side edges 141 and 142 to be inboard of the glove mount holes 153 of the mounting features 204. In accordance with an embodiment of the present invention, a mounting width 205, defined by the minimum distance between mounting locations on a glove, is less than the minimum flat donning path width 206 of a flat or flattened glove on a glove dispenser where opening of said glove to a maximum opening depth 207 of 1 to 3 inches results in a maximum open donning width 208 that is equal to or less than the glove mounting width 205 providing a clear path for a user to don a glove where said widths 205, 206, and 207 are generally parallel to a glove opening as shown in FIG. 23A and FIG. 23B.

Figure 24B:
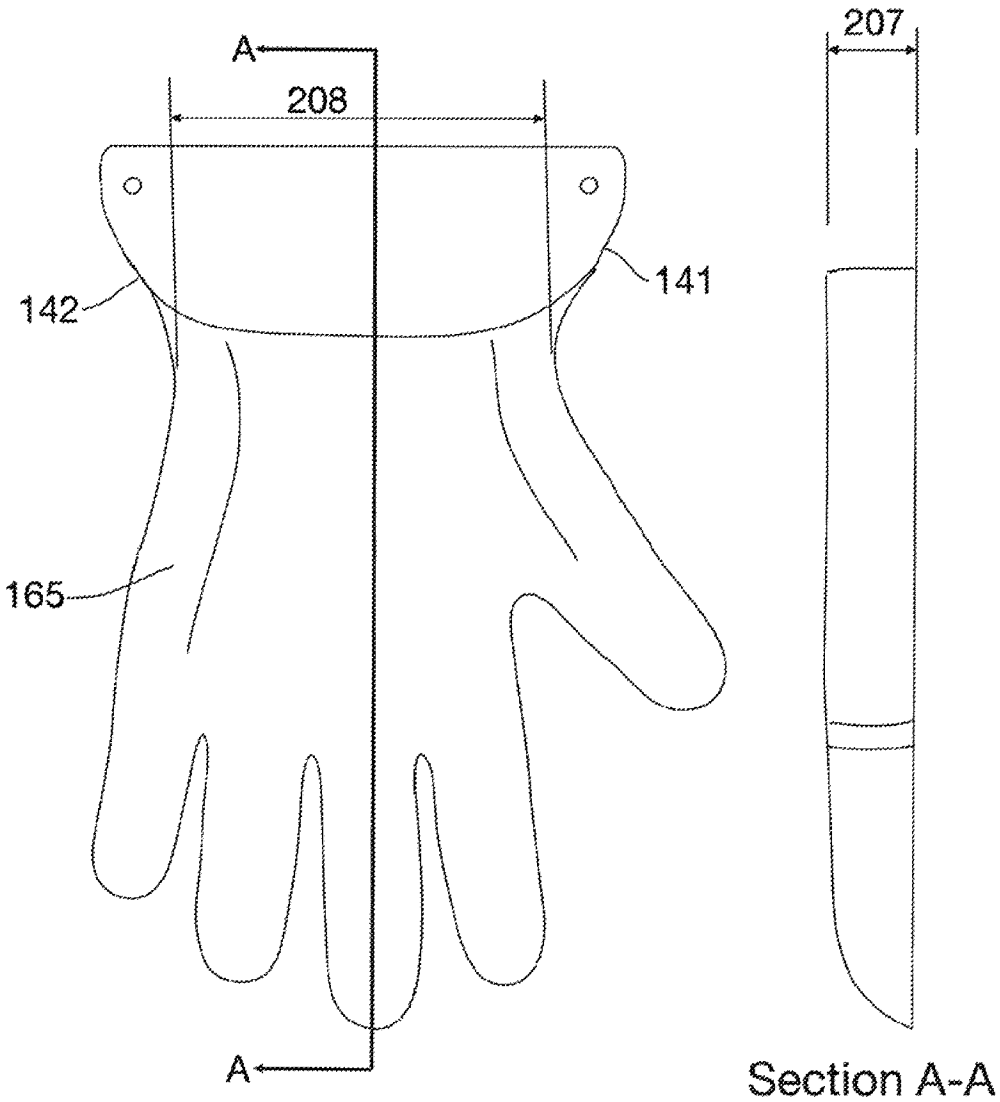
FIG. 24A and FIG. 24B are perspective views and a corresponding cross-sectional view of gloves with alternate widths for mounting holes on mounting features of gloves in relation to cuff opening in accordance with an embodiment.
Figure 24A:
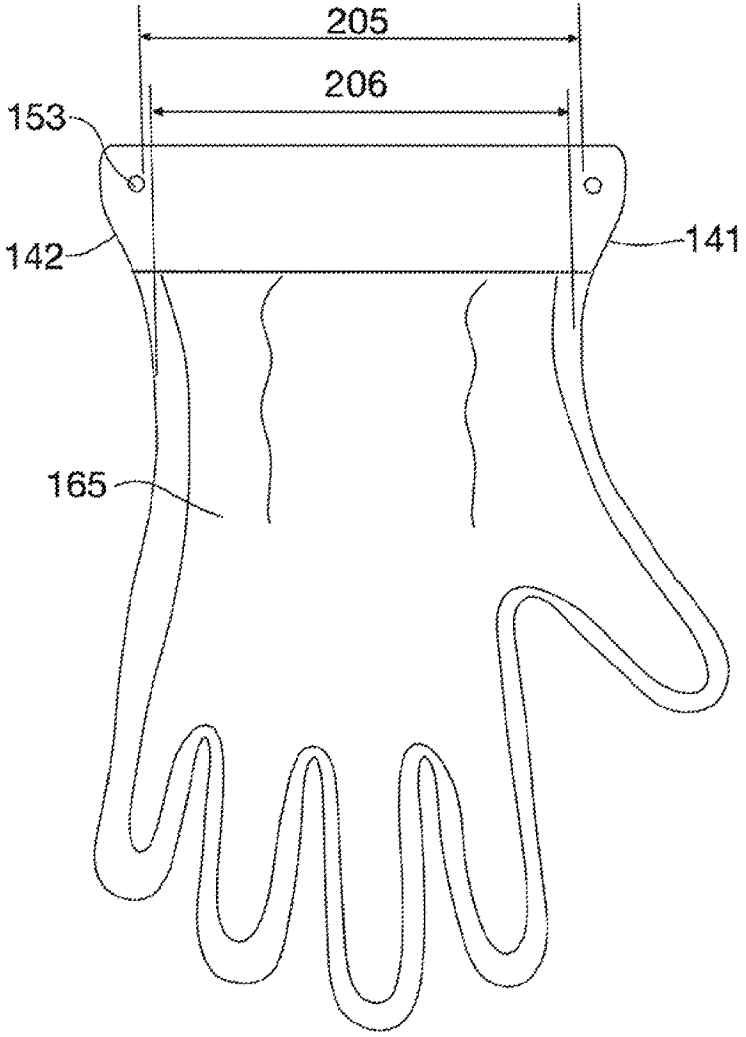

Per FIG. 24A and FIG. 24B, in accordance with another embodiment of the present invention, a mounting width 205, defined by the minimum distance between mounting locations on a formed glove 165, is equal to or larger than the minimum flat donning path width 206 of a flat or flattened glove where the mount holes 153 are still positioned inboard of cuff side edges 141 and 142 such that the minimum flat donning path width 206 is the smallest location in a glove where a user's full hand or the bulk of a user's hand has to pass through in order to don a glove. Opening of said glove to a maximum opening depth 207 of 1 to 3 inches results in a maximum open donning width 208 that is less than the glove mounting width and providing a clear path for a user to don a glove.

It should be understood by one of skill in the art that mount holes 153 or other aspect of mounting features 204 can be in-board or outboard or in line with cuff side edges 141 or 142 and any of the cuff features for the gloves shown in FIG. 21A, FIG. 22A, FIG. 23A, and FIG. 24A or any other gloves discussed thereof or herein such as gloves with opening reliefs are interchangeable or combinable or removable in accordance with an embodiment of the present invention. In accordance with an embodiment of the present invention, glove mounting features 204 or separation regions 149 or side separation regions 138 are composed of material from one or both material layers or additional layers of material. Using both layers or additional layers of material for generating tear locations provides another means for increasing the tear strength other than geometry changes or material changes or process changes or the like. In accordance with an embodiment of the present invention, glove mounting regions or separation regions or side separation regions are composed of one or more material layers or additional layers of material where both layers of a mounting feature or features reside on one side of a glove. In accordance with an embodiment of the present invention, the two-layer gloves of FIG. 21A, FIG. 22A, FIG. 23A, or FIG. 24A or any of the embodiments discussed thereof or herein are made from starch-based thermoplastic and have mounting feature or features to be used on a dispenser.

Figure 25:
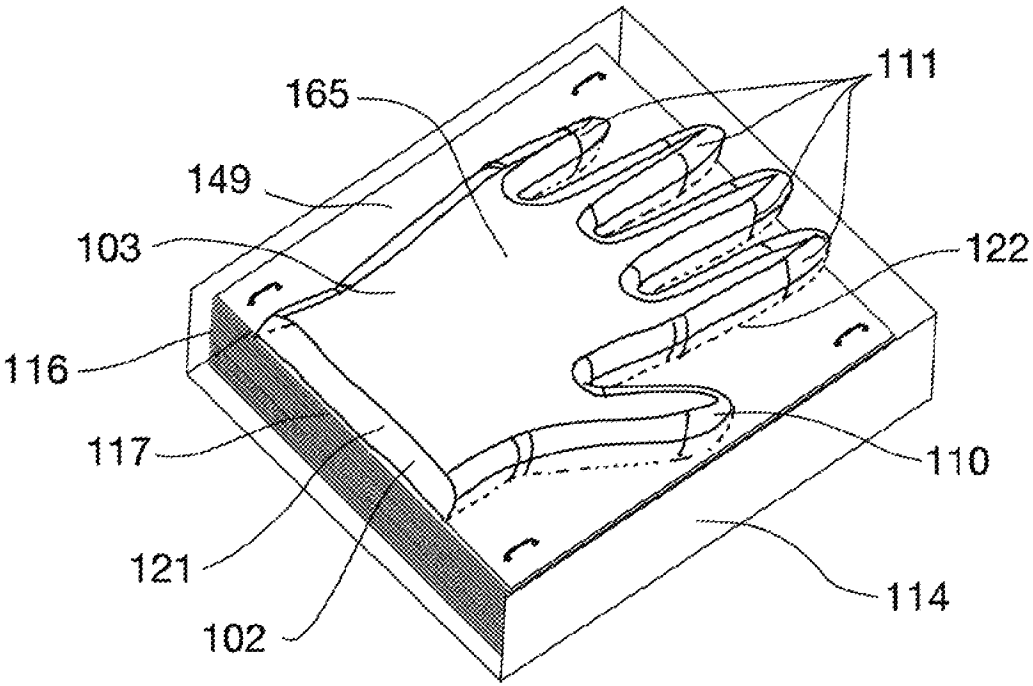
FIG. 25 is a perspective view of another alternate stack of gloves having formed geometry and mounting features in use on a dispenser in accordance with an embodiment.

A donning box 114 is shown in FIG. 25 where formed gloves 165 are integrally arranged in a stack 116 of sheets. Separation region 149 mounting features, about all or a portion of formed glove 165, includes material from flat film layer 102 or formed film layer 103 or material from both film layers 102 and 103. A cut and perforated or weakened material line 122 outlines the formed gloves such that the top-most formed glove 165 can be donned and torn free from a stack 116 and its corresponding separation region 149. Separation region 149 or stack 116 can in turn be tethered to donning box 114. Tearing free the top-most formed glove 165 opens a subsequent glove 117 in accordance with an embodiment of the present invention. In accordance with another embodiment of the present invention, the donning box 114 is fully open and exposed in front of glove openings 121 as not to impede donning throughout the stack 116.

In accordance with aspects of the present invention, film layer 102 is held in an elastically deformed, compressed flat (not three-dimensionally formed) or substantially flat form to hold lower layers down and permit only the formed film layer 103 of the top formed glove 165 in stack 116 to open to a formed position for donning. Creating formed geometry in just the top film layer 103 for each glove shape in stack 116 provides for all of the formed geometry to open away from stack 116 for improved donnability.

With fingers 111 positioned in a non-splayed state or a minimally splayed state, donning box 114 footprint is also reduced in size. In accordance with one embodiment of the present invention, excess separation region 149 material between fingers 111 and thumb 110 is removed prior to packaging or fully slit prior to packaging such that the fingers 111 and thumb 110 are free once the formed glove 165 is torn away and fingers 111 and thumb 110 do not have to be individually separated from each other.

Other than removing or slitting locations of separation region 149 from between fingers 111 and thumb 110, removing portions of the separation region 149 is practicable for improving the donning process, reducing the packaging weight and consumer waste, eliminating the potential for loose strings of material and for other reasons not mentioned.

Figure 26:
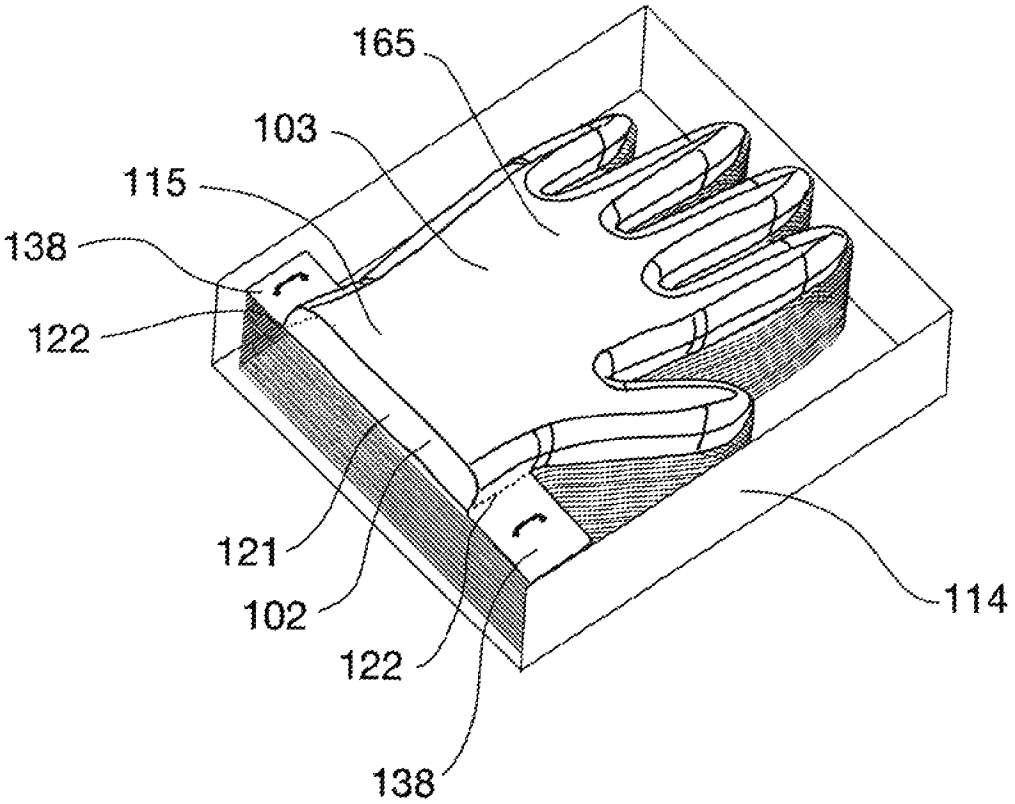
FIG. 26 is a perspective view of another alternate stack of gloves having formed geometry and mounting features in use on a dispenser in accordance with an embodiment.

FIG. 26 identifies another donning box 114, similar to FIG. 25, where the mounting features comprise side separation regions 138 near the cuff 115 region and not positioned in front of glove opening 121. Side separation regions 138 hold film layer 102 down and relatively tight keeping all film layer cuff regions below formed glove 165 flat such that the formed film layer 103 is easily separable from film layer 102 to form glove opening 121. Said donning box 114 features any of the glove types described herein or thereof including differential layer sized gloves and gloves with glove opening relief features in accordance with embodiments of the present invention.

Figures 27A, 27B, 27C:
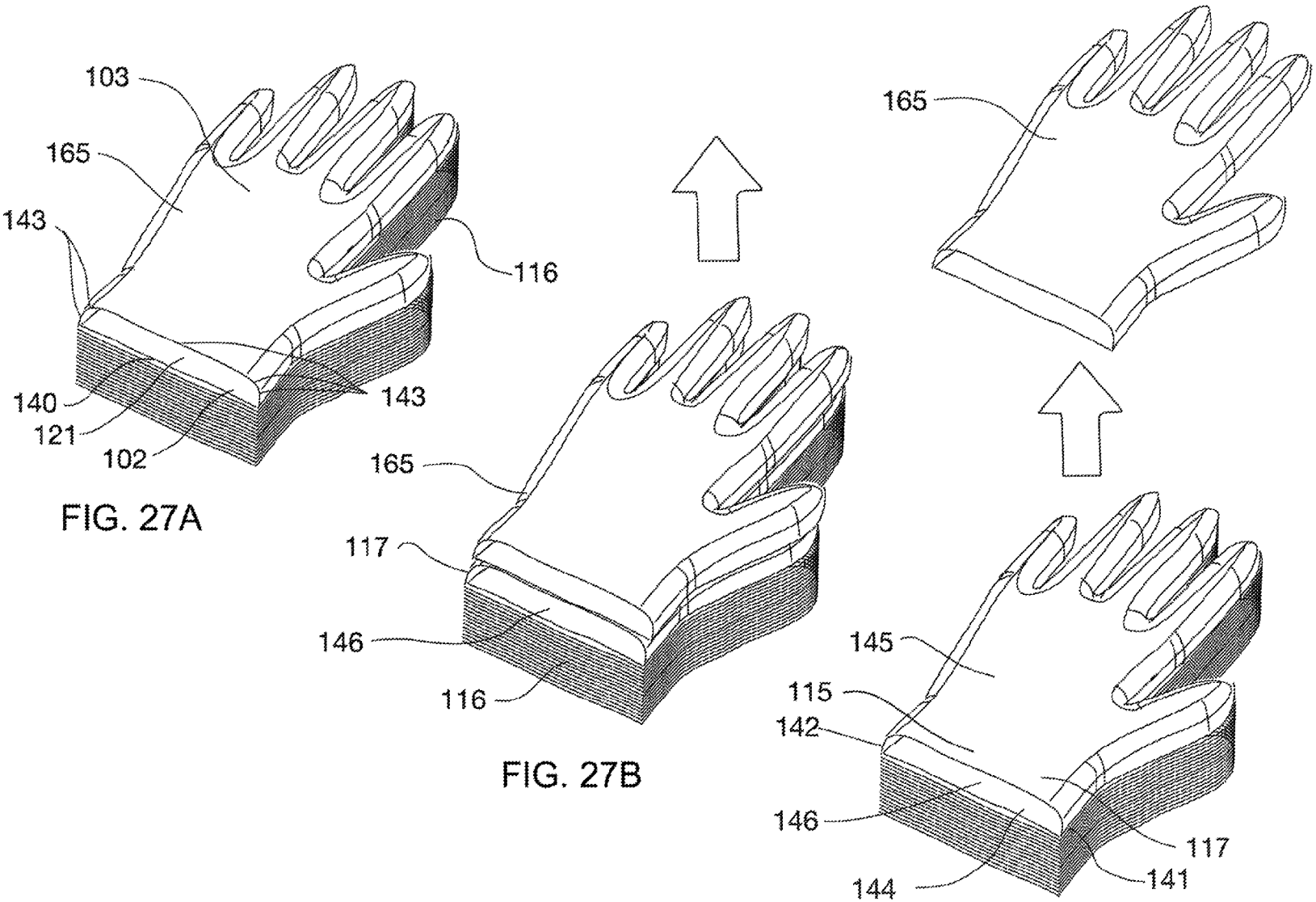
FIG. 27A, FIG. 27B, and FIG. 27C are perspective views of a stack of gloves having formed geometry in use in accordance with an embodiment.

FIGS. 27A-27C portray an embodiment of the present invention where a set of two or more three-dimensionally formed gloves 165 are overlaid and compressed into an elastically deformed flattened stack 116. In accordance with one embodiment of the present invention, said gloves are tethered together at one or more locations such as along cuff side edges 141 and cuff side edges 142 although said gloves are left untethered and independent of one another in accordance with another embodiment of the present invention. Although FIGS. 27A-27C depicts formed gloves where a cuff opening edge 143 is longer than cuff opening edge 140 to promote easy access for donning, other methods to promote easy access for donning are practicable in accordance with other embodiments of the present invention, such as curving or creasing stack 116 to bias stack 116 and film layer 102 away from glove opening 121, similar to glove stack shown in FIG. 20A and FIG. 20B, or by adding one or more glove opening reliefs 150 or other methods as described herein.

FIG. 27A shows a glove stack 116 where the topmost formed glove 165 is open and ready for donning. FIG. 27B illustrates formed glove 165 in the process of separating from stack 116 where it is still attached to now open subsequent glove 117. Having the act of tearing away a donned formed glove 165 open a subsequent glove 117 removes the need for the user to manually open subsequent glove 117 prior to donning as this slows down the donning process and generally results in the user having to contact the exterior of the glove and causing the spread of contamination. FIG. 27C shows formed glove 165 being fully separated from subsequent glove 117 and subsequent glove 117 open and prepared for donning. Opening the entire subsequent glove 117 to its natural formed shape is helpful for donning but simply opening the cuff 115 or partially opening the cuff 115 is sufficient to separate film layers 144 and 145 to allow the user's hand to enter the glove. In accordance with an embodiment of the present invention, gloves are connected to or otherwise attracted to material from one or more adjacent gloves in a region or regions within the perimeter of the glove such that donning a glove causes a subsequent glove to open in preparation for donning. In accordance with certain embodiments, treatments such as chemical, electrostatic or heat can be applied to connect or otherwise attracted the material of adjacent gloves in the stack 116.

Features or mechanisms that cause a subsequent glove 117 to open at glove opening 146 as the previous glove is pulled away and removed from stack 116, such as the formed glove 165 shown in FIGS. 27A-27C, include adhesive, staking, melted or sealed glove layers, mechanical engagement such as texturing, interlaced and folded layers, corona treated surfaces, frictional properties and glove separation methods, or by some other means that are appreciated by those of skill in the art. Treating, charging, composing layers of differing materials, or otherwise fabricating the two internal surface layers of the gloves such that they oppose one another and are inclined to separate resulting in an open state or an easily openable state further aid in the opening of gloves for donning. In accordance with embodiments of the present invention, additional mechanisms are employed to assist with opening the glove opening 121 of the uppermost glove in a stack 116 such as a spring-loaded mechanism; air bladder, pump, or the like; electromechanical means such as air flow, vacuum, ruffling or the like; and other methods not mentioned including methods that are understood by those of skill in the art. In accordance with other embodiments of the present invention, any of the gloves or glove stacks described thereof or herein feature a glove interconnection means for removing a glove to open the cuff of a subsequent glove in preparation for donning.

In accordance with one embodiment of the present invention, the act of removing a formed glove 165 and opening a subsequent glove 117 from a stack 116 does not create a load substantial enough to open any other gloves in stack 116 other than subsequent glove 117 or separate any other glove other than formed glove 165 that is being removed as depicted in FIGS. 27A-27C. Gloves below subsequent glove 117 in stack 116 are held flat or substantially flat by film layer 144 assuming gloves in a stack are tethered such as at or near cuff side edge 141 and 142, and are therefore not inclined to take a formed shape and is in a tensioned state or subject to potential tension if deflected. The shorter length of cuff opening edge 140 of film layer 102 compared to formed cuff opening edge 143 of film layer 103 also promotes the formation of glove opening 121. In accordance with one embodiment of the present invention, the holding force between each glove to the stack 116 or a donning apparatus, such as a holding force at or near cuff side edges 141 and 142, is greater than the bond between a glove and a subsequent glove. This ensures that formed glove 165 tears free from stack 116 and only subsequent glove 117 opens. In accordance with one embodiment of the present invention, the force to separate a formed glove 165 after donning from stack 116 or dispenser is between 0.5 and 4.0 pounds for ease of use and still ensures that the user is able to get their hand fully into the glove prior to said formed glove 165 separating from said stack 116 or donning apparatus. In accordance with one embodiment of the present invention, the holding force between each glove in a stack is 2 to 100 times less than the force to separate a donned formed glove 165 from stack 116 or a donning apparatus so that removing formed glove 165 consistently opens subsequent glove 117 without tearing away or starting to tear away subsequent glove 117 from stack 116 or a donning apparatus. In accordance with one embodiment of the present invention, the holding force of formed glove 165 to subsequent glove 117 at forces as low as 0.01 pounds or less is sufficient to still open subsequent glove 117 when removing formed glove 165. In accordance with one embodiment of the present invention, cuff 115 is predisposed to re-form when in an unloaded state due to material memory. Cuff 115 features a folded layer or the addition of material or a material treatment operation or alternate material or some other method mentioned or not mentioned, including methods that are understood by those of skill in the art, to provide structure or an ability to retain its shape after being opened or be inclined to open when not held shut.

Figures 28A, 28B, 28C:
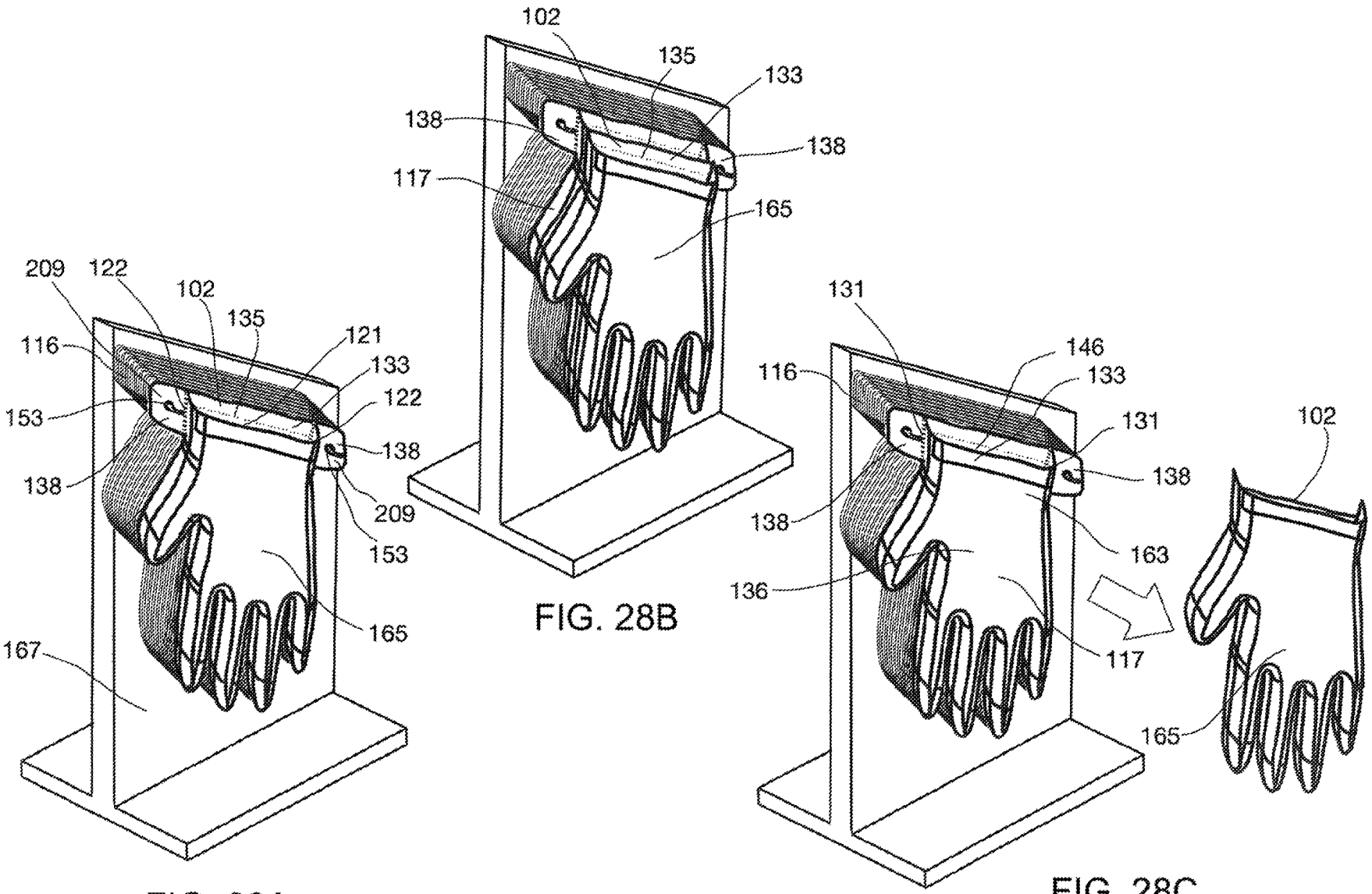
FIG. 28A, FIG. 28B, and FIG. 28C are perspective views of a stack of gloves having formed geometry in use on a dispenser in accordance with an embodiment.

FIGS. 28A-28C identifies a residual strip of material 133 from a removed formed glove 165 that remains attached to cuff 163 of subsequent glove 117 and provides additional structure to cuff 163 for holding glove opening 146 open. A perforated or weakened material line 135 in film layer 102 defines the separation location for residual strip of material 133. The process of sealing, adhering, or other means of attaching the residual strip of material 133 of film layer 102 to formed film layer 136 of the subsequent glove 117 also increases the strength, rigidity, or ability to hold its form after opening. In accordance with other embodiments of the present invention, the residual strip of material 133 is composed of multiple strips or sections, alternate materials or adhesives, a folded layer or layers, or some other form to assist in separation or structure not mentioned thereof or herein.

FIG. 28A shows the topmost formed glove 165 of a glove stack 116 open and ready for donning where all of the side separation region mounting features 138 on each side of the gloves are held together with the adjacent side separation regions 138 to create side separation units 209 and hold said formed glove along perforated or weakened material lines 122. The side separation units 209 also provide for a mounting means such as mount holes 153 for mounting on wicketed dispenser 167. FIG. 28B illustrates formed glove 165 in a donned state and separated from its corresponding side separation regions 138 where perforated or weakened material lines 122 have been torn through and formed glove 165 still connected to subsequent glove 117 along the residual strip of material 133 region where subsequent glove 117 has been opened. FIG. 28C shows formed glove 165 separated from subsequent glove 117 where residual strip of material 133 from film layer 102 remains on cuff 163 of subsequent glove 117 and side separation regions 138 remain with dispenser 167. Said perforated or weakened material lines 135 having less strength than perforated or weakened material lines 131 holding subsequent glove 117 to stack 116 such that perforated or weakened material lines 131 are able to remain intact even though glove 165 is removed.

Having no mounting features such as tether material or separation region positioned in front of the glove opening 121 ensures that the donnability remains constant throughout the stack 116 where the user does not have to concern themselves with avoiding any remnant material layers when inserting their hand. Alternately, separation regions can remain in front of the opening and should therefore not be considered limiting to the present invention. Side separation regions or glove mounting regions can be implemented with any of the glove configurations described herein including flat gloves or differential layer sized gloves in accordance with other embodiments of the present invention.

Figure 29:
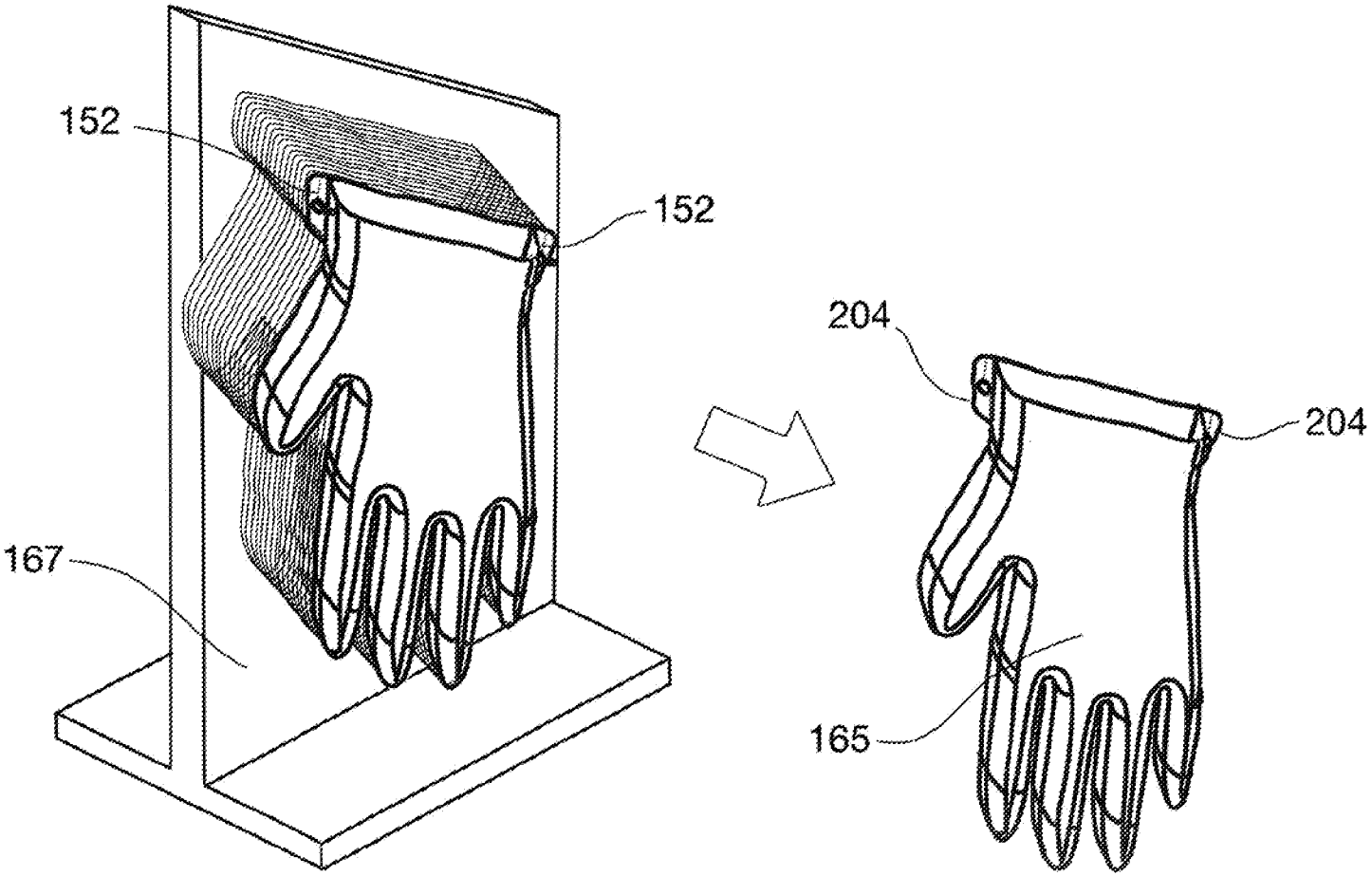
FIG. 29 is a perspective view of an alternate stack of gloves having formed geometry and mounting features in use on a dispenser in accordance with an embodiment.

In accordance with an embodiment of the present invention, FIG. 29 shows glove mounting features 204 instead of side separation regions where the glove mounting features 204 remain a part of the formed glove 165 when removed. Perforated or weakened separation tearing line 152 provide tear through points for the formed gloves 165 to easily separate. In accordance with one embodiment of the present invention, a perforated or weakened tab tearing line is not necessary, however, and the formed gloves 165 simply tear through for separation or slide off or free from wicketed dispenser 167 or some other donning apparatus. Such embodiments eliminate scrap plastic material that is common with other glove separation methods.

In accordance with an embodiment of the present invention, the mount holes of a glove stack or alternate holes or edges of a mounting feature are hot staked or melted by another means such that the gloves in a stack are connected and remain intact for stack management making it easy to handle and mount on a dispenser. In accordance with an embodiment of the present invention, the mount holes of a glove stack or alternate holes or edges are hot staked or melted by another means such that the gloves are connected and serve as a connection means for separation of gloves from one another such as for opening a subsequent glove or rigidly attaching on a dispenser. In accordance with an embodiment of the present invention, gloves are melted or sealed together along a side edge such as sealing a side edge with a hot knife or hot staking or a localized cut seal so just a small tear point and low force of separation for glove to glove separation is needed. In accordance with an embodiment of the present invention, hot staking one or more of the mounting holes or staking mounting regions in a compressed state provides an integral or semi-integral mounting feature for improved mounting capability. In accordance with an embodiment of the present invention, gloves require 0.5 to 4.0 pounds to separate a glove from a stack and 1.5× to 100× less force to separate a glove from a dispenser. In accordance with an embodiment of the present invention, gloves require 0.5 to 4.0 pounds to separate a glove from a dispenser and 1.5× to 100× less force to separate a glove from a glove stack. In accordance with an embodiment of the present invention, gloves require approximately the same amount of force to separate a glove from a dispenser or from stack. In accordance with an embodiment of the present invention, 1.5× to 1000× less separation force for opening a subsequent glove or the force to separate from an adjacent glove as a function of having opened said glove than the force required to separate a glove from a dispenser or a glove from a stack. It should be noted that opening a subsequent glove using more than 1000× less separation force than the 0.5 to 4.0 pounds to separate a glove from a stack or a dispenser is practicable as the force needed to separate the two layers of film of a glove is generally a trivial amount of force. In accordance with an embodiment of the present invention, the holding forces between gloves includes any tacked or welded feature, corona treatment, adhesives, static, mechanical engagement, or the like or any combination thereof or herein.

Figure 30:
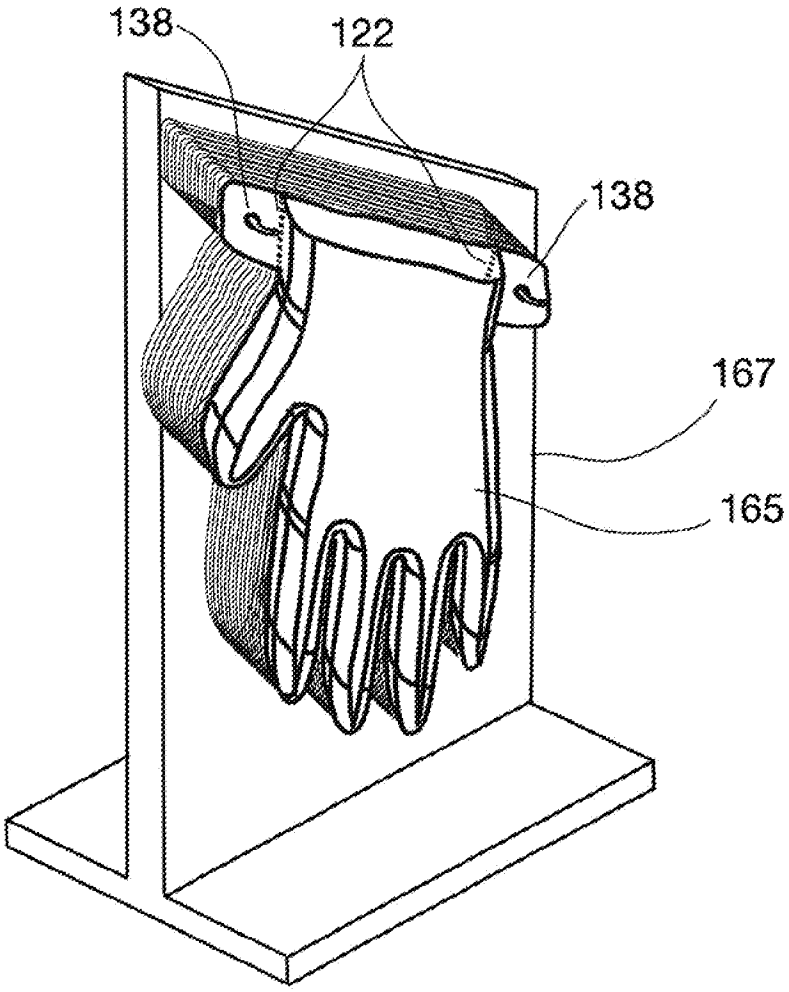
FIG. 30 is a perspective view of another alternate stack of gloves having formed geometry and mounting features on a dispenser in accordance with an embodiment.
Figure 31:
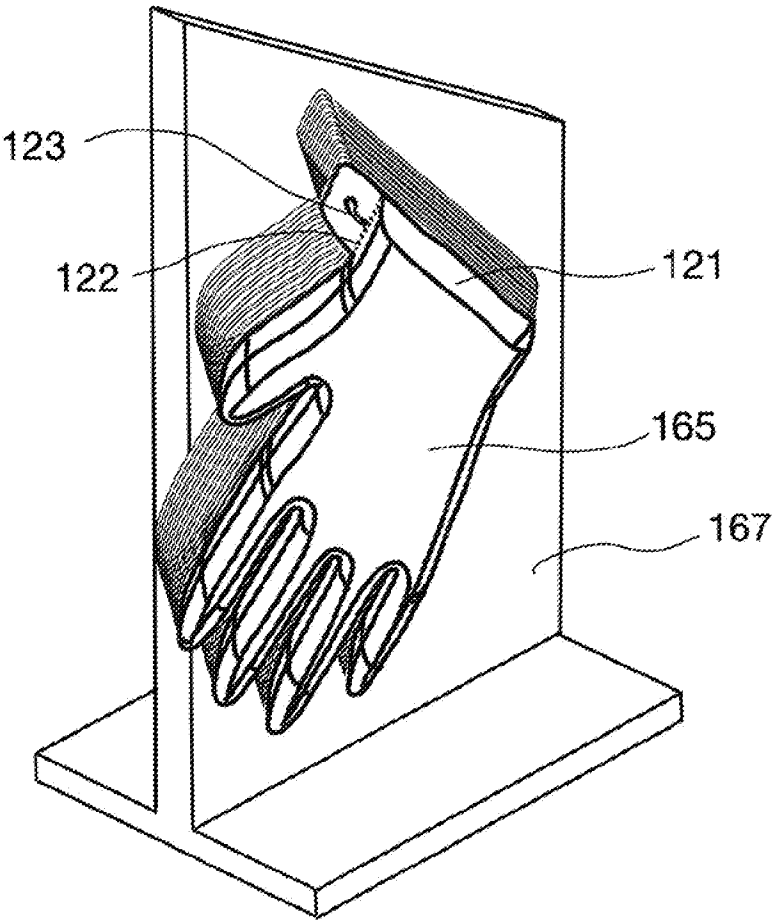
FIG. 31 is a perspective view of another alternate stack of gloves having formed geometry and mounting features on a dispenser in accordance with an embodiment.
Figure 32B:
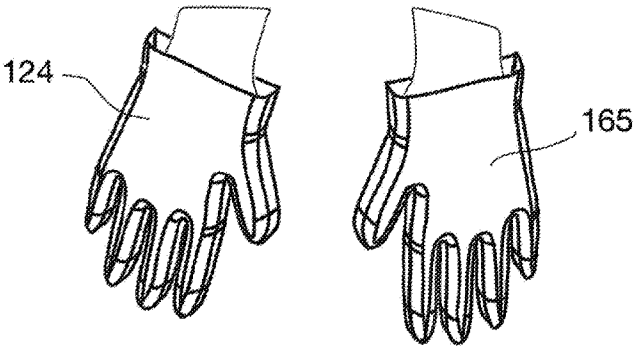
FIGS. 32A and 32B are perspective views of stacks of gloves having formed geometry and mounting features in use on a double sided dispenser in accordance with an embodiment.
Figure 32A:
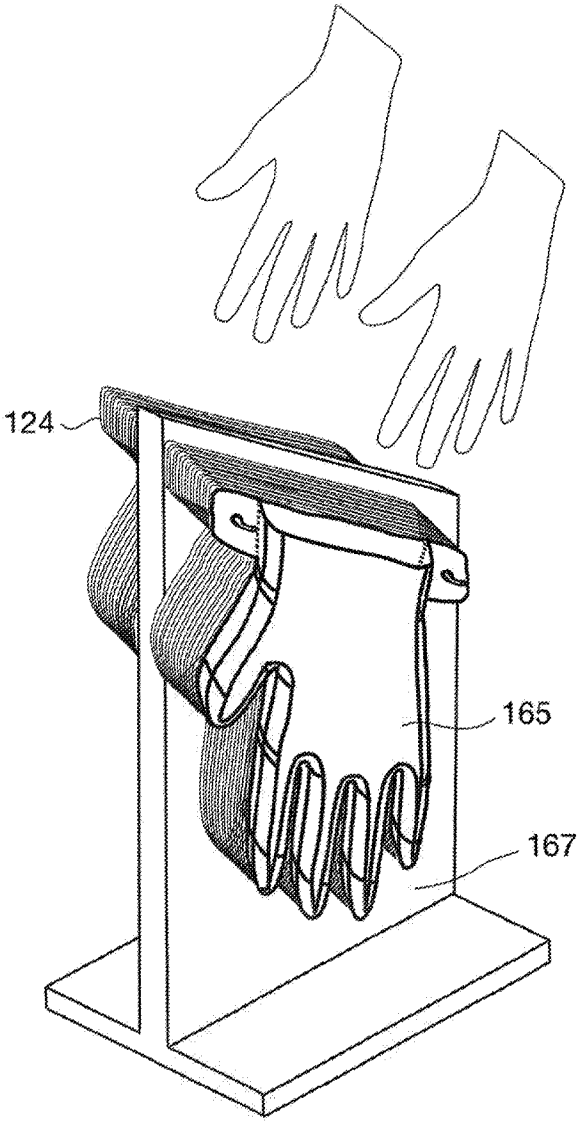

FIG. 30 illustrates a wicketed dispenser 167 where formed gloves 165 hang from the dispenser for donning and tear free at perforated or weakened material line 122 with side separation regions 138 remaining with the wicketed dispenser 167. FIG. 31 provides an alternate wicketed dispenser 167 where a single wicket post 123 is positioned close to a corner of glove opening 121 with a small perforated or weakened material line 122 for the formed glove 165 to tear free from. A double-sided wicketed dispenser 167 is shown in FIG. 32A where a user dons a formed glove 165 and an opposing hand formed glove 124 simultaneously. FIG. 32B shows the donned formed glove 165 and the opposing hand formed glove 124 from double-sided wicketed dispenser 167. In other embodiments of the present invention, a double-sided wicketed dispenser is implementable such as using the single-post dispenser method portrayed in FIG. 31. It should be understood to one of skill in the art that any of the glove types described herein or thereof including differential layer sized gloves, gloves with glove opening relief features or binding regions or side separation regions or glove mounting regions are usable with various donning methods such as having one or more wicketed posts or clips or mounting region holders or side separation region holders or other donning methods such as those methods discussed in FIGS. 18-32 or not discussed thereof or herein.

Figure 33B:
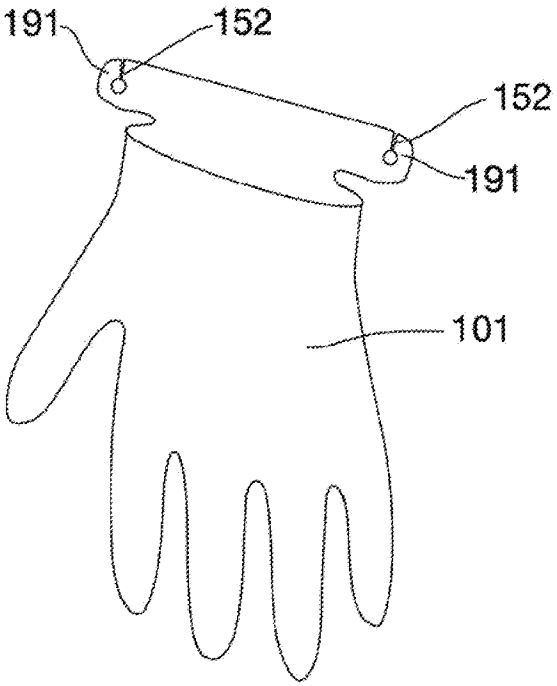
FIGS. 33A and 33B are perspective views of stacks of gloves having opening reliefs and mounting features in use on a double sided dispenser in accordance with an embodiment.
Figure 33A:
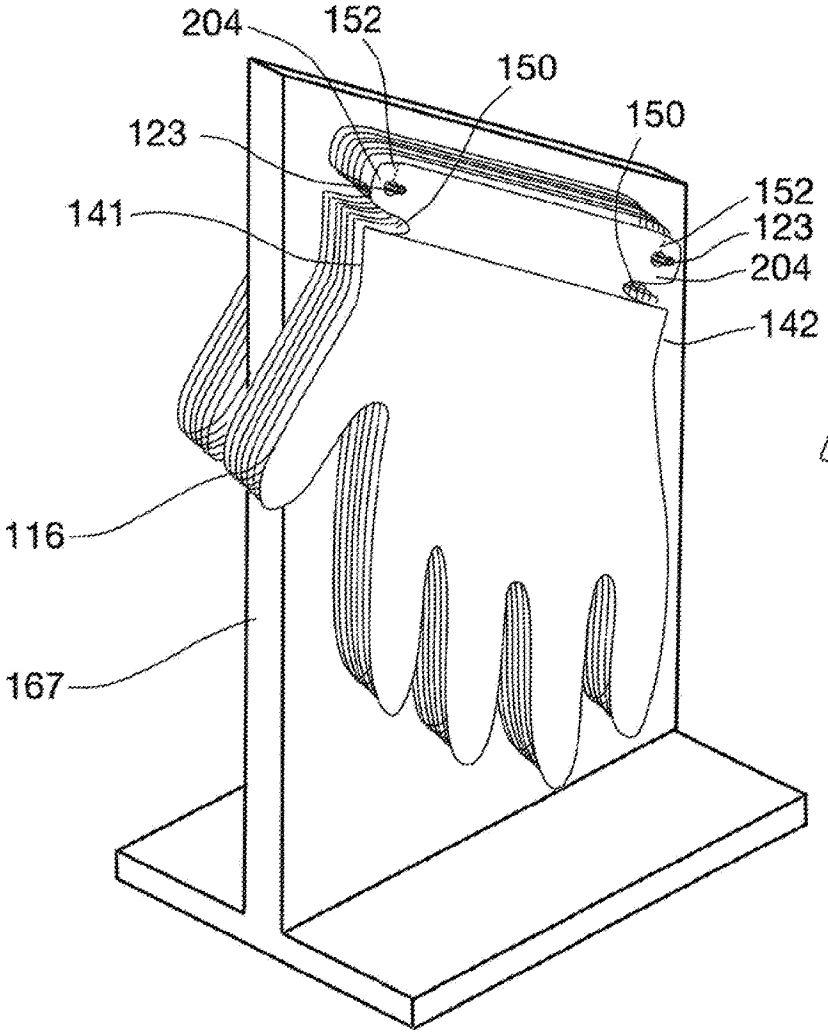

FIG. 33 shows an embodiment of the present invention featuring a double-sided wicketed dispenser 167 with a stack 116 of two-layer gloves 101 having slotted glove opening reliefs 150 and glove mounting features 204 inboard of the cuff side edges 141 and 142, when gloves are mounted and closed, where the glove mounting features 204 remain with the glove and the gloves are independent of one another. Removing two-layer glove 101 from stack 116 causes perforated or weakened separation tearing lines 152 to tear, separating two-layer glove 101 from wicketed dispenser 167. In accordance with embodiments of the present invention, said stack 116 can be lightly tethered together or can simply slide off the posts or tear through the gloves 101 or glove mounting features 204 without perforated or weakened separation tearing lines 152. In accordance with an embodiment of the present invention, one or more wicket posts 123 are designed to bend or move such that wicket posts 123 get closer together as a donning load is introduced allowing for a more opened and donnable glove and providing similar glove opening functionality as glove opening reliefs 150. In accordance with an embodiment of the present invention, one or more wicket posts 123 are designed to bend or move closer together for loading gloves or glove stacks onto a dispenser to make it easier to load or for holding the gloves tight on the stand or ensuring the gloves don't fall off or come off without intentionally removing them or removing them by donning or for some other reason. In accordance with another embodiment of the present invention, the dispenser 167 contains features to retain a glove or glove stack against a mounting face with a retention means such as vacuum, suction cups, adhesive or tacky surface, static, or some other means.

Figures 34A, 34B:
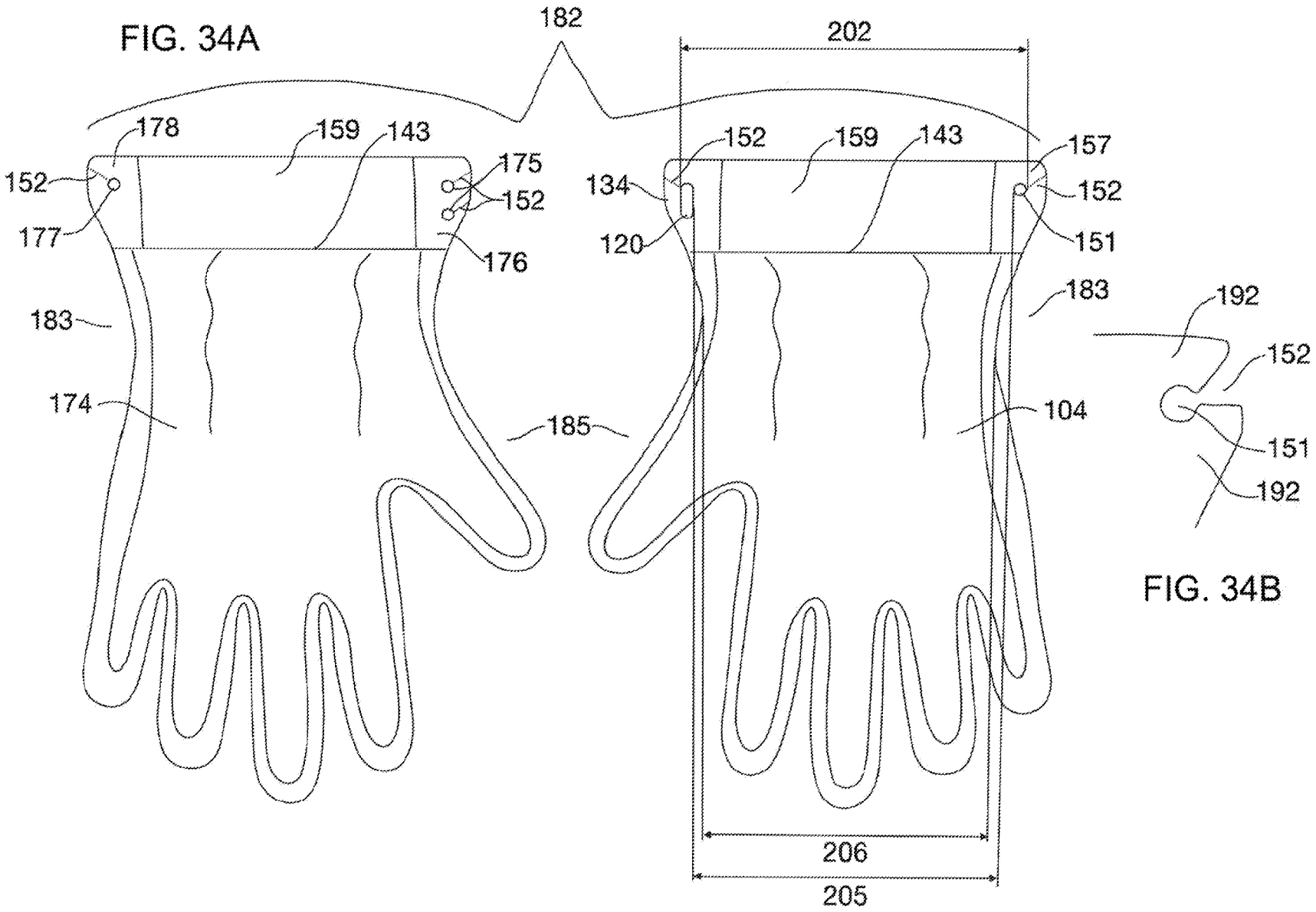
FIG. 34A and FIG. 34B depicts mounting feature configurations for disposable gloves in accordance with an embodiment.
Figure 35:
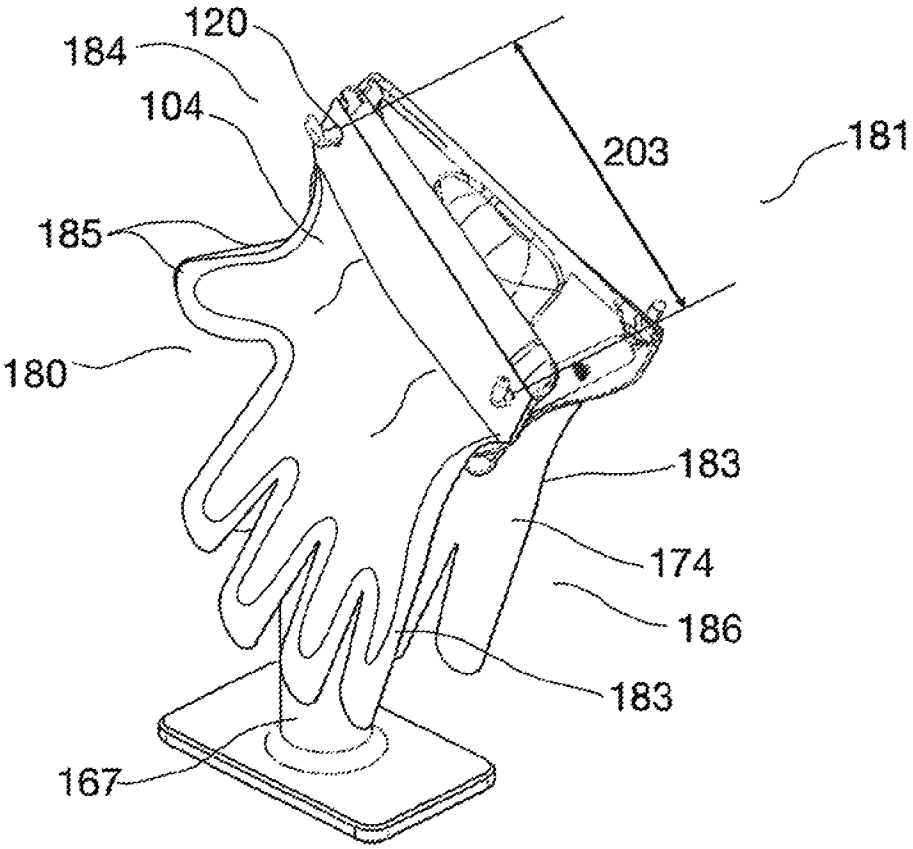
FIG. 35 is a perspective view of one or more disposable gloves mounted on an adjustable dispenser in accordance with an embodiment.

FIG. 34A illustrates the posterior sides of a glove set 182 in accordance with an embodiment of the present invention, where the mounting features are not symmetric on each side along the width of a glove and do not match between a left hand formed glove 104 and a right hand formed glove 174 such that corresponding mounts on a dispenser 167, as shown in FIG. 35, prevent or limit the possibility of a right hand formed glove 174 from being mounted on the left-handed side 180 of dispenser 167 and a left hand formed glove 104 from being mounted on the right-handed side 181 of a dispenser 167 and also prevent or limit a glove or glove stack from being mounted backwards such that the pinky side 183 of each glove is unable to be properly loaded on the dispenser thumb side 184 and the thumb side 185 of a glove is unable to be properly loaded on the dispenser pinky side 186. In accordance with an embodiment of the present invention, a dispenser 167 exists featuring non-matching mounting provisions for a left hand or right hand glove, or both right and left hand gloves to be mounted on a single dispenser such that gloves are able to be donned simultaneously. For example, a glove set 182 includes a left formed glove 104 having a slotted hole 120 on thumb side mounting features 134 and a pinky side hole 151 on the pinky side mounting features 157 and right hand gloves 174 having two right thumb side holes 175 on a thumb side mounting features 176 and a pinky side hole 177 on a pinky side mounting features 178 serving as non-symmetry between right and left gloves and between thumb side mounting features and pinky side mounting features for mounting onto dispenser 167. In accordance with embodiments of the present invention, a perforated or weakened separation tearing line 152 exists at one or more hole locations on a glove. In accordance with an embodiment of the present invention, the perforated or weakened separation tearing line 152 is angled or directed to tear toward the side edge of a mounting feature to reduce the resulting flap 191 of loose material on the glove, as shown in FIG. 33, by having two smaller flaps 192 on both sides of a perforated or weakened separation tearing line 152, as depicted in FIG. 34B, providing aesthetic benefits. In accordance with embodiments of the present invention, one or more gloves has one or more features to uniquely define it as a right or left glove such as an offset cuff, mounting features, formed features, differential cuff lengths or any other glove characteristic capable of differentiating it from an opposite glove as described thereof or herein.

Figure 36B:
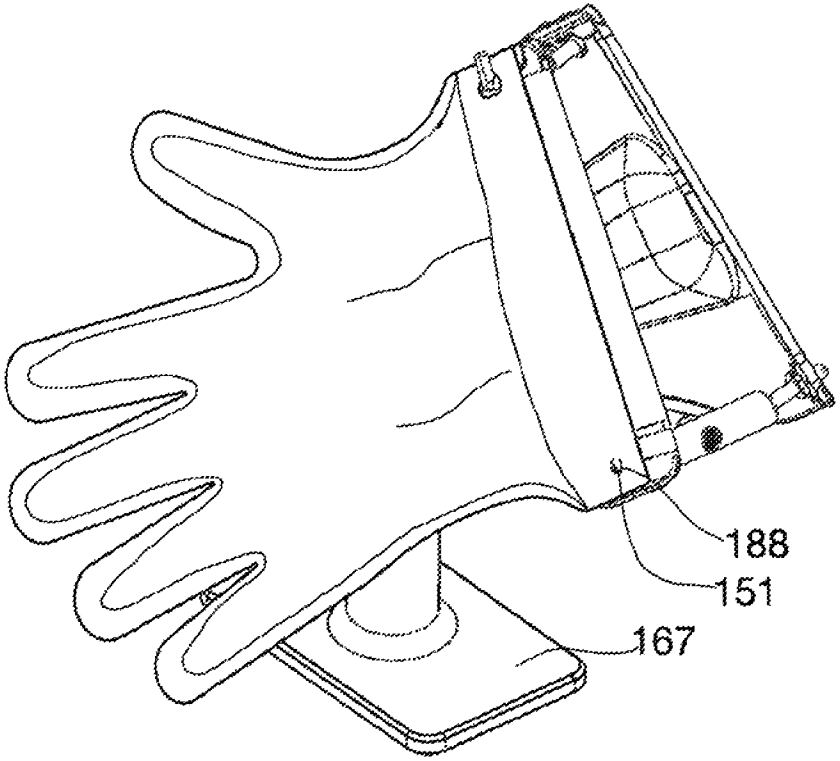
FIGS. 36A-36D are perspective views showing a disposable glove being mounted on both side of an adjustable dispenser in accordance with an embodiment.
Figure 36A:
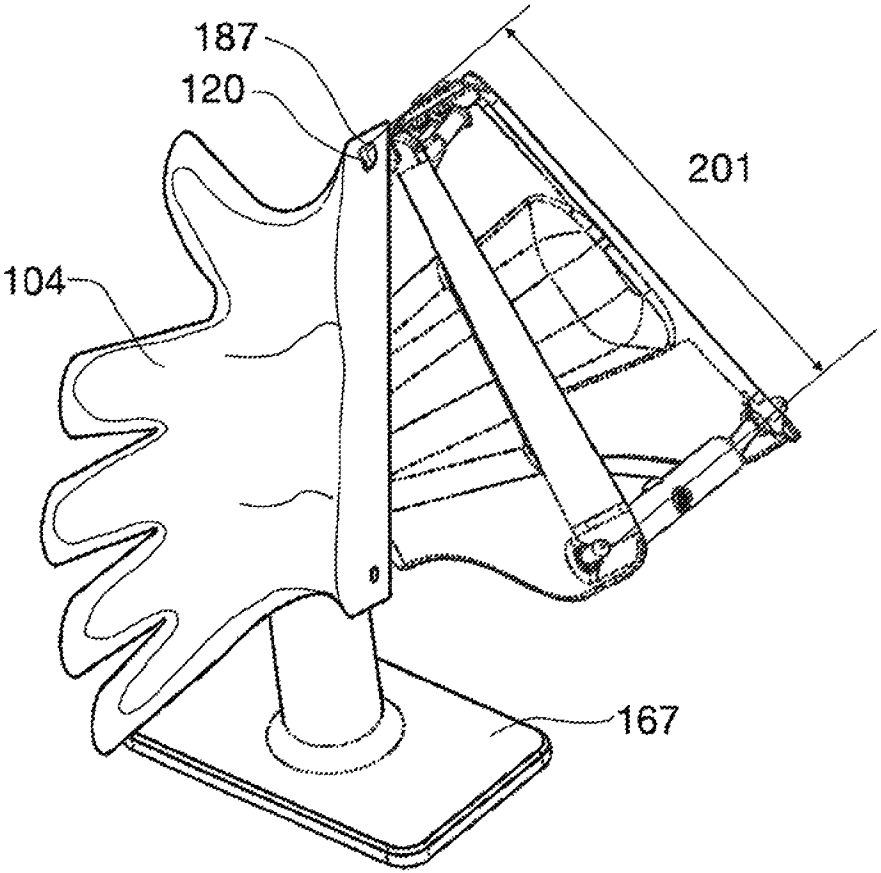
Figure 36D:
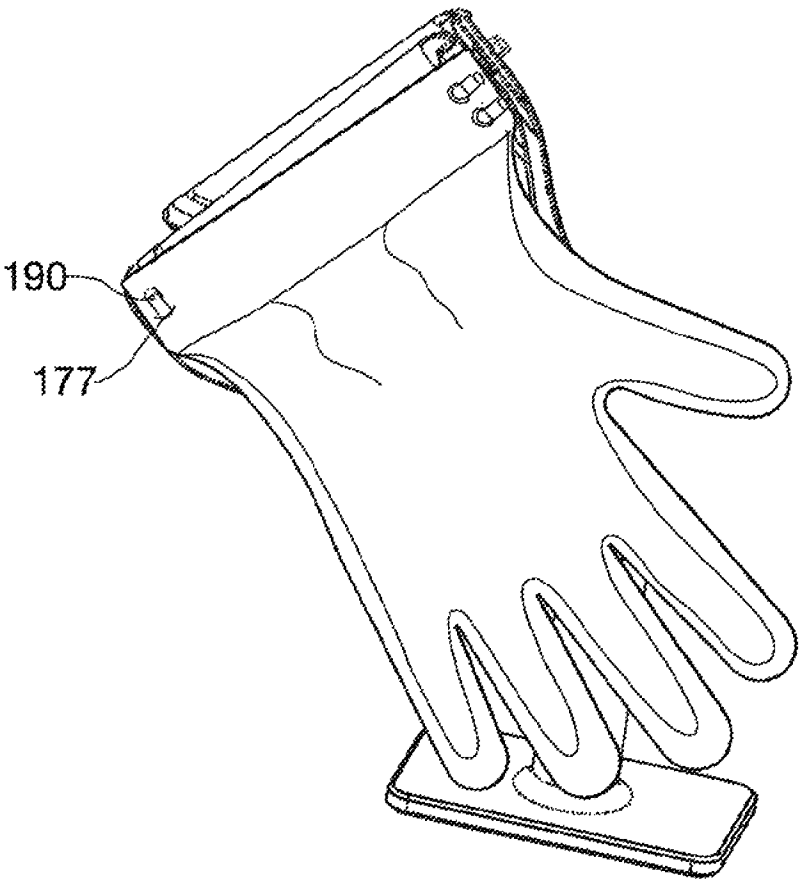
Figure 36C:
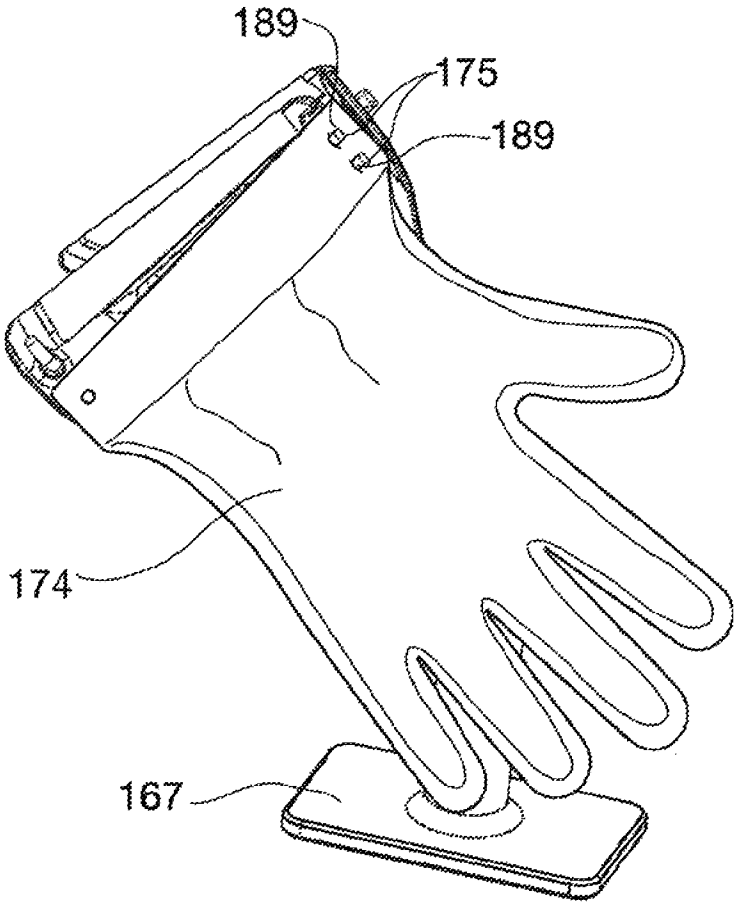

FIG. 35 illustrates left and right hand formed gloves 104 and 174 of FIG. 34A mounted on a dispenser 167. The thumb side slotted holes 120 of left hand formed gloves 104 are installed onto the elongated left thumb side mount, such as mounting hook 187 as shown in FIG. 36A followed by hooking the pinky side mounting hole 151 onto the corresponding left-handed pinky side hook mount 188 as in FIG. 36B. For mounting the right hand formed gloves 174 as shown in FIG. 36C and FIG. 36D, the right thumb side holes 175 are installed onto the right thumb mount, such as side mounting hooks 189 followed by hooking the right-handed pinky side hole 177 onto its corresponding right-handed pinky side hook mount 190. The identified mounts are intended to engage one more of glove slots and holes to ensure proper mounting and orientation on a dispenser where said mounts make it easy to identify correct installation location and orientation and also impede or make it difficult for a user to install gloves backwards or on the wrong side of a dispenser 167.

Figure 37B:
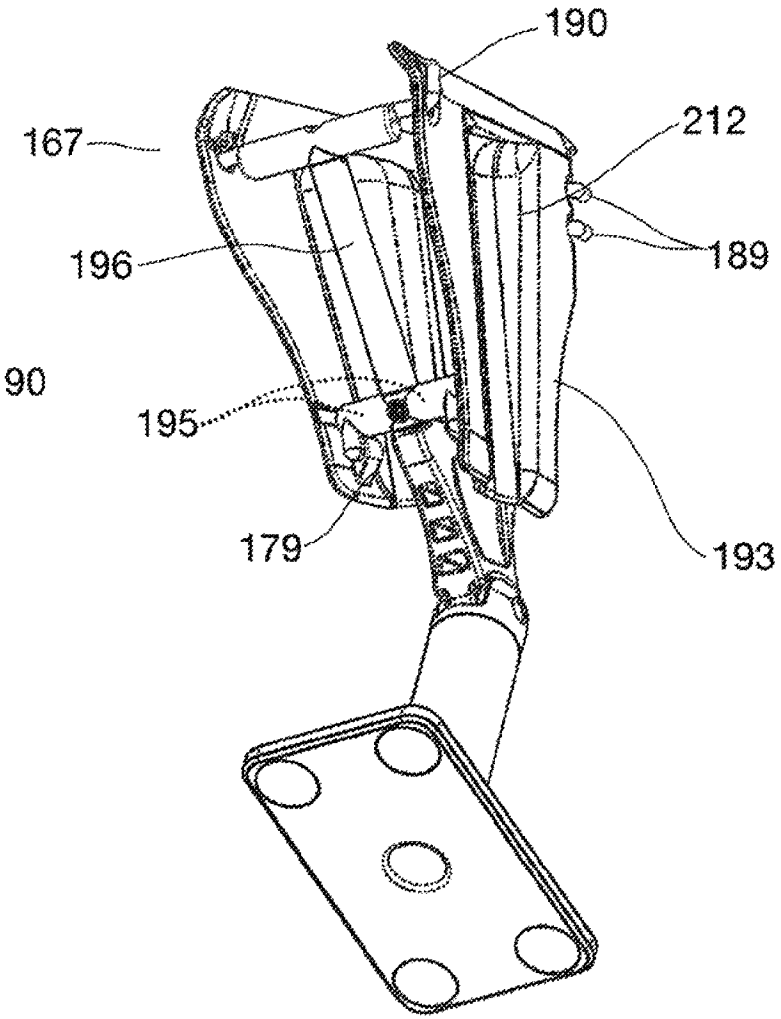
FIG. 37A and FIG. 37B are perspective views of an adjustable dispenser for disposable gloves in accordance with an embodiment.
Figure 37A:
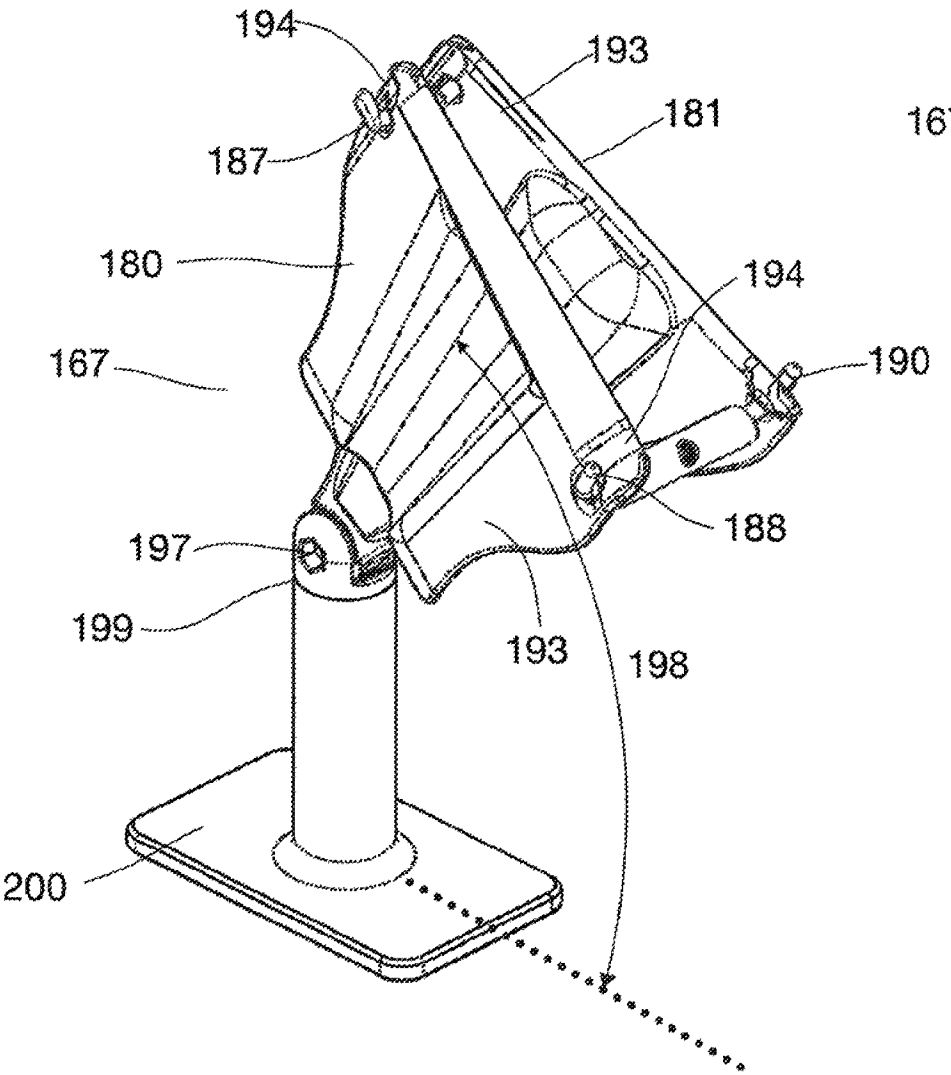

In accordance with an embodiment of the present invention, a dispenser 167 as shown in FIG. 37A and FIG. 37B is provided comprising a base 200, a frame 196 extending from base, and first and second mounting faces 193 with mounts such as mounting hooks or posts where the distance 201, of FIG. 36A, between the installation points of one or more sets of mounting hooks or posts is greater than the distance 202, of FIG. 34A, between the corresponding mounting holes or slots or provisions on one or more gloves or glove stacks as well as the distance 203, of FIG. 35, between the installed glove mounted positions of said set of mounts such that a one or more mounting hooks or posts needs to be removable or is able to move into a loading position to install one or more gloves or glove stacks or one or more gloves or glove stacks require being installed onto said posts in an order such that any remaining mounting hooks or posts with no gloves or glove stacks installed are still accessible for loading without having to stretch and potentially damage the one or more gloves or gloves stacks. Adding the described non-symmetric glove retention and installation means across the width of gloves limits a user's ability to install the gloves incorrectly and provides an increased level of retention where a glove or glove stack needs to be removed in a particular way as well, other than by donning or otherwise damaging or stressing the one or more gloves or glove stacks.

It should be understood by one of skill in the art that the number, location, shape, or size of the holes is able to be rearranged or reconfigured or changed and still achieve the intent of preventing or limiting the potential for gloves from being installed backwards, upside-down, or on the wrong side of a dispenser 167. For non-hand specific gloves, non-symmetric mounting provisions still ensure that the thumb side of a glove only mounts to the appropriate location and the pinky side of a glove to its corresponding location so that gloves are properly oriented for donning purposes.

As shown in FIG. 37A, mounts, such as mounting hooks can be oriented at different angles. The thumb side hooks 187 and 189 are oriented away from the pinky side hooks 188 and 190 to make it so a glove has to be installed on said thumb side hook or hooks first and is generally in a direction where gravity will hold it on the stand and is oriented in the direction of tension between the hooks and gloves won't come off of the thumb side hook without being torn off or first being removed from the pinky side hook and also encourages the user to install correctly and get the one or more gloves or glove stacks correctly installed on the thumb side hook or hooks first before installing onto the pinky side hook.

In accordance with other embodiment of the present invention, mounting hooks are oriented in alternate directions or mounting hooks or provisions are mounted in the same direction such as hooks oriented opposite of the donning direction such as the direction of pinky side hooks 188 and 190 of FIG. 37A. In accordance with other embodiments of the present invention, hooks are oriented in the same direction so that both sides of a glove have the ability to be loaded at the same time such as loading both sides straight onto posts or pins or hooked on from the donning side. In accordance with other embodiment of the present invention, low profile glove mounting pins such as pins with mushroom heads are used where the glove mounting holes are stretched over the heads so the gloves are mounted straight on or gloves are simply placed onto the pins and another glove retention means is used for holding the gloves onto a dispenser. In accordance with an embodiment of the present invention, a dispenser 167 features stationary mount hooks, posts, or pins where the distance between the tips of the mounts is greater than the distance between the mounting holes on a glove or glove stack as well as the installed mounting positions on the dispenser when said dispenser is in a configuration for donning where one specific side of a glove must be mounted on first in order to mount the other side of a glove.

In accordance with other embodiments of the present invention, hooks are pulled or deflected towards each other in order to mount gloves and ensure they remain retained on the dispenser 167. In accordance with other embodiments of the present invention, hooks rotate, such as being manually rotated or rotationally spring loaded so that one or more hooks is rotated while loading and returns or is returned to a position that ensures retention of the gloves or glove stacks.

In accordance with other embodiments of the present invention, a dispenser 167 features a movable mechanism such that a glove or stack of gloves is biased toward the end of protruding mounts to minimize interference in the donning path. In accordance with an embodiment of the present invention, a force is applied to one or more mounting faces 193 or other mechanisms, such as with one or more springs or spring-like mechanisms or gravity acting on the mounting faces, to maintain a force on a glove or glove stack to force the gloves toward the end of the mounts, such as holding pins or hooks or glove or glove stack retention means. Forcing a glove or glove stack to the end of the mounts minimizes or eliminates interferences in the path of a users' hand for donning that could injure, catch or otherwise impede the user. Watch bands, bracelets, or the cuff of a shirt or the like are additional articles that are apt to get caught on protrusions from the donning stand that are in close proximity to the donning path. In accordance with an embodiment of the present invention, spring-loaded mounting faces 193 also feature grooves 194 for the angled hooks to reside when no gloves are present or to force the gloves to deflect into grooves 194 residing between each hook and mounting faces 193 such that hooks are close to or below the top surface of a top glove on dispenser 167 as identified in FIG. 37A and FIG. 37B.

Spring loaded mounting faces 193 further feature angled surfaces at the hook location such that placing a hole of a glove stack over a hook and pushing or pulling the glove or glove stack further onto the hook causes the mounting face to deflect away from the end of the hook such that the gloves are easily loaded. In accordance with an embodiment of the present invention, a mounting face 193 is manually deflected by the user when loading a glove or glove stack. In accordance with an embodiment of the present invention, mounting face 193 features a spring such as compression spring 195 located within frame 196 although torsion springs or tension springs or some other spring load or force, such as gravity, are also practicable. In accordance with another embodiment of the present invention, mounting face 193 pivots in relation to frame 196 at pivot locations 179 to provide angular deflection at the hook locations where the gloves are mounted although fully spring-loading and retaining the mounting faces without pivots or retaining the mounting faces 193 by some other means or having an alternate mechanism other than mounting faces such as individual hooks with localized loading mechanisms or simply a frame 196 with hooks or mounting pins serve as the moveable mechanism to pull a glove or glove stack toward the mounting face of the dispenser such as having the pins or hooks spring-loaded or moveable by some other means is also practicable.

In accordance with an embodiment of the present invention, the mounting face 193 of dispenser 167 features a depression or open area 212 to allow the anterior layer of a glove to be pushed in to aid in separation of anterior and posterior layers and create a glove opening to enhance donnability as shown in FIG. 37B. In accordance with another embodiment of the present invention, mounting face 193 of dispenser 167 is curved such that when the posterior layer of the glove is pulled away from the anterior layer, which remains the same shape as the curve of the dispenser, a larger glove cuff opening is formed in comparison to a flat mounting face.

In accordance with an embodiment of the present invention, a dispenser 167 is angularly adjustable with dispenser pivot 197 in order to change the donning angle 198 as shown in FIG. 37A and FIG. 37B and provide an ergonomically correct donning angle based on the dispenser mount height and the height of a user. In accordance with an embodiment of the present invention, dispenser pivot 197 provides resistance such that excess force is used to change the position of the dispenser 167 or the dispenser pivot 197 is set to a position and locked or requires pressing or pulling a release for adjusting the donning angle 198 or any other means for providing angular locking or position adjustment or resistance adjustment.

Figure 38C:
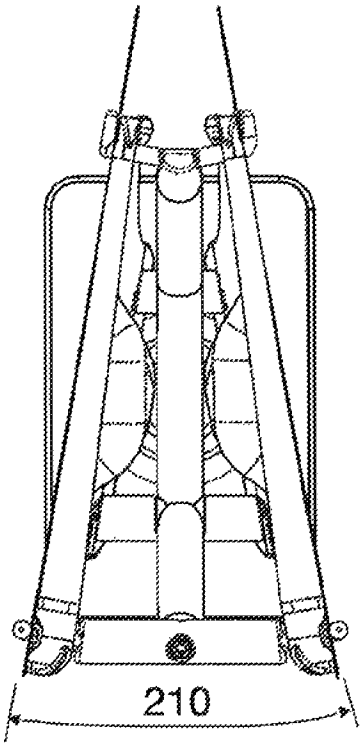
FIG. 38A, FIG. 38B, and FIG. 38C depict donning and support angles for the adjustable dispenser for disposable gloves in accordance with an embodiment.
Figure 38B:
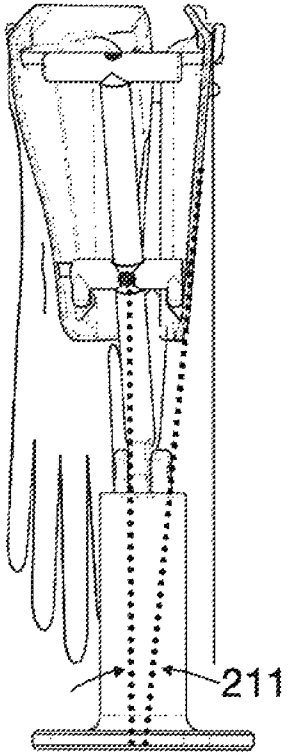
Figure 38A:
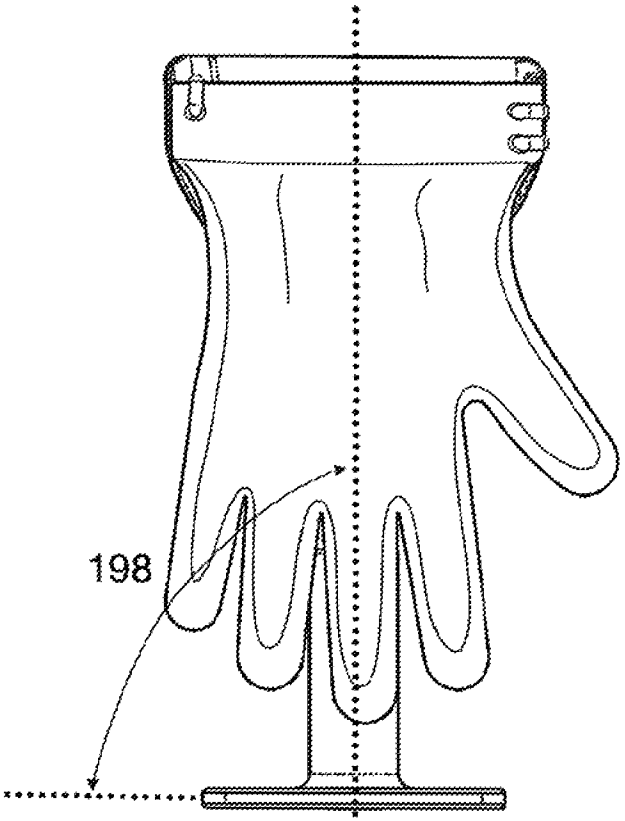

In accordance with another embodiment of the present invention, FIG. 38A-38C show a dispenser 167 with an adjustable donning angle 198 that is in the 90-degree (vertical) donning position. In accordance with an embodiment of the present invention, dispenser 167 is configured with an angular splay 210 of 5-degrees to 150-degrees between the faces of a left hand and a right hand glove or glove stack such that the cuff opening edges are not parallel to one another and the thumb side of a left and right glove are closer together than a pinky side of a left and right glove, as shown in FIG. 38C, where the position of a left glove for a user's left hand is in an equivalent position to a right glove positioned for a user's right hand with a user standing in a centered location in front of said dispenser. In accordance with an embodiment of the present invention, said angular splay 210 providing an ergonomic donning position or a balance between an ergonomically optimal donning position and the size or cost or other attribute or combination of attributes of dispenser 167 for a user to don both a left and a right glove simultaneously. In accordance with another embodiment of the present invention, the faces of the left and right gloves on a dispenser are parallel to each other. In accordance with another embodiment of the present invention, the cuff opening edges of left and right gloves on a dispenser are parallel to each other.

Figure 39B:
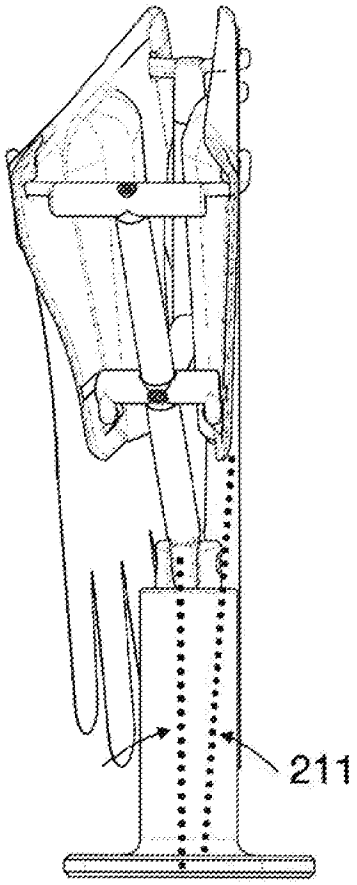
FIG. 39A and FIG. 39B depict alternate donning and support angles for the adjustable dispenser for disposable gloves in accordance with an embodiment.
Figure 39A:
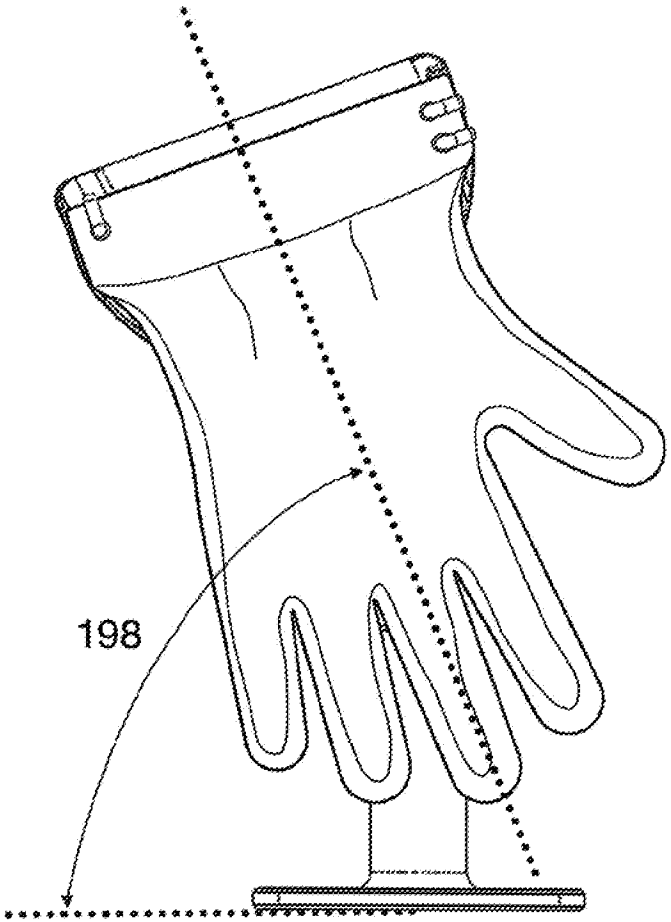
Figure 40B:
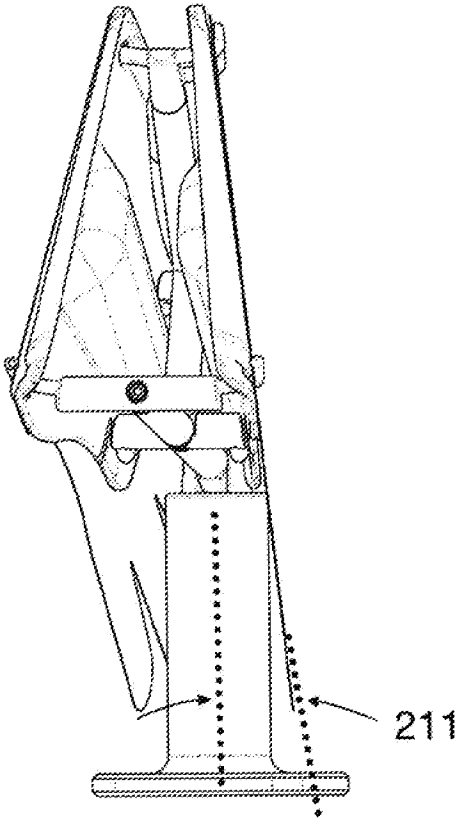
FIG. 40A and FIG. 40B depict additional alternate donning and support mounting angles for the adjustable dispenser for disposable gloves in accordance with an embodiment.
Figure 40A:
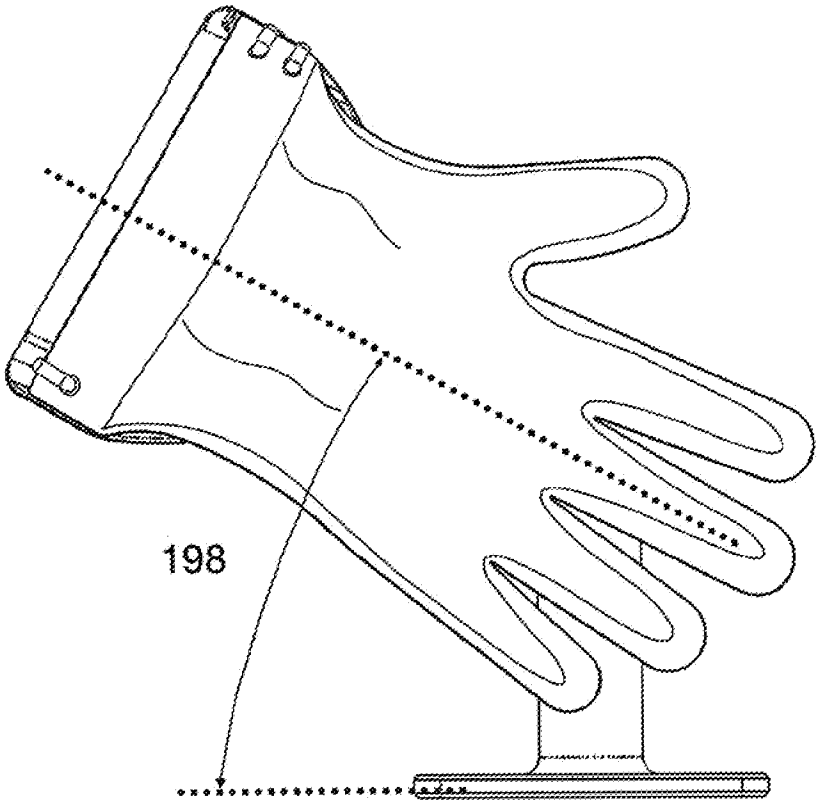

In accordance with another embodiment of the present invention, said angular splay 210 further providing a glove or glove stack support benefit where angularly adjusting the dispenser 167 or the position of the dispenser 167 to change the donning angle 198 relative to the direction of gravitational effects on a glove or glove stack, as shown by a 70-degree donning angle in FIG. 39A and FIG. 39B and a 30-degree donning angle in FIG. 40A and FIG. 40B, results in a range where the dispenser support angle 211 increases such that gloves are increasingly supported by the dispenser 167 at decreased donning angles or over a range of decreased donning angles. As shown in FIG. 38B and FIG. 39B, the support angle 211 is negative and the glove or gloves or glove stack or glove stacks are able to simply hang from the dispenser 167. FIG. 40B shows a positive support angle 211 where the decreased donning angle of 30-degrees, as indicated in FIG. 40A, causes mounting face 167 to provide an angled supporting surface for the glove, gloves, glove stack or glove stacks to rest on and help maintain shape. At high donning angles such as at 90-degrees, angular support is generally not needed as a glove or glove stack or gloves or glove stacks simply hang down from a dispenser from mounting locations at or around the cuff region that are positioned higher than other areas of the glove that are prone to fold or flop over at lower donning angles.

In accordance with an embodiment of the present invention, forming of a layered glove or gloves and compressing of said glove or gloves such that the non-planar shape of flattened gloves provides structure, increasing the rigidity and the ability to hold shape at extreme donning angles such that gloves that are 3 mils thick or less are able to maintain their shape when the donning angle 198 of a glove opening or cuff edges that are generally perpendicular to the donning direction are positioned at angles less than 70-degrees without having to tether or hold other locations of the glove away from the cuff region such as at the fingers or palm area to prevent a glove or glove stack from flopping over on itself making it difficult to don and is also messy and visually unpleasant. In accordance with another embodiment of the present invention, tethering or otherwise holding or constraining gloves at the fingers or palm or other regions of the glove to maintain the shape or structure of the gloves is practicable. Additionally, in accordance with some embodiments of the present invention, compressing and elastically deforming a stack of formed gloves produces non-planar layers of gloves resulting in additional structure and an interlacing effect to further promote the ability of a glove stack to maintain its shape and structure for glove mounting angles reliant on the glove and stack structure to maintain a shape.

In accordance with embodiments of the present invention, angling the face of the glove stack from a vertical position, such as increasing the support angle to angles such as 5 to 90-degrees from vertical to create a resting surface for the gloves additionally aides in the ability of the gloves to maintain a donnable shape when in a position that would otherwise subject the gloves to kinking or folding. Conventional glove donning setups are oriented for vertical donning or flat donning or have finger tethering features. Besides relying on the formed structure to hold the shape of a glove when the glove is mounted on an angle that makes a glove or glove stack prone to bending or flopping over, in accordance to some embodiments of the present invention, material additives or increased layer or location thicknesses to increase strength or structure are incorporated. In accordance with an embodiment of the present invention, formed ribs or features to further improve glove donning or holding the glove structure for angled donning configurations such as forming features for particular mounted angles or incorporating any of the other embodiments described thereof or herein also provide for holding the structure of a glove for angled donning. Formed features such as ribs positioned generally vertical along a glove surface with respect to the glove as it is positioned on an angled donning setup is also practicable. In accordance with an embodiment of the present invention, curving the stack or having curved geometry on the donning stand provides an additional means for promoting structure to hold gloves from folding out or flopping over by generating additional structure. In accordance with one embodiment of the present invention, formed gloves have sufficient enough structure such that a dispenser has mounting provisions for gloves where said gloves are able to hold their shape regardless of the orientation of the gloves whether they lie flat, sideways, upside-down, vertically or at any other orientation and a glove dispenser contains mounting provisions to mount said gloves on a vertical surface or horizontal surface or at any angles therebetween.

In accordance with an embodiment of the present invention, dispenser 167 features a swivel 199 for rotating the dispenser side-to-side relative to a mounted base 200 as shown in FIG. 37A and FIG. 37B. In accordance with an embodiment of the present invention, swivel 199 provides resistance such that excess force is used to change the rotational position of the dispenser 167 or swivel 199 is set to a position and locked or requires pressing or pulling a release for adjusting the swivel position or any other means for providing rotational locking or position adjustment or resistance adjustment.

In accordance with another embodiment of the present invention, a dispenser 167 is not mounted and is able to sit on a table top or counter or the like. In accordance with other embodiments of the present invention dispenser 167 has a heavy or large base 200 to resist moving as a user loads gloves or dons gloves or changes the angle or rotation or the like. In accordance with other embodiments of the present invention, dispenser is mounted with screws, bolts, magnets, adhesives, glue, suction cups, or other retention means or any combination of retention means. In accordance with an embodiment of the present invention, the dispenser 167 is wall mountable or mountable on other surfaces at other orientations.

Figure 41:
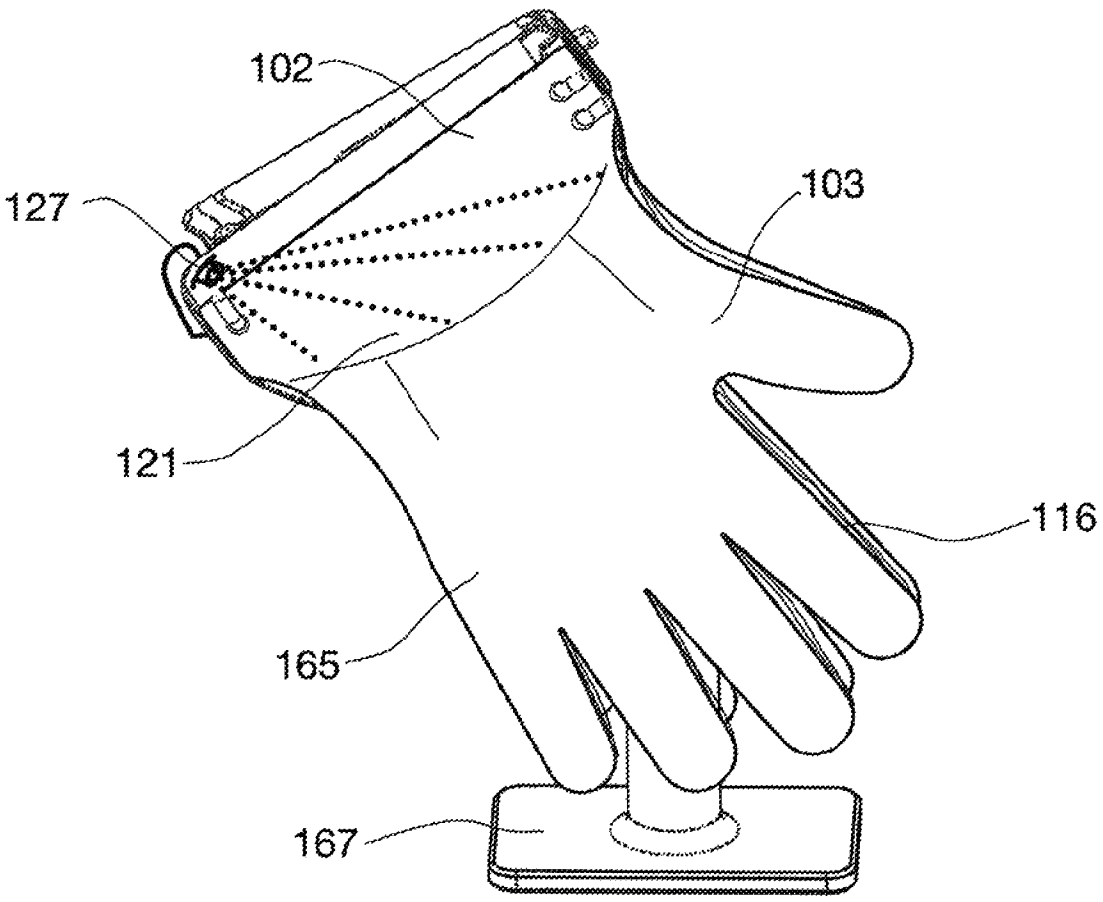
FIG. 41 depicts an air jet feature for assisting in opening disposable gloves mounted on an adjustable dispenser in accordance with an embodiment.

In accordance with an embodiment of the present invention, an air assist device is incorporated into a dispenser 167 as in FIG. 41 that is directed towards the glove opening location of a topmost glove 165 of a glove stack 116 such that activation of said air assist device causes air to flow through air flow nozzle 127 causing film layer 102 and 103 to separate as the formed glove 165 is effectively reformed or partially reformed to its natural formed shape and creating an accessible glove opening 121. In accordance with an embodiment of the present invention, an air flow nozzle is integral and built into one or more mounting features such as hooks or pins where the proximity of a hook or pin and the positional consistency of a hook or pin relative to a glove where said glove is pushed towards the end of said hooks or pins by way of a spring loaded mounting face or other dispenser mechanism and providing a means for consistently directing air at a glove opening location without the need for another dispenser appendage or other air delivery means. In accordance with another embodiment of the present invention, triggers for an air assist device include proximity sensors or other sensors that activate just prior to a user attempting to don a glove or a manual button or sensor that the user activates to separate the posterior and anterior layer and open the glove or a glove is simply opened after a prior glove is donned such that the glove is ready prior to a user attempting to don a next glove. In accordance with an embodiment of the present invention, said air assist device produces air mechanically and is activated by the user such as with a bellows or is electro-mechanical in nature and is run by batteries or connected by a power cord or an alternate powering means to produce air by a fan or pump or the like or said air is supplied from a pressurized canister or pneumatic system or some other means. In accordance with an embodiment of the present invention, said air assist mechanism is active to re-open a subsequent glove after a prior glove is donned, is active to open and hold a glove open as a user dons a glove, or is continuously active or intermittently active for any other reason or duration to provide a donnable glove or gloves.

Figure 42:
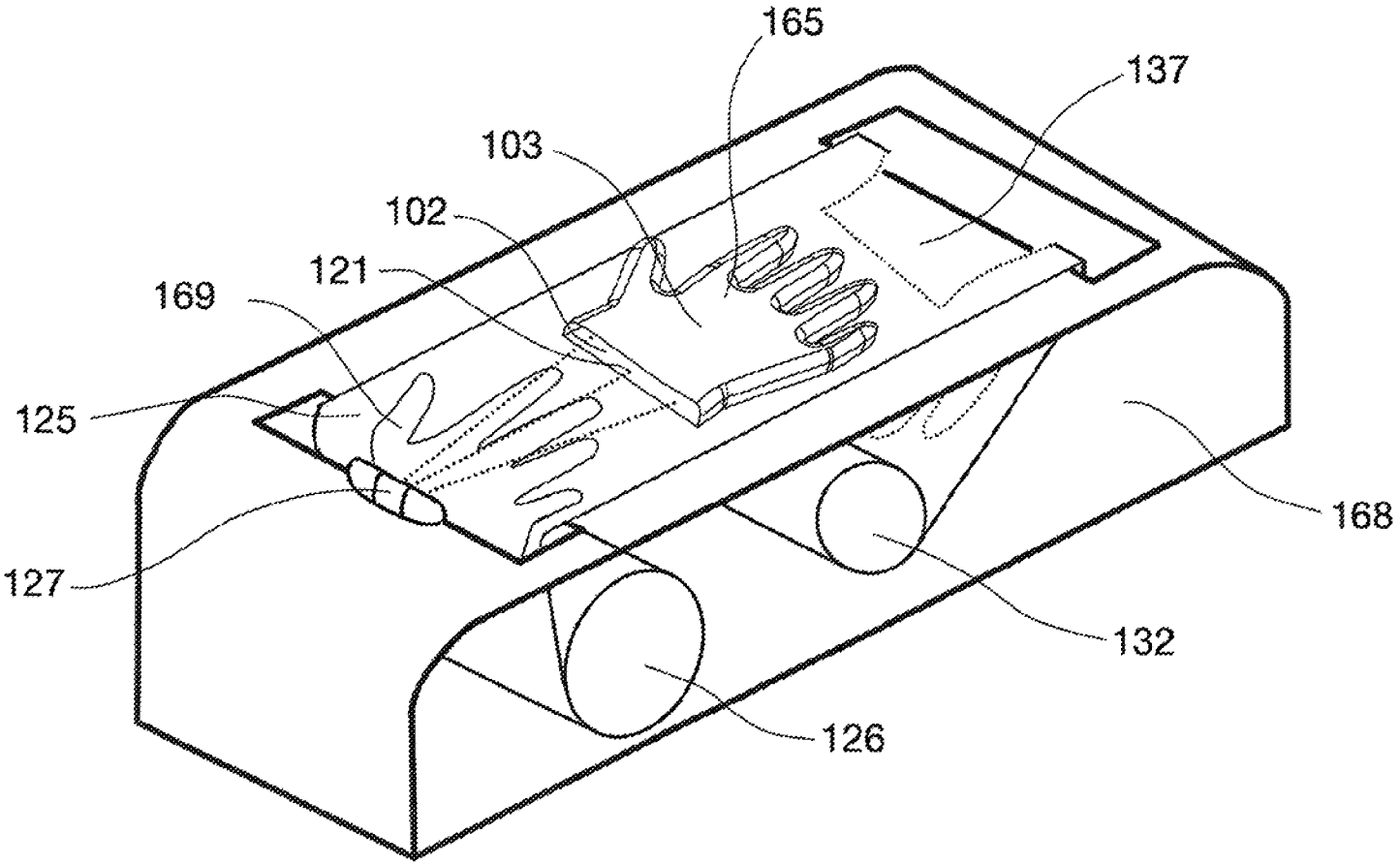
FIG. 42 is a perspective view of a belt style glove dispenser in accordance with an embodiment.

An automated donning apparatus 168, such as the one shown in FIG. 42, is employed for formed gloves 165 in a web 125 that unspools from glove roll 126, although web material in a box or by some other means besides glove roll 126 is used to feed web 125 in accordance with an embodiment of the present invention. In accordance with an embodiment of the present invention, the perimeter of the gloves remains separably attached to one or more material layers from which it was manufactured such that a roll of gloves or gloves otherwise organized to supply a number of gloves as a single unit are available for donning. After a user dons a formed glove 165, the automated donning apparatus 168 rewinds or collects the web 125, with a glove removed leaving open area 137, feeding into material take up roll 132 while unspooling glove roll 126 to move a next formed glove 169 into position for donning. In accordance with one embodiment of the present invention, the automated donning apparatus 168 actively separates film layers 102 and 103 to produce glove opening 121 by mechanisms or electromechanical means previously mentioned, such as opening it or reforming it or partially reforming it to its natural formed shape with air flow using air flow nozzle 127 directed at the glove opening 121. In accordance with one embodiment of the present invention, simply unwinding the roll or strategically varying the tension on web 125 is sufficient to splay film layers 102 and 103 to create glove opening 121. Said glove roll 126 can feature any of the glove types described herein or thereof including differential layer sized gloves, formed gloves, and gloves with glove opening relief features.

Figure 43:
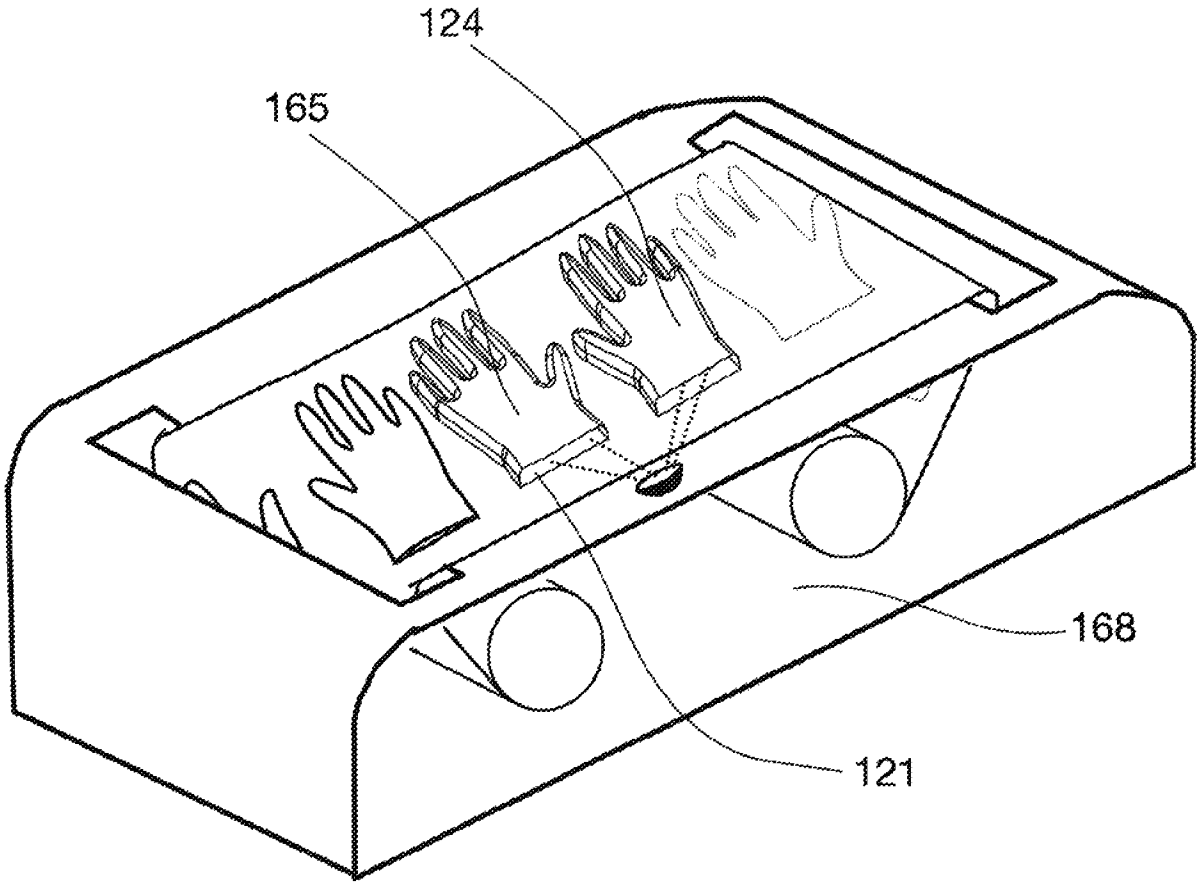
FIG. 43 is a perspective view of an alternate belt style glove dispenser in accordance with an embodiment.

FIG. 43 presents an alternate automated donning apparatus 168 where formed gloves 165 and opposing hand formed gloves 124 are positioned in the transverse web direction in accordance with an embodiment of the present invention. In accordance with another embodiment of the present invention, glove openings 121 alternate from side-to-side or end-to-end or at any angles therebetween. Glove orientations and positioning can be adjusted or offset as desired to reduce material waste or for the convenience of donning or for other reasons not mentioned as would be appreciated by those of skill in the art.

In accordance with an embodiment of the present invention, a dispenser is equipped with a reminder alert such as a light or alarm if the donning stand has been unused for a period of time. In accordance with another embodiment of the present invention, the dispenser has recognition technology such as voice or facial recognition or RFID bracelets worn by the user or the like such that the dispenser alerts individuals to change their gloves if they have not changed them for a period of time or if moving between particular activities or alert to change gloves or load more glove or the like.

Figure 44:
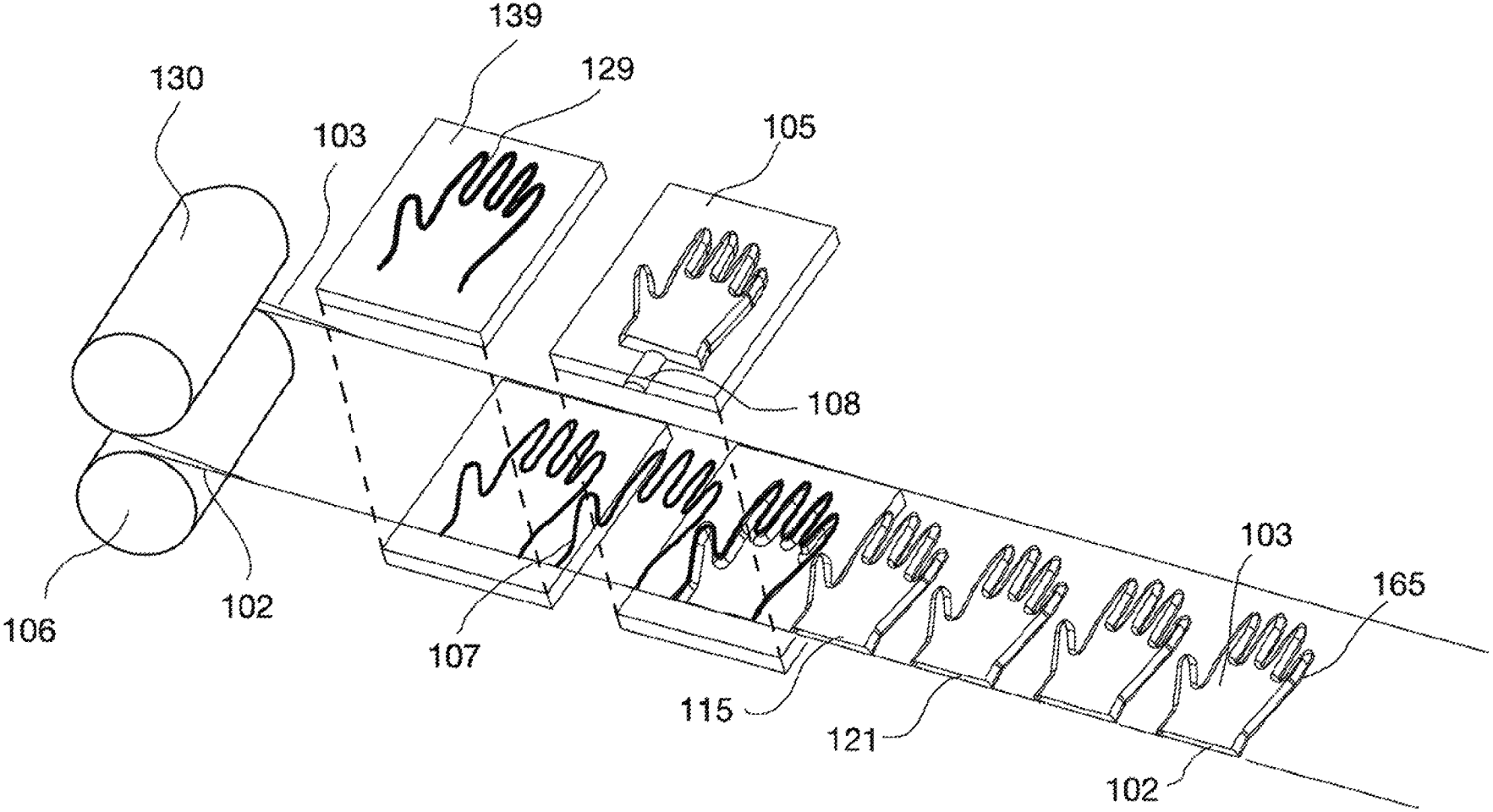
FIG. 44 depicts a fabrication process for making disposable gloves in accordance with an embodiment.

FIG. 44 illustrates a means of manufacturing formed gloves 165 where a cavity or form 105 is used to extrude the three-dimensional geometry of the formed glove 165 in one or more of the layers of film layer 102 and film layer 103 in accordance with yet another embodiment of the present invention.

A perimeter sealer 129 on sealer block 139 is used to create the sealed profiles 107 as film layer 102 and film layer 103 unspool from film roll 106 and film roll 130 respectively. In accordance with another embodiment of the present invention, a single roll of two-ply film material is used in place of film roll 106 and film roll 130. A roll of folded film to form two-ply is also practicable. In accordance with an embodiment of the presentment invention, each film layer is generally between 0.5 and 3 mils thick although thicker and thinner glove material layers are also practicable. In accordance with an embodiment of the present invention, said material layers are composed of a thermoplastic material such as PLA or polyethylene.

The sealed profiles 107 are achieved by any thermal bonding, ultrasonic welding, or some other fusing or binding operation to define and seal the contour of the glove. The order of operation for fusing the layers, forming the geometry, and cutting or perforating the profile can be re-ordered, combined, or altered as needed. Slit lines, perforations, creases, weakened material, less material or some other method for promoting separation can also be incorporated at any points about the perimeter, in between the fingers, at the glove opening or at any other locations not mentioned.

In accordance with one embodiment of the present invention, the formed glove 165 is produced with the glove opening at the edge of the film layer 102 and film layer 103 as shown in FIG. 44 or it is positioned in-board of the film edge and either cuff 115 is cut or slit open or the material not sealed to create glove opening 121. In accordance with one embodiment of the present invention, the edge of one or more film layers is offset from the edge to assist in creating the glove opening 121 or for some other reason such as donning or packaging.

In accordance with one embodiment of the present invention, to create the three-dimensional geometry of a formed glove 165, one or more film layers is positioned on or in the cavity or form 105, resembling a hand typically with heat involved in the form, on the web, or on a film roll and also with a load applied to the film such as pneumatically pushed or pulled, such as with vacuum or pressure, with a mechanical load, or other known methods or any combination of methods mentioned or not mentioned. In accordance with one embodiment of the present invention, the posterior layer is mechanically or pneumatically pushed or pulled, such as with a vacuum, into a mold resembling a hand shape and in accordance with another embodiment of the present invention, the anterior layer is mechanically or pneumatically pushed or pulled, such as with a vacuum, into a mold resembling a hand shape. Forming with film in a hot or molten state generally eases the forming operation and assists with minimizing thickness variability within one or more material layers or is used to create thickness variability within one or more material layers if desired. In accordance with an embodiment of the present invention, gloves are cold-formed at ambient temperatures without the presence of heat or formed with low levels of heat. To form and seal film layer 103 of formed glove 165 without forming film layer 102, a means to allow air to enter the space between the two film layers 102 and 103 is needed such as air inlet 108. As the forming operation takes place, film layer 103 is formed while film layer 102 remains flat. In accordance with an embodiment of the present invention, layers of a two layer glove are sealed together while still in a cavity or on a form. In accordance with one embodiment of the present invention, the formed glove 165 is cut during the sealing operation using a cut seal device around the perimeter of a formed glove 165 to remove it from the web or formed glove 165 is removed in a subsequent step.

In accordance with one embodiment of the present invention for a glove forming operation, a material thickness reduction occurs as the material stretches to a formed shape and thicker gauge material is used to accommodate the forming operation.

Figure 45:
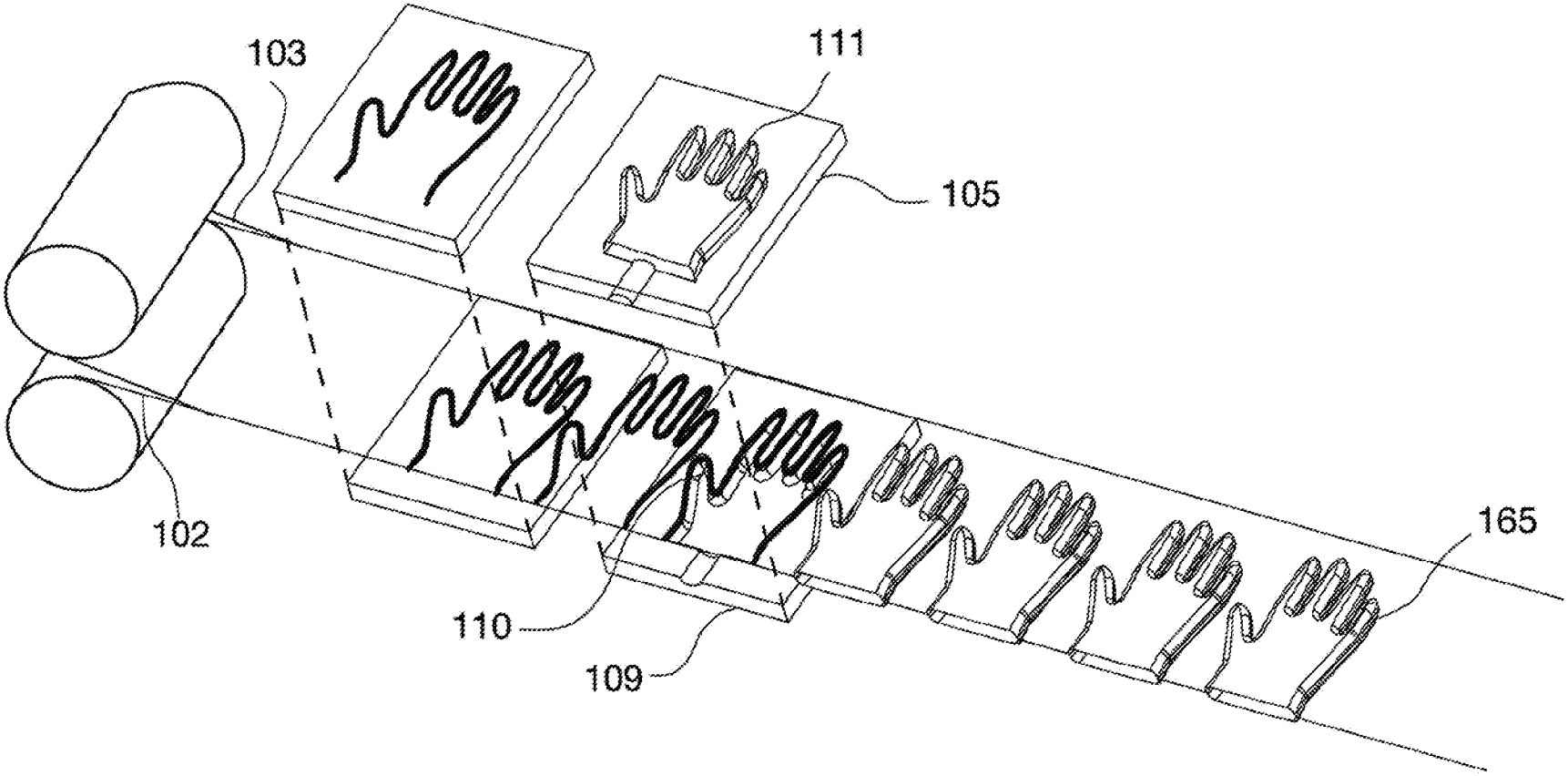
FIG. 45 depicts an alternate fabrication process for making disposable gloves in accordance with an embodiment.

In accordance with an embodiment of the present invention, FIG. 45 defines a means of manufacturing where the formed glove 165 is created by forming both film layer 103 and film layer 102 using cavity or form 105 and opposing cavity or form 109 respectively. Opposing cavity or form 109 and cavity or form 105 have mirrored geometry or different geometry such as having a deeper thumb 110 region in the opposing cavity or form 109 and a deeper fingers 111 region defined in cavity or form 105 to more appropriately match the non-planar shape of a person's hand.

Figure 46:
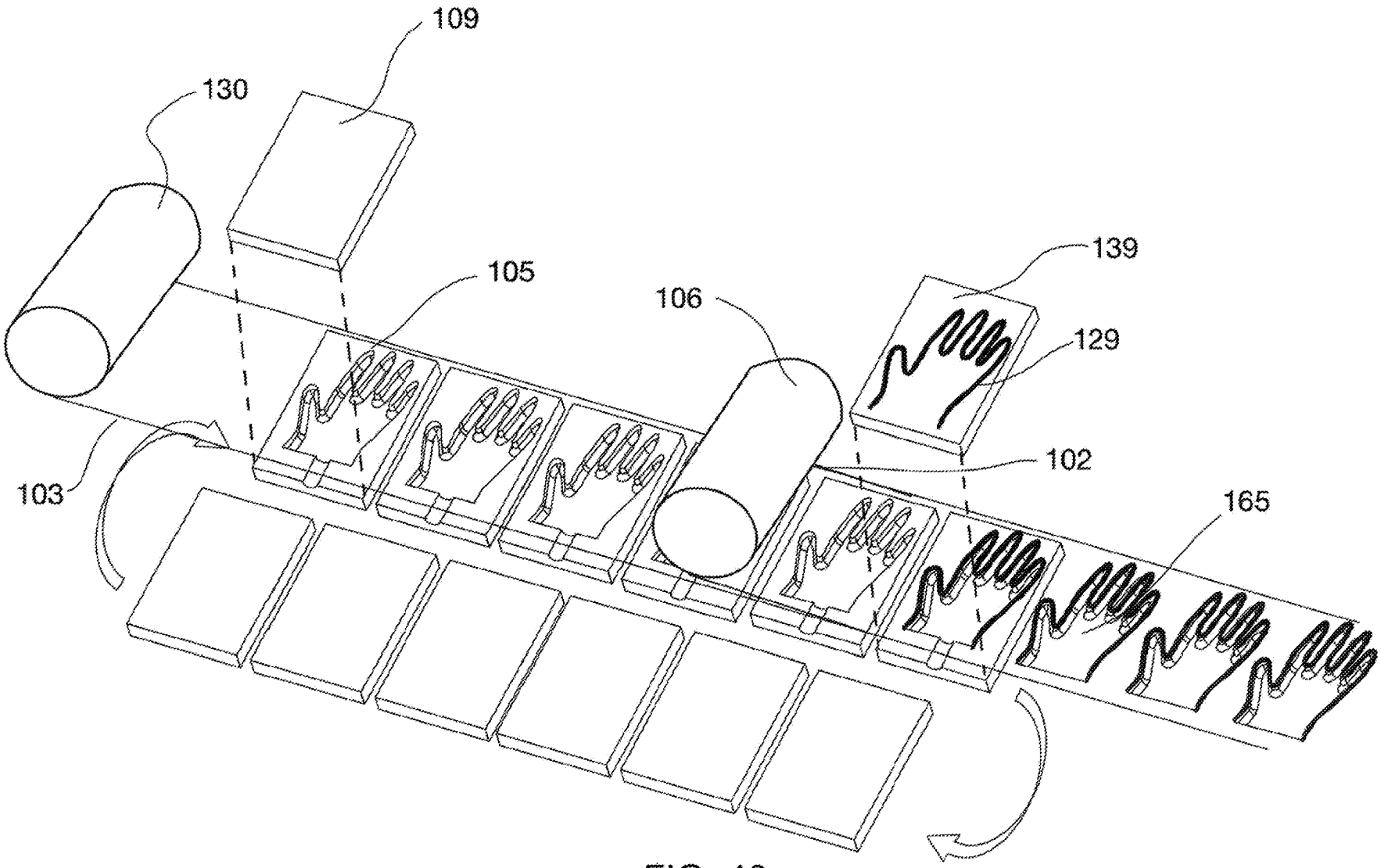
FIG. 46 depicts an alternate fabrication process for making disposable gloves in accordance with an embodiment.

In accordance with an embodiment of the present invention, an additional method for manufacturing formed gloves is identified in FIG. 46 where a series of cavities or forms 105 is used in a carousel to provide dwell time for the forming operation without having to stop film layer 103 from unspooling from film roll 130. An opposing cavity or form 109 may or may not be used and may or may not also be in a carousel and may be a cover or plate or the like. Film layer 102 from film roll 106 is introduced while film layer 103 is forming in a cavity or form 105 or after film layer 103 has been formed in said cavity or form 105. In accordance with one embodiment of the present invention, the perimeter seal operation occurs between a perimeter sealer 129 on perimeter sealing block 139 and a cavity or form 105.

Perimeter sealing block 139 is also practicable in a carousel or not. The perimeter sealing step also separates or removes formed glove 165 from the web composed of film layers 102 and 103 in accordance with an embodiment of the present invention.

Figure 47:
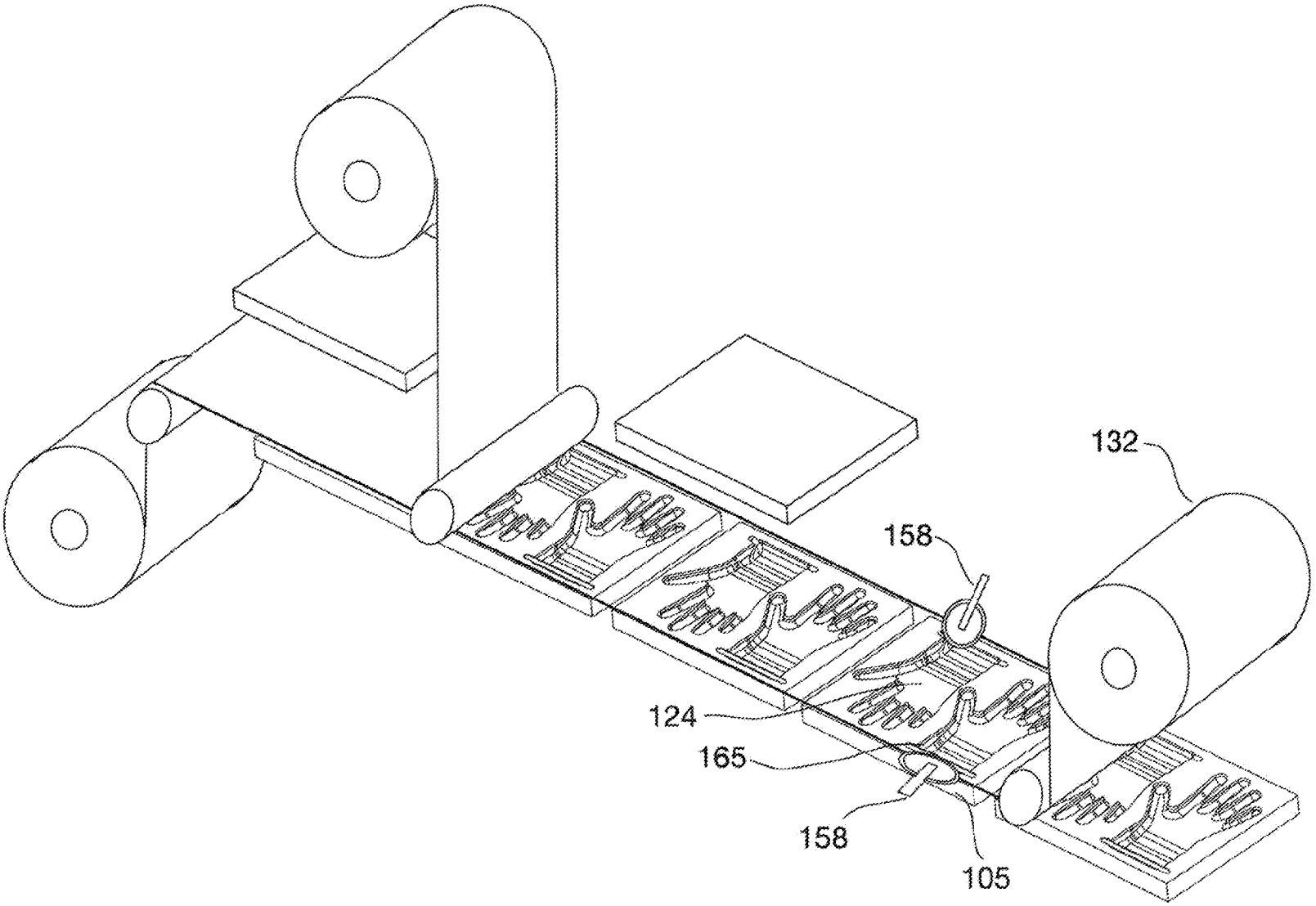
FIG. 47 depicts an alternate fabrication process for making disposable gloves in accordance with an embodiment.

FIG. 47 defines an additional formed glove manufacturing operation in accordance with an embodiment of the present invention, where a material take up roll 132 collects the non-glove material that can then go to regrind in order to melt and reuse the material. Angle blades 158 that are designed to plunge through the formed glove 165 and into the glove cavity or form 105 to create an angled offset cuff are also depicted in FIG. 47 such that an offset cuff area featuring material removed from only the posterior layer of the glove, is created by cutting across the width of the glove at an angle while glove is still in the mold. Cavities featuring areas for generating both a formed glove 165 and an opposing hand formed glove 124 are also shown in an effort to optimize the space utilization of the sheet material.

Figure 48:
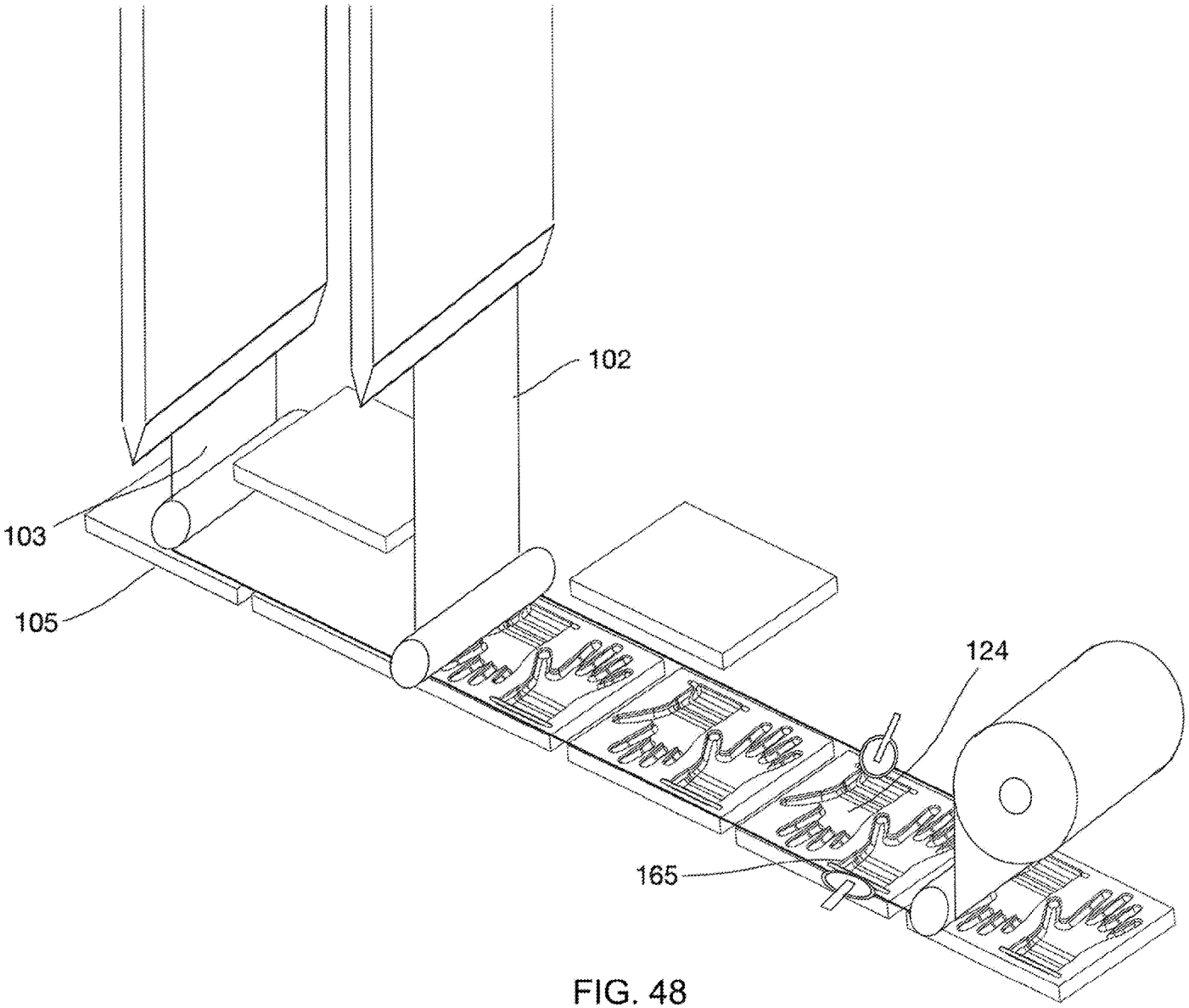
FIG. 48 depicts an alternate fabrication process for making disposable gloves in accordance with an embodiment.

In accordance with one embodiment of the present invention, pellet material is melted and extruded in sheet form and then formed in a heated state after exiting the extruder as shown in FIG. 48. Melting and forming the material after exiting the extruder simplifies the manufacturing process and provides for the creation of stress-free and uniform material thickness formed glove 165. For the manufacturing operation depicted in FIG. 48, a layer of extruded material is dispensed onto or into a glove cavity or form 105, which may or may not include vacuum forming, where a glove shape is created in film layer 103. A second film layer 102 of extruded material is introduced to overlay the glove and conveyed glove cavities retaining film layer 103 where film layer 102 is not formed and retains its flat state, which is then sealed to film layer 103 and cut to create formed glove 165. Although melting pellet material and extruding film layers is depicted in FIG. 48, other film manufacturing methods are also practicable in accordance with other embodiments of the present invention such as melting pellet material and extruding film for only one layer. Cavities featuring areas for generating both a formed glove 165 and an opposing hand formed glove 124 are also shown in FIG. 48 although cavities or forms with individual glove cavities or forms with alternating left and right gloves or some other variation that is understood by those of skill in the art is also practicable in accordance with other embodiments of the present invention.

In accordance with one embodiment of the present invention, gloves manufactured per the operations identified in FIGS. 44-48 are further processed for packaging and preparation for dispensing. Stacking gloves, staking or otherwise attaching or interconnecting gloves, or compressing gloves or any combination of steps described thereof or herein are also implementable as part of a manufacturing operation, in accordance with some embodiments of the present invention. In accordance with an embodiment of the present invention, gloves are stacked and compressed together to effectively flatten the formed layers for packaging as part of a manufacturing operation and are connected together in one or more glove mounting regions or gloves are packaged together as a stack per any of the embodiments described thereof or herein. In accordance with embodiments of the present invention, gloves compressed for packaging and dispensing out of a box or gloves are interwoven together to dispense cuff first from a box.

The gloves of the present invention are not restricted to particular applications and can be used in any application that a user sees fit including food preparation, cleaning, gas pumping, sanitary bathroom use, janitorial tasks, medical applications, industrial applications and the like. It should be noted that other gloves besides thermoplastic and two-layer disposable gloves, such as nitrile gloves and molded gloves, are usable with regards to glove stacks and dispensers in accordance with embodiments of the present invention.

To any extent utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about" and "approximately" are intended to cover variations that may exist in the upper and lower limits of the ranges of subjective or objective values, such as variations in properties, parameters, sizes, and dimensions. In one non-limiting example, the terms "about" and "approximately" mean at, or plus 10 percent or less, or minus 10 percent or less. In one non-limiting example, the terms "about" and "approximately" mean sufficiently close to be deemed by one of skill in the art in the relevant field to be included. As utilized herein, the term "substantially" refers to the complete or nearly complete extent or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A disposable glove comprising:

a first layer of thermoplastic material having a first perimeter border generally in a shape of a human hand and including a first middle section configured to span interchangeably a palmar aspect and a dorsal aspect of a user's hand based on whether the user's hand is left hand or right hand; and a second layer of thermoplastic material having a second perimeter border generally in the shape of a human hand and including a second middle section configured to span interchangeably a palmar aspect and a dorsal aspect of a user's hand based on whether the user's hand is a left hand or right hand;

the first layer and the second layer are coupled together at and along the first perimeter border and the second perimeter border in such a way that results in the disposable glove;

a biased open cuff opening configured to receive a user's left hand or a user's right hand therethrough;

wherein the first middle section and the second middle section have different total areas from each other in such a way that one of the first middle section and second middle section contain extra material and does not lay flat, causing the biased open cuff opening to maintain a steady-state open configuration facilitating donning of the disposable glove.

2. The disposable glove of claim 1, wherein at least one of the first layer and second layer comprises a starch based thermoplastic.

3. The disposable glove of claim 1, wherein the thermoplastic material of at least one of the first layer and second layer has a thickness between 0.5 mils and 3 mils.

4. The disposable glove of claim 1, wherein at least one of the first layer and the second layer comprises formed geometry.

5. The disposable glove of claim 4, wherein the formed geometry comprises a three-dimensional form generally shaped to fit a human hand.

6. The disposable glove of claim 4, wherein the formed geometry is formed by extruding the thermoplastic material to a depth between about 0.1 inches to about 2.5 inches.

7. The disposable glove of claim 4, wherein the formed geometry comprises features for facilitating compression of the disposable glove for storage.

8. The disposable glove of claim 7, wherein when in a compressed state, the extra material of the formed geometry provides structural rigidity to the disposable glove.

9. The disposable glove of claim 1, wherein at least one of the first layer or second layer has extra cuff length so to extend beyond the cuff opening of the other layer resulting in an offset cuff feature.

10. The disposable glove of claim 1, further comprising one or more mounting features for mounting the disposable glove.

11. The disposable glove of claim 10, where the one or more mounting features are configured to release with the disposable glove when the disposable glove is unmounted and donned by a user.

12. The disposable glove of claim 10, wherein the one or more mounting features are asymmetrical for facilitating correct orientation when mounting.

13. The disposable glove of claim 10, wherein the one or more mounting features are configured to facilitate the stacking of one or more disposable gloves in a compressed closed state.

14. The disposable glove of claim 1, wherein when the disposable glove is disposed within a stack of a plurality of disposable gloves underneath the plurality of disposable gloves, the biased open cuff is held in a closed state by the stack of the plurality of disposable gloves and returns to the steady-state open configuration when the disposable glove is disposed in a top most position on top of the stack of the plurality of disposable gloves.

15. The disposable glove of claim 14, wherein each glove in the stack of the plurality of disposable gloves further comprises one or more mounting features.

16. The disposable glove of claim 15, wherein the one or more mounting features are asymmetrical for facilitating correct orientation when mounting the stack in a dispenser.

17. The disposable glove of claim 15, wherein the one or more mounting features connect the disposable glove to the other disposable gloves in the stack.

18. The disposable glove of claim 14, wherein the stack of the plurality of disposable gloves consists of either right-handed or left-handed gloves.

* * * * *